US005623913A

United States Patent [19]

Kitajima et al.

[11] Patent Number: 5,623,913

[45] Date of Patent: Apr. 29, 1997

[54] FUEL INJECTION CONTROL APPARATUS

[75] Inventors: Shinichi Kitajima; Yusuke Hasegawa; Toshio Hayashi; Yoshitaka Takasuka, all of Wako, Japan

[73] Assignee: Honda Giken Kogyo Kabushiki Kaisha, Tokyo, Japan

[21] Appl. No.: 602,286

[22] Filed: Feb. 16, 1996

[30] Foreign Application Priority Data

| | | | |
|---|---|---|---|
| Feb. 27, 1995 | [JP] | Japan | 7-038856 |
| Feb. 27, 1995 | [JP] | Japan | 7-038867 |
| Feb. 27, 1995 | [JP] | Japan | 7-038868 |

[51] Int. Cl.[6] ..... F02D 41/14; G06G 7/70

[52] U.S. Cl. ..... 123/673; 123/687; 123/690

[58] Field of Search ..... 123/673, 679, 123/687, 690; 364/431.05, 421.07; 60/276

[56] References Cited

U.S. PATENT DOCUMENTS

| | | | |
|---|---|---|---|
| 4,934,328 | 6/1990 | Ishii et al. | 123/673 |
| 5,020,502 | 6/1991 | Wild | 123/673 |
| 5,131,371 | 7/1992 | Wahl et al. | 123/673 |
| 5,462,037 | 10/1995 | Hasegawa et al. | 123/673 |
| 5,548,514 | 8/1996 | Hasegawa et al. | 123/673 |
| 5,566,071 | 10/1996 | Akazaki et al. | 123/673 |

FOREIGN PATENT DOCUMENTS

| | | |
|---|---|---|
| 59-101562 | 6/1984 | Japan . |
| 5-180040 | 7/1993 | Japan . |

OTHER PUBLICATIONS

"Comptrol", Computer and Application's Mook, No. 27, Jul. 10, 1989, pp. 28–41.

"Automatic Control Handbook", Ohm, Ltd., Japan, pp. 701–707, Oct. 1983.

"A Survey of Model Reference Adaptive Techniques –Theory and Applications", Landau, *Automatica*, vol. 10, Jan. 1974, pp. 353–379.

"Unification of Discrete Time Explicit Model Reference Adaptive Control Designs", Landau et al, *Automatica*, vol. 17, No. 4, Jan. 1981, pp. 593–611.

"Combining Model Reference Adaptive Controllers and Stochastic Self–tuning Regulators", Landau, *Automatica*, vol. 18, No. 1, Jan. 1982, pp. 77–84.

*Primary Examiner*—Willis R. Wolfe

*Attorney, Agent, or Firm*—Nikaido, Marmelstein, Murray & Oram LLP

[57] ABSTRACT

A fuel injection apparatus for internal combustion engine of this invention applies detection output of a wide-range air/fuel ratio sensor to an observer so as to estimate an air/fuel ratio of individual cylinder and, based on thus estimated air/fuel ratio, obtains an air/fuel ratio correction coefficient for individual cylinder and correctively controls the fuel injection amount for individual cylinder with the air/fuel ratio correction coefficient for individual cylinder. While the estimation processing of the observer is always continued, the air/fuel ratio correction coefficient for individual cylinder is automatically adjusted, for example, when the estimated air/fuel ratio becomes an abnormal value, according to operational condition of the internal combustion engine, and the like, thereby securing the stability in the corrective control and preventing the emission from deteriorating. Also, the calculation processing of the air/fuel ratio correction coefficient for individual cylinder is thinned out at a predetermined timing in response to increase in the engine speed, for example, to shorten the corrective control, thereby achieving the purification of the exhaust gas even when the internal combustion engine is at a high speed.

10 Claims, 34 Drawing Sheets

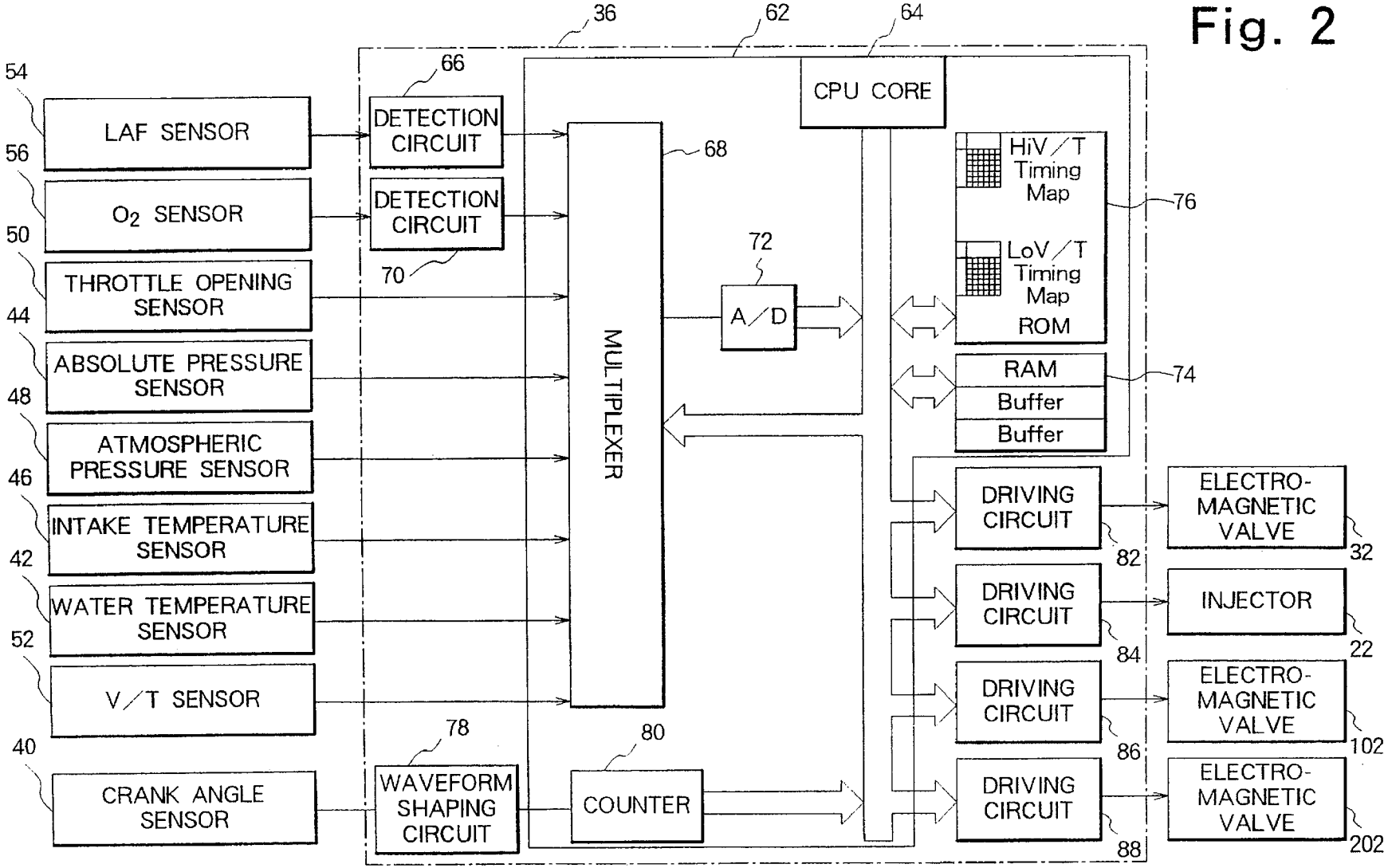
Fig. 2
ELECTRO-MAGNETIC VALVE
INJECTOR
ELECTRO-MAGNETIC VALVE
ELECTRO-MAGNETIC VALVE
32
22
102
202
HiV/T Timing Map
LoV/T Timing Map
ROM
RAM
Buffer
Buffer
DRIVING CIRCUIT
DRIVING CIRCUIT
DRIVING CIRCUIT
DRIVING CIRCUIT
76
74
82
84
86
88
CPU CORE
64
62
A/D
72
68
MULTIPLEXER
COUNTER
80
36
DETECTION CIRCUIT
DETECTION CIRCUIT
66
70
WAVEFORM SHAPING CIRCUIT
78
LAF SENSOR
$O_2$ SENSOR
THROTTLE OPENING SENSOR
ABSOLUTE PRESSURE SENSOR
ATMOSPHERIC PRESSURE SENSOR
INTAKE TEMPERATURE SENSOR
WATER TEMPERATURE SENSOR
V/T SENSOR
CRANK ANGLE SENSOR
54
56
50
44
48
46
42
52
40

FUEL INJECTION CONTROL APPARATUS

BACKGROUND OF THE INVENTION

1. Field of the Invention

The present invention relates to a fuel injection control apparatus in which the fuel injection amount of individual cylinder in a multiple cylinder internal combustion engine is controlled in order to further purify its exhaust gas.

2. Related Background Art

Conventionally, in fuel injection control apparatuses for internal combustion engines, there has been known a technique in which, in view of the fact that the degree of purification of exhaust gas is maximized at the theoretical air/fuel ratio, the air/fuel ratio is detected by an air/fuel ratio sensor (oxygen concentration sensor) disposed in the exhaust system and the fuel injection amount is feedback-controlled such that the detected air/fuel ratio becomes the theoretical air/fuel ratio in order to purify the exhaust gas (Japanese Unexamined Patent Publication Sho No. 59-101562).

Also, there has been known a technique in which a single above-mentioned air/fuel ratio sensor is disposed at the collective portion in the exhaust system of the multiple cylinder internal combustion engine, while a theoretical model of this exhaust system is constructed, and the detected value of the single air/fuel ratio sensor is applied to this theoretical model so as to estimate the air/fuel ratio of individual cylinder and, based on thus estimated value, to feedback-control the air/fuel ratio of individual cylinder to attain the theoretical value, thereby purifying the exhaust gas (Japanese Unexamined Patent Publication Hei No. 5-180040).

SUMMARY OF THE INVENTION

The present invention provides a fuel injection amount control apparatus for internal combustion engine, in which a wide-range air/fuel ratio sensor is disposed at a collective portion in an exhaust system of an internal combustion engine, the air/fuel ratio of an air-fuel mixture detected by the wide-range air/fuel ratio sensor is applied to an observer so as to estimate the air/fuel ratio of individual cylinder, the estimated air/fuel ratio of individual cylinder is applied to a PID control law so as to determine an air/fuel amount correction coefficient for individual cylinder, and a feedback control is effected by the correction coefficient so as to correct the fuel injection amount for individual cylinder, thereby purifying the exhaust gas.

When the estimated air/fuel ratio of individual cylinder assumed by the above-mentioned observer deviates from a predetermined range, it may be detected and then the correction control with respect to the cylinder deviating from that range or all the cylinders may be substantially stopped so as to reduce the influences among the cylinders caused by the feedback control, thereby preventing the stability in control from deteriorating.

In such a stop period, however, the observer continuously estimates the air/fuel ratio of individual cylinder. As a result, when the feedback control is restarted, the observer can be used to immediately determine, on the basis of history information on the last estimated air/fuel ratio of individual cylinder, the air/fuel ratio correction coefficient for individual cylinder immediately after the restarting, thereby enabling the feedback control for individual cylinder with an excellent response immediately after the restarting of the feedback control.

Also, the predetermined range for judging whether or not a cylinder has an estimated air/fuel ratio which abnormally deviates may be set on the basis of a target air/fuel ratio. As a result, even when the estimated air/fuel ratio drastically changes in response to change in the target air/fuel ratio during transient operation, the predetermined range can rapidly change in response to the change in the target air/fuel ratio. Accordingly, the period for stopping the air/fuel ratio control is prevented from being elongated due to the estimated air/fuel ratio which is deviated from the predetermined range.

Further, abnormality in at least one cylinder may be judged on the basis of the amount of change in the detected air/fuel ratio (i.e., air/fuel ratio of the air-fuel mixture) and, when there is abnormality, the feedback control for that cylinder may be substantially stopped so as to reduce its influence on the feedback control of the other cylinders. During this stop period, as mentioned above, the observer continuously estimates the air/fuel ratio of individual cylinder so as to secure an excellent response immediately after the restarting of the feedback control.

Also, abnormality in at least one cylinder may be judged on the basis of the amount of change in the target air/fuel ratio correction coefficient and, when there is abnormality, the feedback control for that cylinder may be substantially stopped so as to reduce its influence on the feedback control of the other cylinders. During this stop period, as mentioned above, the observer continuously estimates the air/fuel ratio of individual cylinder so as to secure the response.

Further, the present invention provides a fuel injection apparatus for internal combustion engine, in which it is judged whether or not there is abnormality in operational and environmental conditions of the internal combustion engine as well as detection sensors for measuring these conditions and, when it is judged that there is abnormality, the calculation of the air/fuel ratio correction coefficient for individual cylinder by the air/fuel ratio correction calculation means is stopped or the calculating speed of the air/fuel ratio correction coefficient for individual cylinder is changed to a value smaller than that in a normal state, thereby, for example, preventing the air/fuel ratio from being dispersed upon such abnormal conditions in order to maintain the stability in feedback control for individual cylinder.

Also, the present invention provides a fuel injection apparatus for an internal combustion engine, in which, when the cycle of TDC becomes shorter as the engine speed is higher, a so-called thinning-out processing, in which the above-mentioned calculation processing of the air/fuel ratio correction coefficient is successively shifted and stopped in order of stroke of cylinders, is effected and thereby the feedback control for individual cylinder is enabled even when the internal combustion engine is at a high speed. During this thinning-out operation, the above-mentioned estimating process of the air/fuel ratio is continued and the response of the air/fuel ratio control is prevented from being retarded, due to delay in the calculation of estimated air/fuel ratio of individual cylinder, at the time when the feedback control for individual cylinder using the estimated value of air/fuel ratio of individual cylinder is restarted.

Further, when the cycle of TDC becomes shorter as the engine speed is higher, the air/fuel ratio correction coefficient for individual cylinder may be fixed at a predetermined value or maintained at a correction coefficient value which has been determined just before so as to correct the fuel injection amount to be supplied to each cylinder. In this manner, the calculation processing of air/fuel ratio correction coefficient for individual cylinder may be reduced so as to shorten the processing time for feedback control of individual cylinder, thereby enabling the feedback control for individual cylinder to deal with the internal combustion engine at a high speed. Also, in this case, the above-mentioned estimating process of the air/fuel ratio is continued and the response of the air/fuel ratio control is prevented from being retarded, due to delay in the calculation of estimated air/fuel ratio of individual cylinder, at the time when the feedback control for individual cylinder using the estimated value of air/fuel ratio of individual cylinder is restarted.

Also, when the cycle of TDC becomes shorter as the engine speed is higher, the above-mentioned calculation processing of the air/fuel ratio correction coefficient for individual cylinder by the air/fuel ratio correction coefficient calculating means may be stopped. However, the estimation processing of the air/fuel ratio of individual cylinder by the air/fuel ratio estimating means is continued. Accordingly, the feedback control for individual cylinder which deals with the internal combustion engine at a high speed can be realized, while the response of the air/fuel ratio control can be prevented from being retarded, due to delay in the calculation of estimated air/fuel ratio of individual cylinder, at the time when the feedback control for individual cylinder using the estimated value of air/fuel ratio of individual cylinder is restarted.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

FIG. 2 is a block chart showing the constitution of the control unit depicted in FIG. 1;

DETAILED DESCRIPTION OF THE PREFERRED EMBODIMENTS (First Embodiment)

The first embodiment of the fuel injection control apparatus for internal combustion engine in accordance with the present invention will be explained with reference to drawings. As a typical example, the apparatus being applied to a four-cylinder internal combustion engine will be explained.

Figure 1:
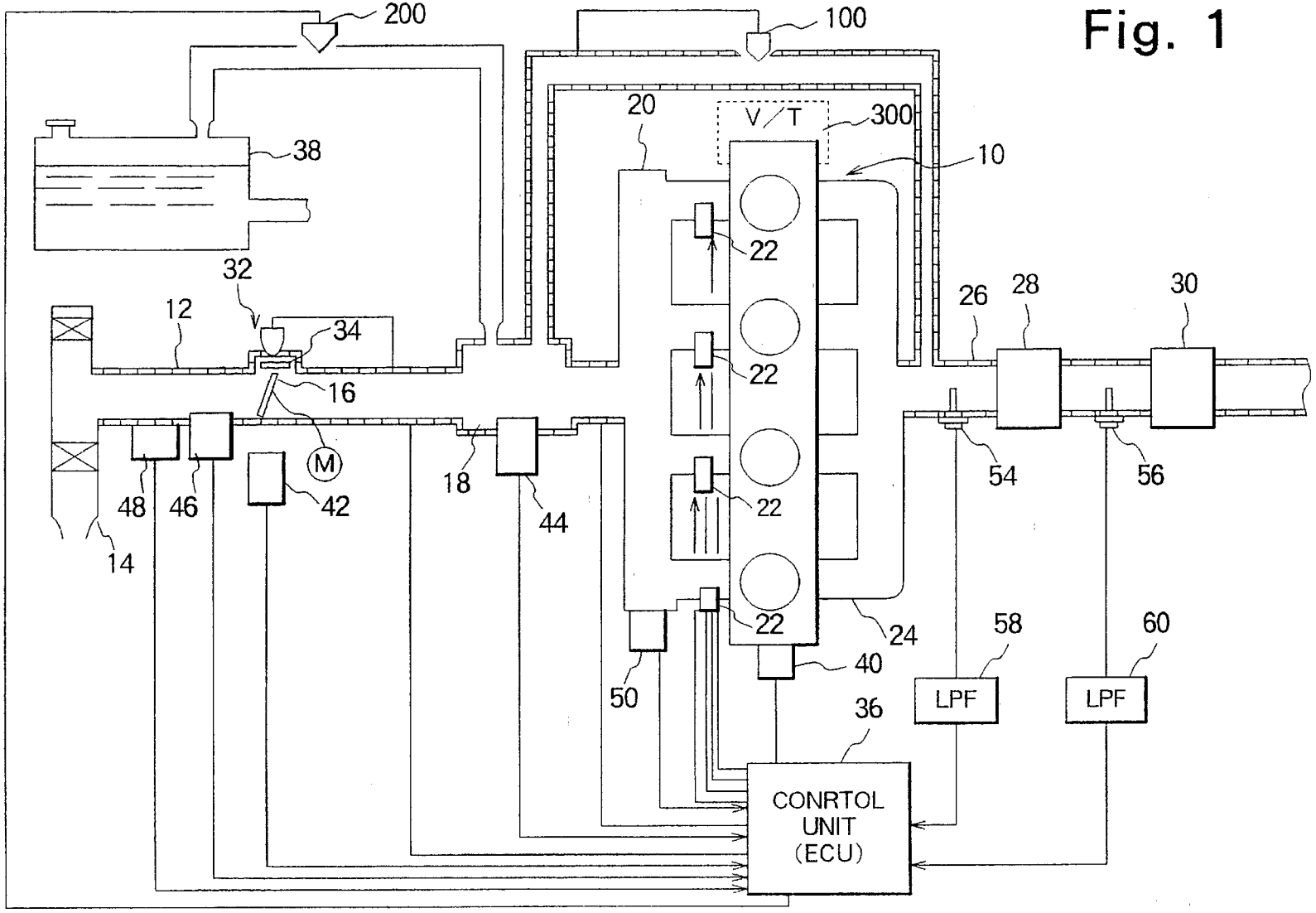
FIG. 1 is a schematic constitutional view showing the overall constitution of a fuel injection apparatus for internal combustion engine in accordance with an embodiment of the present invention.

FIG. 1 is a schematic view showing the overall constitution of this fuel injection apparatus. In this drawing, the intake air introduced from an air cleaner 14 disposed at a tip of an intake pipe 12, while being flow-controlled by a throttle valve 16, passes through a surge tank 18 and an intake manifold 20 and then, by way of intake valves (not shown) for discrete cylinders, flows into the discrete cylinders of a four-cylinder internal combustion engine 10.

In the proximity of the above-mentioned intake valve for individual cylinder, a injector 22 for fuel injection is disposed such that a mixture of the intake air and the injected fuel is ignited by a spark plug (not shown) disposed in individual cylinder and burned so as to drive each piston (not shown).

The exhaust gas after the combustion is discharged, by way of exhaust valves (not shown) for the discrete cylinders, into an exhaust manifold 24 and then, by way of an exhaust pipe 26 connected to a collective portion of the exhaust manifold 24, purified by a first catalytic converter rhodium apparatus 28 and a second catalytic converter rhodium apparatus 30 before being discharged out of the engine.

The throttle valve 16 is controlled and driven by a pulse motor M which rotates according to operational conditions such as the amount of acceleration of the accelerator pedal. In the intake pipe 12, near the throttle valve 16, there is disposed a by-pass path 34 which controls the secondary air amount according to the opening/closing amount of an electromagnetic valve 32. As in the case of generally-known mechanisms, the throttle valve 16 may be mechanically interlocked with the accelerator pedal.

Also, the internal combustion engine 10 has an exhaust circulating mechanism (i.e., EGR mechanism) 100 which, by controlling the opening/closing amount of an electromagnetic valve (not shown), circulates a part of the exhaust gas into the intake system and a canister purge system 200 which supplies the evaporated fuel (i.e., purge gas) generated within a fuel tank 38 to the intake system according to the opening/closing amount of an electromagnetic valve (not shown).

Further, the internal combustion engine 10 has a so-called variable valve-timing mechanism 300 disclosed, for example, in Japanese Unexamined Patent Publication Hei No. 2-275043, by which the valve timing V/T of the internal combustion engine 10 is variably controlled between two timing characteristics LoV/T and HiV/T according to parameters which indicate operational conditions such as engine speed Ne and intake pressure Pb in the intake system.

Also, within a distributer (not shown) in the internal combustion engine 10, a crank-angle detecting sensor 40 for detecting the crank angle position of the piston (not shown) is disposed. In the proximity of the throttle valve 16, a throttle-opening detecting sensor 42 for detecting the throttle opening $\theta_{TH}$ thereof is disposed. The intake pipe 12 has an absolute pressure sensor 44 for detecting the intake pressure (i.e., absolute pressure) Pb downstream of the throttle valve 16 and an intake temperature sensor 46 for detecting the intake temperature upstream of the throttle valve 16. At appropriate positions in the internal combustion engine 10, an atmospheric pressure sensor 48 for detecting the atmospheric pressure Pa and a water temperature sensor 50 for detecting the temperature Tw of engine cooling water are disposed. Though not depicted in FIG. 1, a detection sensor 52 for detecting the selected valve timing characteristic is disposed in the variable valve timing mechanism 300. Detection signals of these sensors 40 to 52 are sequentially supplied to a control unit 36.

In the exhaust pipe 26, at a portion upstream of the catalytic converter rhodium apparatus 28, a wide-area air/fuel ratio sensor 54 is installed as a first air/fuel ratio detecting means, while an $O_2$ sensor 56 is installed between the catalytic converter rhodium apparatuses 28 and 30 as a second air/fuel ratio detecting means.

As the wide-area air/fuel ratio sensor 54, an LAF sensor disclosed, for example, in Japanese Unexamined Patent Publication Hei No. 2-11842 is utilized. This LAF sensor 54 has a wide-range characteristic in which the oxygen concentration in the exhaust gas can be linearly detected in a wide range from lean to rich. Detection signals of the LAF sensor 54 and $O_2$ sensor 56 are supplied to the control unit 36 by way of low path filters 58 and 60 which are set with predetermined cut-off frequencies, respectively.

In the following, the system constitution of the control unit 36 will be explained with reference to the circuit block diagram of FIG. 2. In the control unit 36 provided with a microprocessor 62 and various I/O ports, a central control unit (referred to as "CPU core" in the following) 64 executes various application programs which have been made into firmware in a ROM 76, thereby effecting feedforward control and feedback control operations which will be explained later.

The detection signal of the LAF sensor 54 is input into a first detection circuit 66 by way of the above-mentioned low pass filter 58. The detection circuit 66 effects a predetermined linearization processing of this detection signal so as to obtain a linear air/fuel ratio (A/F) in proportion to the oxygen concentration in the exhaust gas in a wide range from lean to rich and then outputs thus obtained linear air/fuel ratio to a multiplexer 68. The detection signal from the $O_2$ sensor 56 is input into a second detection circuit 70 by way of the above-mentioned low pass filter 60. The detection circuit 70 applies this detection signal value to a characteristic curve such as the one shown in FIG. 3 to generate a signal indicating whether the air/fuel ratio supplied to the internal combustion engine 10 is rich or lean with respect to the theoretical air/fuel ratio ($\lambda$=1) and then outputs thus generated signal to the multiplexer 68. Also, the detection signals from the above-mentioned sensors 42 to 52 are supplied to the multiplexer 68. Then, these signals are time-divisionally transmitted to an A/D converter 72 by way of the multiplexer 68, which changes over channels in synchronization with a predetermined switching timing, and then converted into digital data to be stored in a predetermined buffer area of a random access memory (RAM) 74 or to be subjected to calculation by the CPU core 64. In this embodiment, the A/D converter 72 A/D-converts the detection signal from the second detection circuit 70 per a predetermined crank angle (e.g., 15 degrees).

Further, the detection signal from the crank angle sensor 40 is waveform-shaped into a two-valued logic rectangular signal and then counted at a counter 80. Thus counted value is also stored in a predetermined buffer area of the RAM 74 or subjected to calculation by the CPU core 64.

Figure 4:
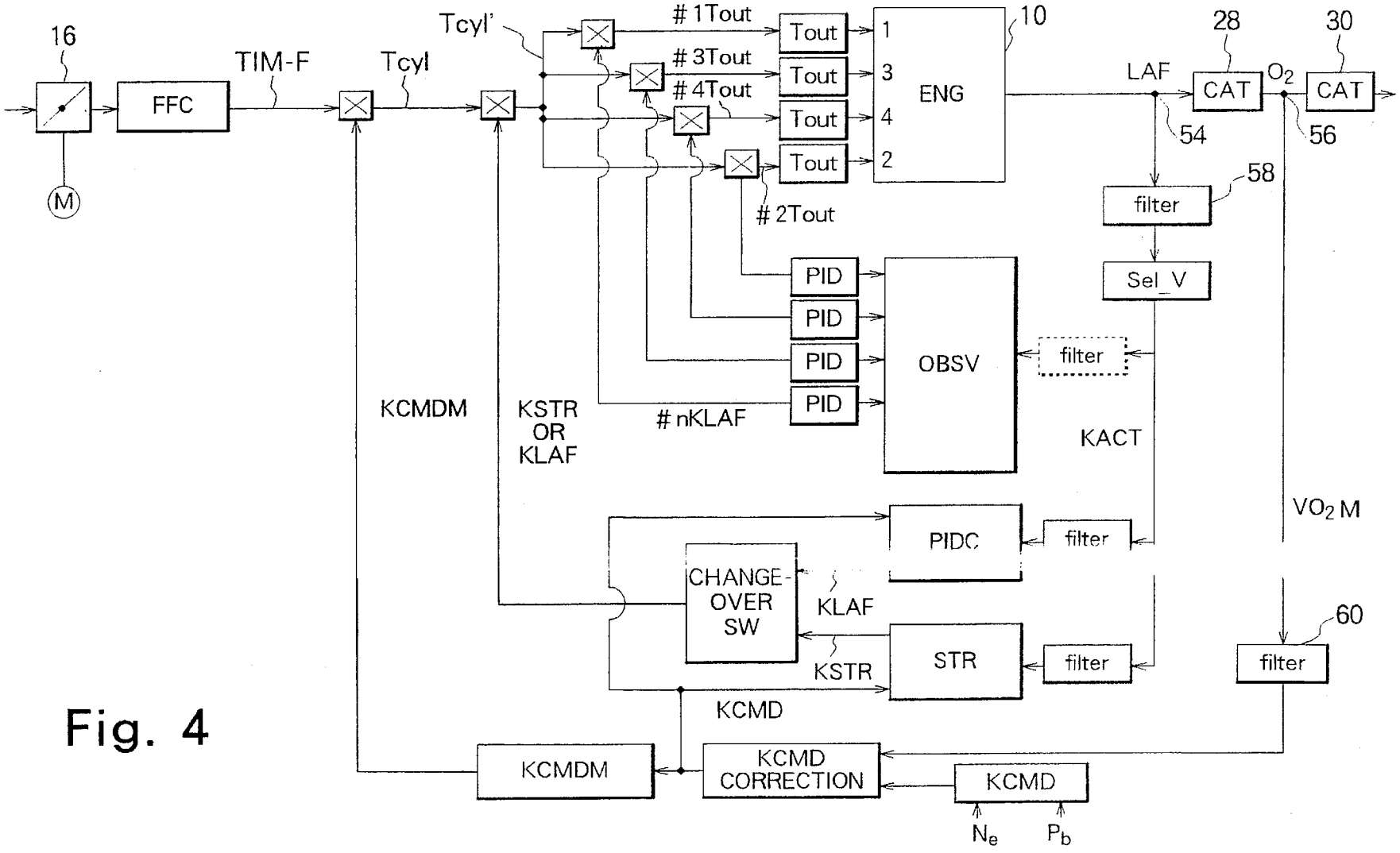
FIG. 4 is a block chart showing functions of the fuel injection apparatus for the internal combustion engine in accordance with the above-mentioned embodiment of the present invention.

In a read only memory (ROM) 76, the above-mentioned various application programs, map data of the above-mentioned timing characteristics LoV/T and HiV/T, and map data for various retrieval operations which will be explained later have been stored beforehand. As the CPU core 64 executes the above-mentioned application programs while applying the various data in the RAM 74 and ROM 76 thereto, an optimal fuel injection control condition corresponding to an actual operational condition is obtained. Then, the injector 22, the electromagnetic valve 32, the above-mentioned electromagnetic valve 102 of the exhaust circulating mechanism (i.e., EGR mechanism) 100, and the above-mentioned electromagnetic valve 202 of the canister purge mechanism 200 are controlled by way of driving circuits 82 to FIG. 4 is a block diagram showing functions of the fuel injection control apparatus in accordance with this embodiment. It includes a feedforward control system for compensating for the characteristics of the intake system with respect to the internal combustion engine 10 and three kinds of feedback control systems. As the above-mentioned application programs are run, the control functions equivalent to those of this block diagram are performed.

Figure 5:
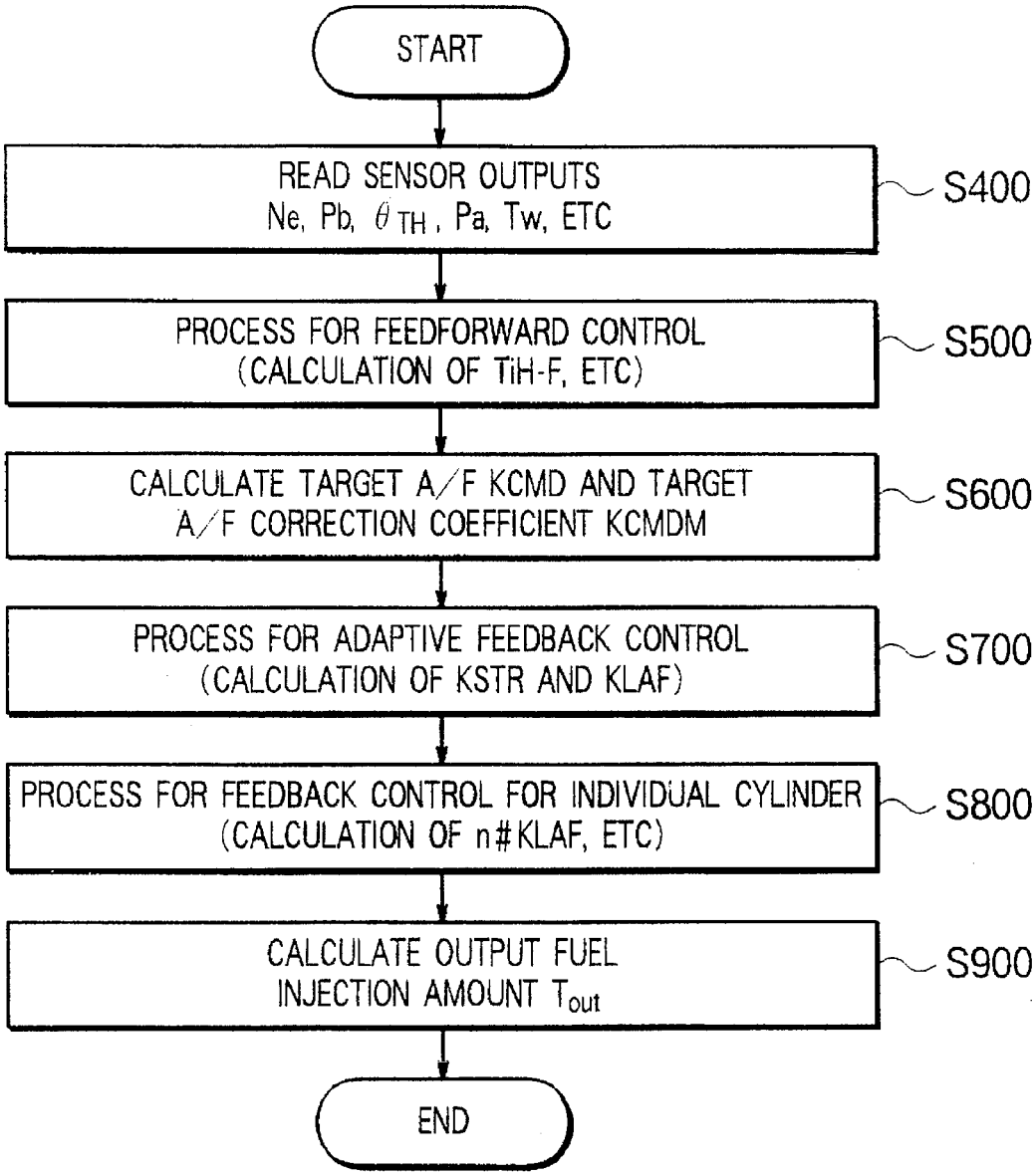
FIG. 5 is a flow chart explaining actions of the fuel injection apparatus.

Namely, as indicated by the main flow chart shown in FIG. 5, the latest outputs from the various sensors such as engine speed Ne, intake pressure Pb, throttle opening $\theta_{TH}$, and cooling water temperature Tw are read into the RAM 74 at step S400 and then the above-mentioned calculation processing of the feedforward control system is performed at step S500 so as to determine a basic fuel injection amount TiM–F. At step S600, the calculation processing of the first feedback system is performed so as to obtain a target air/fuel ratio KCMD, a target air/fuel ratio correction coefficient KCMDM, and the like. At step S700, the calculation processing of the second feedback system is performed so as to obtain adaptive feedback control correction coefficients KSTR, KLAF, and the like. At step S800, the calculation processing of the third feedback system is performed so as to obtain an air/fuel ratio correction coefficient for individual cylinder #nKLAF. At step S900, the basic fuel injection amount TiM–F is multiplied by the target air/fuel ratio correction coefficient KCMDM and the correction coefficient KSTR or KLAF and #nKLAF, for example, to determine a final output fuel injection amount for individual cylinder #nTout and then the injector 22 is driven. Here, prefix #n refers to individual cylinder and the output fuel injection amount #nTout defines the valve-opening period of the injector 22. The processing of this main flow chart is performed in synchronization with TDC.

In the following, the function of each block will be explained. First, the feedforward control system (indicated as "FFC" in FIG. 4) will be briefly explained since it is disclosed in Japanese Patent Application Hei No. 6-197238. In this system, a hydrodynamic model (i.e., mathematic model) or the like of the whole effective volume from the downstream of the throttle valve 16 to the intake port of individual cylinder (i.e., the corresponding portion of the intake pipe 12 and a chamber containing the surge tank 18 and the like) is constructed and then the throttle opening $\theta_{TB}$ and the intake pressure Pb are applied to this hydrodynamic model so as to determine the optimal basic fuel injection amount TiM–F for all operational conditions including not only steady operational conditions but also transient operational conditions.

Figure 6:
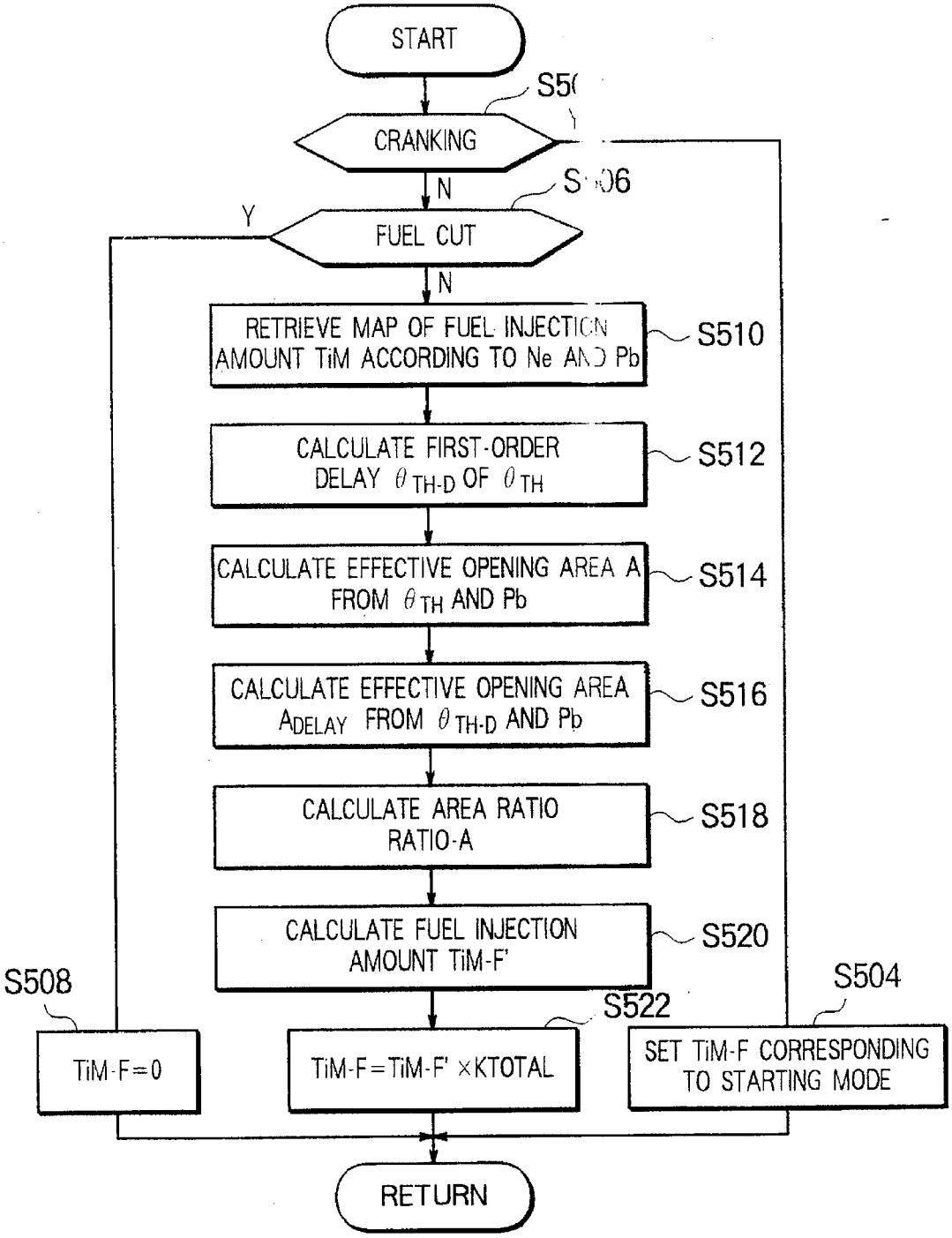
FIG. 6 is a flow chart explaining actions of a feedforward system.
Figure 7:
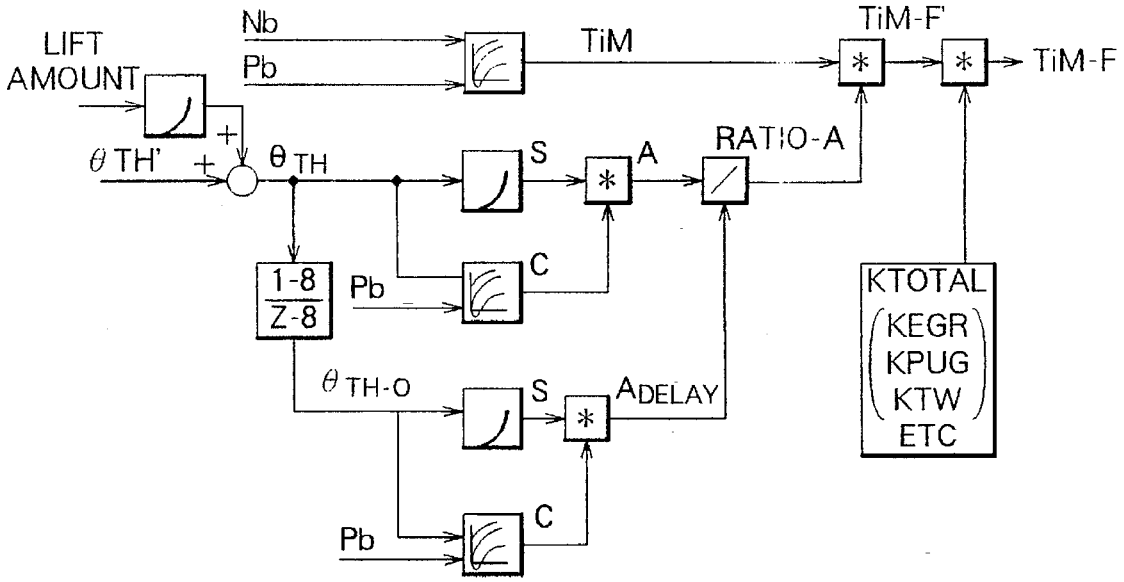
FIG. 7 is a block diagram explaining functions of the feedforward system.

FIG. 6 is a flow chart showing a calculation routine for the basic fuel injection amount TiM–F (corresponding to step S500 in FIG. 5), whereas FIG. 7 is a block diagram explaining this calculation routine. The function of the feedforward control system will be further explained with reference to these drawings.

At step S502, it is judged whether the engine is under a starting condition or not. When it is judged positive, a basic fuel injection amount TiM–F corresponding to a start mode is set at step S504. When it is judged negative, on the other hand, it is further judged whether the engine is under a fuel-cut condition or not at step S506. When it is judged positive at this step, a fuel-cut basic fuel injection amount TiM–F(=0) is set at step S508. When it is judged negative at that step, on the other hand, further processing operations begin at step S510 in order to set a basic fuel injection amount corresponding to a normal operational condition.

At step S510, a predetermined map in the ROM 76 is retrieved using the engine speed Ne and intake pressure Pb as parameters so as to obtain a fuel injection amount (i.e. standard value) during a steady operational condition TiM. Namely, based on a speed density method, the fuel injection amount TiM has been obtained with parameters of the engine speed Ne and intake amount Pb beforehand and stored in the ROM 76 as map data.

At step S512, the value of throttle opening $\theta_{TH}$ is applied to a first-order delay transfer function (1–B)/(Z–B) so as to calculate a first-order delay value $\theta_{TH\text{-}D}$ of the throttle opening $\theta_{TH}$. Namely, since the change in the throttle opening $\theta_{TH}$ during the transient operational condition does not directly correspond to the intake air amount of the intake port, the first-order delay amount $\theta_{TH\text{-}D}$ is used to approximate it. Here, "B" in the transfer function is a coefficient.

At step S514, as shown in FIG. 7, a map which has been stored beforehand in the ROM 76 is retrieved so as to obtain a throttle projection area (i.e., throttle projection area in the longitudinal direction of the intake pipe) S corresponding to the throttle opening $\theta_{TH}$ and a correction coefficient (i.e., product of a flow rate coefficient $\alpha$ and an air expansion correction coefficient $\epsilon$) C corresponding to the throttle opening $\theta_{TH}$ and intake pressure Pb. Then, the throttle projection area S is multiplied by the correction coefficient C to calculate an effective throttle opening area A during the steady operational condition.

At step S516, as shown in FIG. 7, a map which has been stored beforehand in the ROM 76 is retrieved so as to obtain a throttle projection area S corresponding to the first-order delay value $\theta_{TH\text{-}D}$ of the throttle opening and a correction coefficient C corresponding to the first-order delay value $\theta_{TH\text{-}D}$ and intake pressure Pb. Then, this throttle projection area S is multiplied by the correction coefficient C to calculate an effective throttle opening area $A_{DELAY}$ during the transient operational condition.

At step 518, taking the cross section of the opening $A_{BYPASS}$ of the by-pass path 34, a ratio RATIO-A of the effective opening area A during the steady operational condition to the effective opening area $A_{DELAY}$ during the transient operational condition is calculated according to the following equation:

<equation 1>

$$\text{RATIO}-A=\frac{A+A_{BYPASS}}{A_{DELAY}+A_{BYPASS}}$$

At step S520, the fuel injection amount TiM is multiplied by the ratio RATIO-A to obtain a fuel injection amount TiM–F' which is applicable to the steady operational condition and transient operational condition. Namely, since the value of the ratio RATIO-A becomes 1 under the steady operational condition and a certain value other than 1 under the transient operational condition, thus obtained amount corresponds to both the steady operational condition and transient operational condition. Therefore, when the fuel injection amount TiM is multiplied by the ratio RATIO-A, the fuel injection amount TiM–F' which is applicable to the steady operational condition and transient operational condition is obtained.

At step S522, a predetermined map is retrieved on the basis of parameters such as the engine speed Ne, intake pressure Pb, intake air temperature, cooling water temperature Tw, purge gas concentration PUG, and exhaust-gas circulation ratio so as to obtain a correction coefficient KTOTAL. Then, the fuel injection amount TiM–F' is multiplied by the correction coefficient KTOTAL to determine a basic fuel injection amount TiM–F in which the influences of the EGR mechanism 100 and canister purge mechanism 200 are compensated for.

In this manner, even when the amount of air flowing into the cylinder fluctuates in response to changes in operational conditions, this feedforward control system determines the optimal basic fuel injection amount TiM–F corresponding to the amount of air flowing into the cylinder on the basis of the throttle opening $\theta_{TH}$ and intake pressure Pb.

In the following, the first feedback system will be explained. This feedback system has function blocks indicated as "KCMD", "KCMD CORRECTION", and "KCMDM" in FIG. 4 and performs a calculation processing in accordance with the flow chart shown in FIG. 8 (corresponding to step S600 in FIG. 5).

Figure 8:
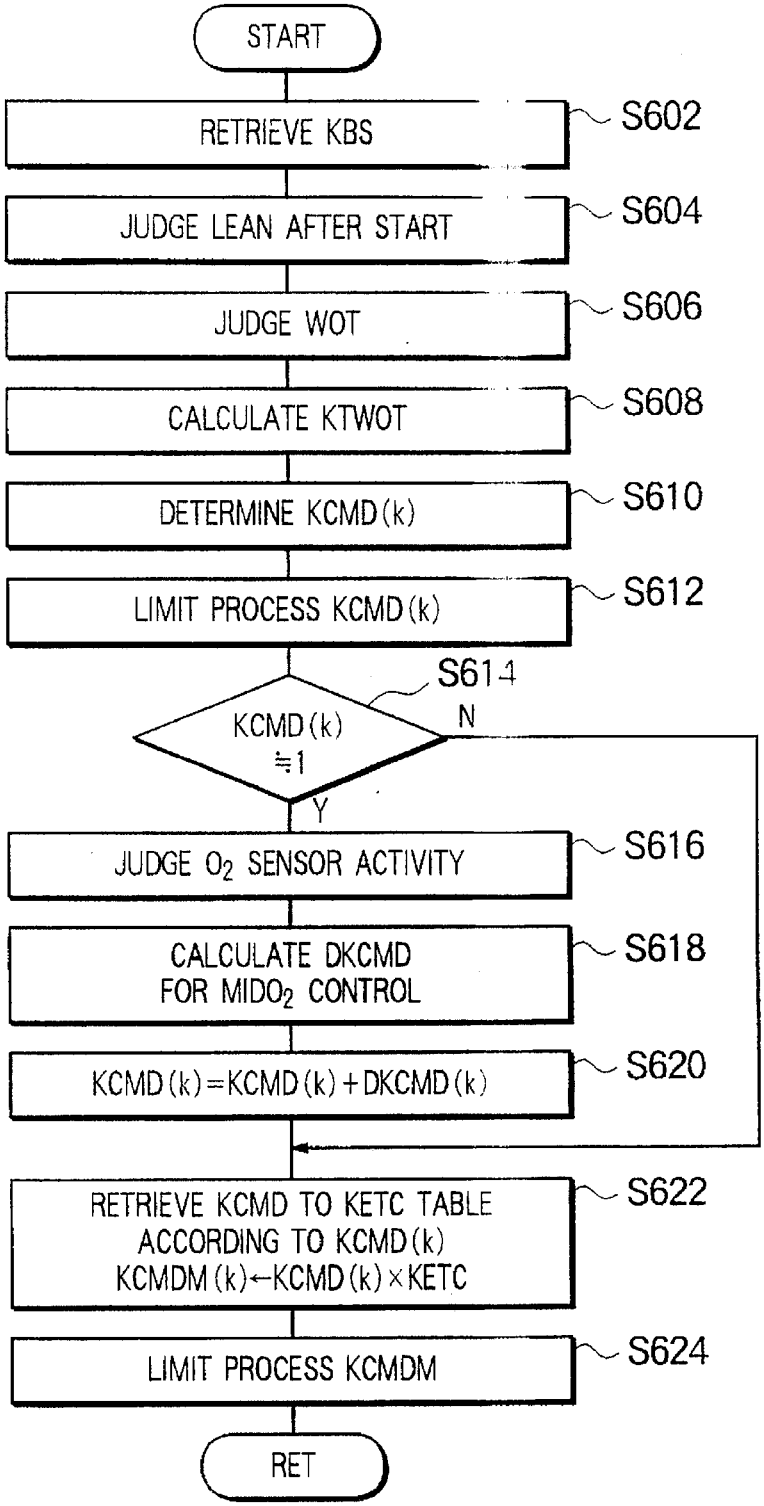
FIG. 8 is a flow chart explaining actions of a first feedback system.

First, at step S602 in FIG. 8, a predetermined map in ROM 76 is retrieved using the engine speed Ne and intake pressure Pb as parameters to obtain a basic value KBS of air/fuel ratio. Namely, this basic value KBS is a kind of air/fuel data which can be obtained from the output of the $O_2$ sensor 56 during the steady operational condition and has been stored in the ROM 76 beforehand. This map also stores a basic value corresponding to an idle operational condition. Further, in a so-called lean-burn engine in which, in order to improve burning characteristics, the air/fuel ratio to be supplied to the engine is increased (or decreased in terms of equivalent ratio) when the engine is under a low load, a basic value for lean-burn is also stored.

At step S604, the value of an internal timer circuit (not shown) is referred to so as to judge whether a lean-burn control after the starting of the engine is performed or not. The lean correction coefficient is set, for example, at 0.89 in the case of lean-burn control period and at 1.0 in the other case.

Such a judgment is performed because of the following reason. Namely, this is because, since the internal combustion engine 10 has the variable valve timing mechanism 300 and the action of one of the intake valves in individual cylinder is stopped during the cranking period after the starting (i.e., starting period) so as to perform a lean-burn control operation by which the target air/fuel ratio is set at a position slightly leaner than the theoretical air/fuel ratio, thereby yielding an effect that hydrocarbon (HC) is prevented from increasing even during the starting period where the catalyst apparatus has not been activated yet. In a normal internal combustion engine having two intake valves per cylinder (i.e., internal combustion engine having no variable valve timing mechanism), when the target air/fuel ratio is set leaner after the starting of the engine, misfire may occur due to unstable burning within the engine. In the internal combustion engine having the variable valve timing mechanism 300 in accordance with this embodiment, on the other hand, since a vortex called "swirl" is generated within the combustion chamber when one of the intake valves is stopped, stable burning can be obtained even when leaning is performed immediately after the starting of the engine.

At step S606, it is judged whether the throttle opening is full open (WOT) or not and then, based on the result of this judgment, a full-open weighting correction coefficient is calculated. Further, at step S608, it is judged whether the cooling water temperature Tw is high or not and then, based on the result of this judgment, a weighting correction coefficient KTWOT is calculated. This weighting correction coefficient KTWOT includes a correction coefficient value for protecting the engine when the water temperature is high.

Figure 3:
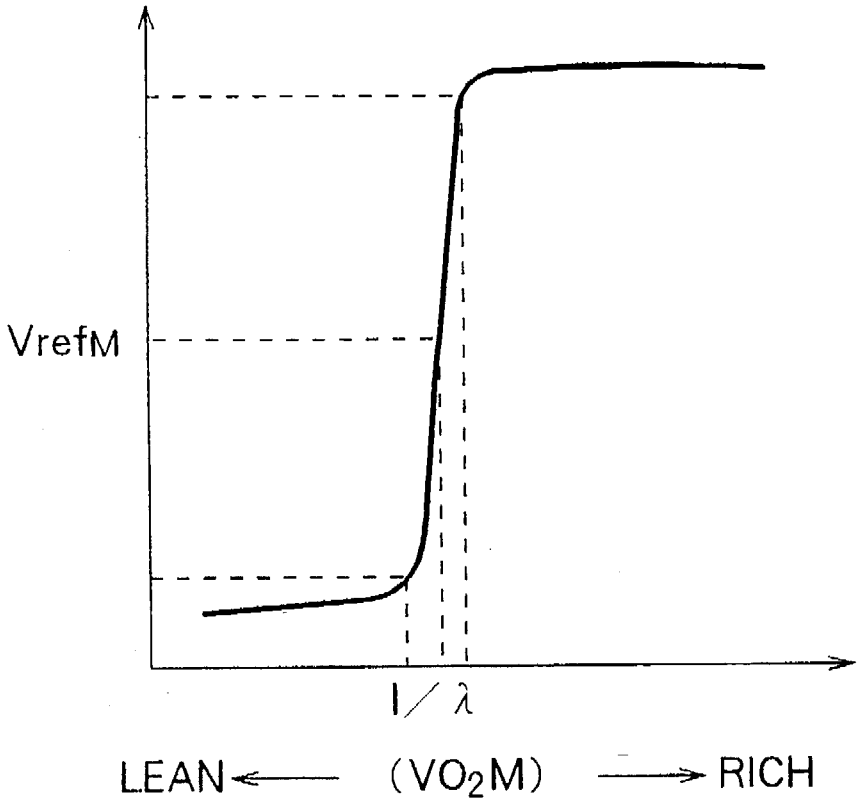
FIG. 3 is an explanatory chart showing an output characteristic of the $O_2$ sensor depicted in FIG. 1.

At step S610, the basic value KBS is multiplied by the correction coefficient KTWOT so as to correct the basic value KBS, while the target air/fuel ratio KCMD is determined by the following equation 2. Namely, as shown in FIG. 3, after a window (referred to as "DKCMD–OFFSET" in the following) for performing minute control of air/fuel ratio is set within the range (indicated by broken lines in the vertical axis) where the output of the $O_2$ sensor 56 has a linear characteristic in the proximity of the theoretical air/fuel ratio, this window value DKCMD–OFFSET is added to the above-mentioned basic value KBS obtained after the correction so as to obtain the target air/fuel ratio KCMD.

<equation 2>

$$KCMD=KBS+DKCMD-OFFSET$$

Then, at step S612, a limit processing of a target air/fuel ratio KCMD(k) (wherein k is time) is performed. Thereafter, at step S614, it is judged whether this target air fuel ratio KCMD(k) approximates 1 or not. When it is judged positive, further judgment is performed at step S616 concerning activation of the $O_2$ sensor 56. This activation judgment is performed, in a separate routine not shown, by detecting voltage changes in the detection signal of the $O_2$ sensor 56.

Next, at step S618, a value DKCMD for $MIDO_2$ control is calculated. Here, "$MIDO_2$ control" refers to an operation in which the target air/fuel ratio KCMD(k) of the upstream LAF sensor 54 is made variable by the output of the $O_2$ sensor 56 downstream of the catalytic converter rhodium apparatus 28. More specifically, as shown in FIG. 3, it is performed when a PID control law is applied to a deviation between a predetermined reference voltage VrefM and an output voltage V02M of the $O_2$ sensor 56 so as to calculate the value DKCMD. The reference voltage VrefM is obtained with reference to the atmospheric pressure Pa, water temperature Tw, exhaust volume (which can be obtained from the engine speed Ne and intake pressure Pb), and the like.

Further, the above-mentioned window value DKCMD–OFFSET is an offset value to be added in order to maintain the purification ratio of the catalytic converter rhodium apparatuses 28 and 30 under their optimal conditions. Since it may vary due to intrinsic characteristics of the catalyst apparatus, it is determined in view of the characteristics of the catalytic converter rhodium apparatus 28. Also, since the window value DKCMD–OFFSET may vary due to the aged deterioration of the catalytic converter rhodium apparatuses 28 and 30, it is learned by weighted mean using every calculated value DKCMD. Specifically, it ks obtained by the following operation expression:

<equation 3>

$$DKCMD\text{–}OFFSET(k)=W\cdot DKCMD+(1-W)\cdot DKCMD\text{–}OFFSET(k-1)$$

wherein W is a weight coefficient and k is time or, more specifically, control cycle. Namely, the target air/fuel ratio. KCMD is obtained by an learning operation of the last calculated value of the window value DKCMD–OFFSET so as to be feedback-controlled to an air/fuel ratio at which the purification ratio of the catalyst apparatuses 28 and 30 is optimized without being influenced by their aged deterioration.

Next, at step S620, the target air/fuel ratio KCMD(k) is added to thus calculated value DKCMD(k) so as to set (renew) a new target air/fuel ratio KCMD(k). Then, at step S622, a predetermined table in the ROM 76 is retrieved on the basis of the renewed target air/fuel ratio KCMD(k) so as to obtain a correction coefficient KETC. The correction coefficient KETC is used to compensate for differences in charging efficiency of the intake air caused by heat of vaporization. Specifically, thus obtained correction coefficient KETC is multiplied by the target air/fuel ratio KCMD (k) to calculate a corrected (renewed) target air/fuel ratio correction coefficient KCMDM(k). Namely, in this control operation, the target air/fuel ratio is indicated by equivalent ratio, while a value in which this ratio is corrected for its charging efficiency is provided as the target air/fuel ratio correction coefficient KCMDM(k).

When a negative judgment is made at the above-mentioned step S614, the target air/fuel ratio KCMD(k) is greatly deviating from the theoretical air/fuel ratio. For example, it is during a lean-burn operational condition. In such a case, the processing immediately jumps to step S622.

Finally, at step S624, a limit processing of the target air/fuel ratio correction coefficient KCMD(k) is performed and then, as shown in FIG. 4, the basic fuel injection amount TiM–F from the feedforward control system is multiplied by the target air/fuel ratio correction coefficient KCMDM(k) to calculate a required fuel injection amount Tcyl.

As explained in the foregoing, this first feedback system has a function in which the above-mentioned predetermined correction processing is conducted, on the basis of the output of the $O_2$ sensor 56, with respect to the basic air/fuel ratio value KBS under the steady operational condition so as to obtain the target air/fuel ratio KCMD and the target air/fuel ratio correction coefficent KCMDM, while the basic fuel injection amount TiM–F is multiplied by the target air/fuel ratio correction coefficient KCMDM to calculate the required fuel injection amount Tcyl which can set an ideal air/fuel ratio for the catalyst apparatuses.

In the following, the second feedback system will be explained. This feedback system has an adaptive controller indicated by "STR", a PID controller indicated by "PIDC", and a change-over mechanism indicated by "CHANGE-OVER SW" in FIG. 4 and is realized when a predetermined application is executed by the CPU core 64. This feedback system will be explained schematically here, since it is disclosed in detail in Japanese Patent Application Hei No. 6-340021.

In cases where the required fuel injection amount Tcyl is simply obtained when the basic fuel injection amount TiM is multiplied by the target air/fuel ratio correction coefficient KCMDM, the target air/fuel ratio KCMD may become an insensitive air/fuel ratio due to the delayed response of the internal combustion engine 10 and the like. In this feedback system, in order to dynamically compensate for the response of the air/fuel ratio from the target air/fuel ratio KCMD, the adaptive controller STR is used to obtain a feedback correction coefficient KSTR and then this feedback correction coefficient KSTR is used to further correct the required fuel injection amount Tcyl. On the other hand, the adaptive controller STR has a relatively high response in control and thus may cause a problem that, when the target air/fuel ratio KCMD greatly fluctuates in response to the operational condition, the amount of control is rather oscillated so as to deteriorate the stability in control. Accordingly, when the control becomes unstable, the required fuel injection amount Tcyl is corrected by a feedback correction coefficient KLAF obtained by the PID controller PIDC. In order to selectively use these feedback correction coefficients KSTR and KLAF according to the operational condition, the change-over mechanism is provided. Further, when the feedback correction coefficients determined on the basis of different control laws are changed over, there is a possibility that the amount of operation may drastically change, due to a large difference therebetween caused by their different characteristics, and thus the amount of control becomes unstable, thereby deteriorating the stability in control. Accordingly, the change-over mechanism smoothly performs this change-over so as to prevent the feedback correction coefficient from generating discontinuity.

First, on the basis of the air/fuel ratio of the collective portion of the exhaust system (referred to as "detected air/fuel ratio KACT" in the following) estimated by the sampling action block (indicated as "sel-V" in the drawing), the PID controller PIDC dynamically compensates for the target air/fuel ratio KCMD. Here, the sampling action block sel-V has a function for calculating the above-mentioned detected air/fuel ratio KACT from the detection signal of the LAF sensor 54. In the third feedback system which will be explained later, this detected air/fuel ratio KACT is used to perform a predetermined feedback control operation. The sampling action block sel-V will be explained in detail together with the third feedback system.

In the processing performed by the PID controller PIDC, in the first place, a control deviation DKAF between the target air/fuel ratio KCMD and the detected air/fuel ratio KACT is determined as follows:

<equation 4>

$$DKAF(k)=KCMD(k-d')-KACT(k)$$

wherein d' indicates the dead time passed before KCMD reflects on KACT. Accordingly, KCMD(k–d') indicates the target air/fuel ratio before the dead-time control cycle. KACT(k) indicates the detected air/fuel ratio in the current control cycle. The air/fuel ratio disclosed herein, either the target value KCMD or detected value KACT, is actually indicated by equivalent ratio, i.e., $Mst/M=1/\lambda$ (wherein Mst is the theoretical air/fuel ratio, M is a ratio of air consumption A with respect to fuel consumption F, i.e., A/F, and $\lambda$ is an excess air factor).

Then, thus obtained value is multiplied by predetermined coefficients to obtain P term KLAFP(k), I term KLAFI(k), and D term KLAFD(k) as follows:

<equation 5>

$$P \text{ term}: KLAFP(k) = DKAF(k) \cdot KP$$
$$I \text{ term}: KLAFI(k) = KLAFI(k-1) + DKAF(k) \cdot KI$$
$$D \text{ term}: KLAFD(k) = (DKAF(k) - DKAF(k-1)) \cdot KD$$

Thus, the deviation DKAF(k) is multiplied by a proportional gain KP to obtain P term, the deviation multiplied by an integral gain KI is added to the last value KLAF(k) of the feedback correction coefficient to obtain I term, and the difference between the current value DKAF(k) and last value DKAF(k−1) of the deviation is multiplied by a differential gain KD to obtain D term. These gains KP, KI, and KD are obtained by a predetermined map retrieval using the engine speed Ne and intake pressure Pb as parameters. Further, as indicated in the following equation, these values are added up together and an offset of 1.0 is further added thereto so as to obtain the current value KLAF(k) of the feedback correction coefficient of the PID controller PIDC according to the PID control law.

<equation 6>

$$KLAF(k)=KLAFP(k)+KLAFI(k)+KLAFD(k)+1.0$$

In the following, the function of the adaptive controller STR will be explained with reference to FIG. 9. The adaptive controller STR has an STR controller and a parameter adjustment mechanism. While the target air/fuel ratio KCMD(k) from the first feedback system and the detected air/fuel ratio KACT(k) from the above-mentioned sampling action block (sel-V) are input, the STR controller receives a coefficient vector identified according to a parameter adjustment law (mechanism) proposed by Landau et al and performs an adaptive digital signal processing to calculate the feedback correction coefficient KSTR(k). In other words, a recurrence formula is used to calculate the feedback correction coefficient KSTR(k).

According to this technique, a so-called adaptive system is converted into an equivalent feedback system composed of a linear block and a nonlinear block and then an adjustment law is determined such that Popov's integrated inequality is realized with respect to input and output in the nonlinear block, while the linear block becomes strictly positive-real, thereby securing the stability of the adaptive system. This technique is described, for example, in "Conputrol" (published by Corona Sha) No. 27, pages 28–41, "Automatic Control Handbook" (published by Ohm Sha), pages 703–707, "A survey of Model Reference Adaptive Techniques-Theory and Application" I. D. LANDAU [Automatica] Vol. 10. p.p. 353–379, 1974, "Unification of Discrete Time Explicit Model Reference Adaptive Control Designs" I. D. LANDAU et al. [Automatica] Vol. 17, No. 4 p.p. 593–611, 1981 and "Combining Model Reference Adaptive Controllers and Stochastic Self-tuning Regulators" I. D. LANDAU [Automatica] Vol. 18, No. 1, p.p. 77–84, 1982.

In the following, this adaptive control technique using the adjustment law of Landau et al will be explained. Namely, in the adjustment law of Landau et al, when the polynomials of denominator and numerator of transfer function $A(Z^{-1})/B(Z^{-1})$ of the subject to be controlled in a discrete system are set as (i) and (ii) of the following set of equations 7, the adaptive parameter $\hat{\theta}(k)$ and an input $\zeta(k)$ to the adaptive parameter adjustment mechanism are determined as (iii) and (iv) in the following set of equations, respectively. In the following set of equations 7, the case where m=1, n=1, and d=3, namely, a brand having a dead time corresponding to three control cycles in the first-order system, is exemplified.

Here, k indicates time or, more specifically, a control cycle.

<equation 7>

$$A(z^{-1}) = 1 + a_1 z^{-1} + \ldots + A_n z^{-n} \quad \text{(i)}$$

$$B(z^{-1}) = b_0 + b_1 z^{-1} + \ldots + B_m z^{-m} \quad \text{(ii)}$$

$$\begin{aligned} \hat{\theta}^T(k) &= [\hat{b}_0(k), \hat{B}_R(z^{-1},k), \hat{S}(z^{-1},k)] \quad \text{(iii)} \\ &= [\hat{b}_0(k), \hat{r}_1(k), \ldots, r_{m+d-1}(k), \\ &\quad s_0(k), \ldots, s_{n-1}(k)] \\ &= [b_0(k), r_1(k), r_2(k), r_3(k), s_0(k) \end{aligned}$$

$$\begin{aligned} \zeta^T(k) &= [u(k), \ldots, u(k-m-d+1), \quad \text{(iv)} \\ &\quad y(k), \ldots, y(k-n+1)] \\ &= [u(k), u(k-1), u(k-2), u(k-3), y(k)] \end{aligned}$$

Here, the adaptive parameter $\hat{\theta}(k)$ is represented by the following equation 8:

<equation 8>

$$\hat{\theta}(k)=\hat{\theta}(k-1)+\Gamma(k-1)\zeta(k-d)e^*(k)$$

wherein $\Gamma(k)$ and $e^*(k)$ respectively indicate gain matrix and identification error signal respectively represented by the following recurrence formulas 9 and 10:

<equation 9>

$$\Gamma(k) = \frac{1}{\lambda_1(k)} \left[ \Gamma(k-1) - \frac{\lambda_2(k)\Gamma(k-1)\zeta(k-d)\zeta^T(k-d)\Gamma(k-1)}{\lambda_1(k) + \lambda_2(k)\zeta^T(k-d)\Gamma(k-1)\zeta(k-d)} \right]$$

<equation 10>

$$e^*(k) = \frac{D(z^{-1})y(k) - \theta^T(k-1)\zeta(k-d)}{1 + \zeta^T(k-d)\Gamma(k-1)\zeta(k-d)}$$

Also, according to how $\lambda_1(k)$ and $\lambda_2(k)$ in the above equation 9 are selected, various specific algorithms are provided. Namely, a gradually-decreasing gain algorithm is provided when $\lambda_1(k)=1$ and $\lambda_2(k)=2$ ($0<\lambda<2$; a method of least square is provided when $\lambda=1$); a variable gain algorithm is provided when $\lambda_1(k)=\lambda_1$ ($0<\lambda_1<1$) and $\lambda_2(k)=\lambda_2$ ($0<\lambda_2<\lambda$; a method of weighted least square is provided when $\lambda_2=1$); and a fixed trace algorithm is provided when $\lambda_1/\lambda_2=\sigma$, $\lambda_3$ is indicated as the following equation 11, and $\lambda_1(k)=\lambda_3$. Also, a fixed gain algorithm is provided when $\lambda_1(k)=1$ and $\lambda_2(k)=0$. In this case, as clearly indicated from equation 9, $\Gamma(k)=\Gamma(k-1)$ and thus a fixed value of $\Gamma(k)=\Gamma$ is provided.

<equation 11>

$$\lambda_3(k) = 1 - \frac{\|\Gamma(k-1)\zeta(k-d)\|^2}{\sigma + \zeta^T(k-d)\Gamma(k-1)\zeta(k-d)} \cdot \frac{1}{tr\Gamma(0)}$$

Figure 9:
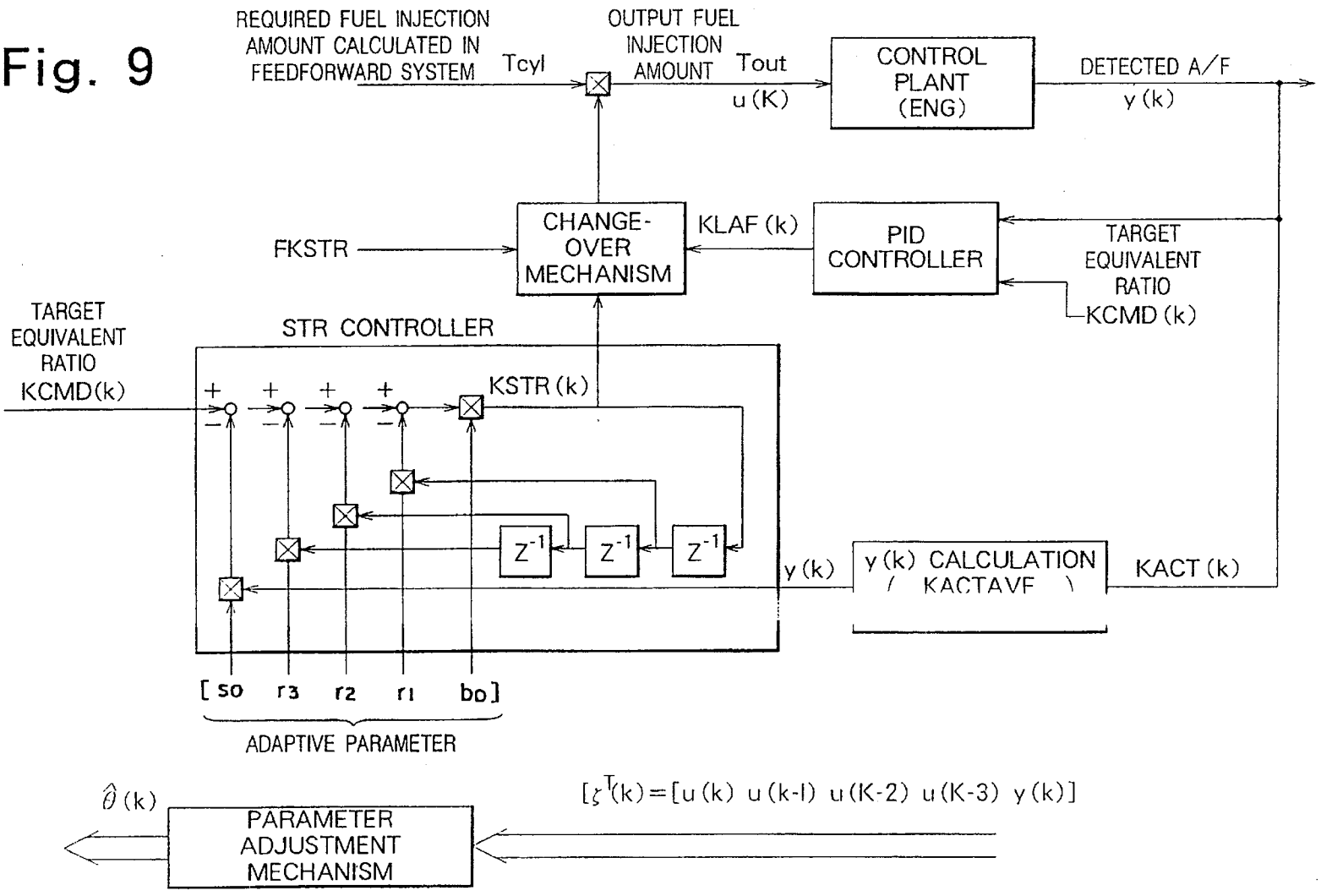
FIG. 9 is a block diagram explaining functions of a second feedback system.

Here, in FIG. 9, the above-mentioned STR controller (adaptive controller) and adaptive adjustment mechanism are disposed outside of the fuel injection amount calculating system and actuated such that the detected air/fuel ratio KACT(k) adaptively coincides with a target air/fuel ratio KCMD(k−d'), wherein d' is the dead time before KCMD reflects on KACT as mentioned above, to calculate the feedback correction coefficient KSTR(k). Namely, the STR controller forms a feedback compensator so as to receive a coefficient vector $\hat{\theta}(k)$ which has been adaptively identified by the adaptive parameter adjustment mechanism and to attain the target air/fuel ratio KCMD(k−d').

In this manner, the feedback correction coefficient KSTR (k) and detected air/fuel ratio KACT(k) are obtained and input into the adaptive parameter adjustment mechanism, where the adaptive parameter $\hat{\theta}(k)$ is calculated and is input into the STR controller. As an input, the target air/fuel ratio(k) is provided for the STR controller and a recurrence formula is used such that the detected air/fuel ratio KACT(k) coincides with the target air/fuel ratio KCMD(k) so as to calculate the feedback correction coefficient KSTR(k) indicated by the following equation 12:

<equation 12>

$$KSTR(k)=\{KCMD(k-d')-s_0\cdot y(k)-r_1-KSTR(k-1)-r_2\cdot KSTR(k-2)-r_3\cdot KSTR(k-3)\}/b_0$$

By way of the change-over mechanism, the required fuel injection amount Tcyl is multiplied by thus calculated feedback correction coefficient KSTR(k) to yield a corrected fuel injection amount Tcyl', which is then further corrected by the air/fuel ratio correction coefficient for individual cylinder #nKLAF in the third feedback control system, which will be explained later, to obtain the output fuel injection amount for individual cylinder #nTout.

The change-over mechanism performs its change-over processing in synchronization with a predetermined change-over flag FKSTR such that the feedback correction coefficient KLAF(k) is selected and the required fuel injection amount Tcyl is multiplied thereby under the operational condition where the target air/fuel ratio KCMD drastically fluctuates, while the feedback correction coefficient KSTR (k) is selected and the required fuel injection amount Tcyl is multiplied thereby under the operational condition where the target air/fuel ratio KCMD does not fluctuate drastically. Namely, the required fuel injection amount Tcyl is corrected by the feedback correction coefficient KSTR or KLAF.

In the following, the third feedback system will be explained. Basically, in this feedback system, an observer (indicated as "OBSV" in FIG. 4) is applied to the air/fuel ratio in the collective portion of the exhaust system estimated by the sampling action block "sel-V", i.e., detected air/fuel ratio KACT, to obtain the air/fuel ratio of individual cylinder #nKACT and then the PID control law (indicated as "PID" in FIG. 4) is used to calculate the air/fuel ratio correction coefficient for individual cylinder #nKLAF from the air/fuel ratio of individual cylinder #nKACT. Here, prefix "#n" refers to individual cylinder. Thereafter, the air/fuel ratio Tcyl' is multiplied by the air/fuel ratio correction coefficient for individual cylinder #nKLAF to set the output air/fuel injection amount #nTout which can homogenize the air/fuel ratios of cylinders. Also, in this manner, the efficiency in exhaust gas purification in the catalytic converter rhodium apparatuses 28 and 30 is improved. Namely, this third feedback system feedback-controls the fluctuation of air/fuel ratio among cylinders. First, before explaining the action of this feedback system, the sampling action block "sel-V" and observer will be explained.

Figure 10:
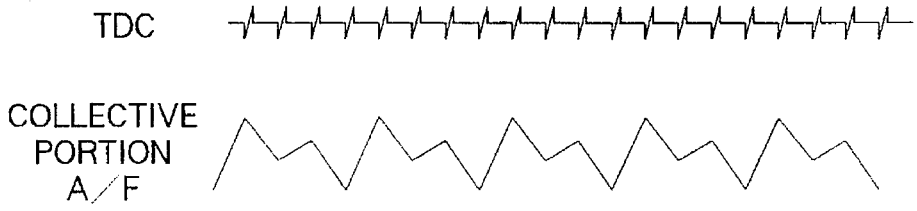
FIG. 10 is an explanatory chart showing the relationship between TDC of a multiple cylinder internal combustion engine and the air/fuel ratio at the collective portion of its exhaust system.
Figure 11:
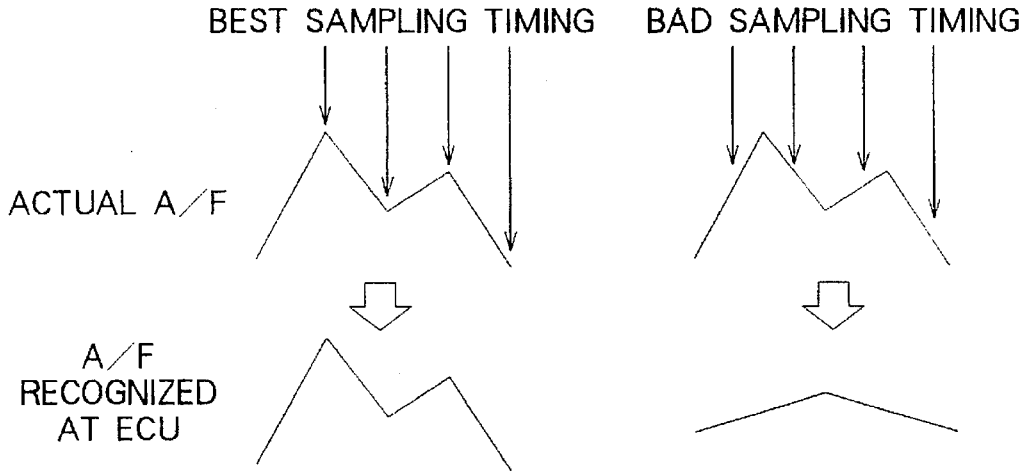
FIG. 11 is an explanatory chart showing good and bad sample timings with respect to an actual air/fuel ratio.

Since the exhaust gas is discharged during exhaust strokes, the air/fuel ratio clearly synchronizes with TDC when behavior of the air/fuel ratio is observed at the collective portion of the exhaust system in the multiple cylinder internal combustion engine. Accordingly, when the single LAF sensor 54 is disposed at the collective portion of the exhaust system in order to sample the air/fuel ratio, it is necessary for such sampling to be performed in synchronization with TDC. However, depending on the sampling timing of the control unit (ECU) 36 which processes the detection output of the LAF sensor 54, the behavior of the air/fuel ratio is not always captured correctly. Namely, for example, when the air/fuel ratio at the collective portion of the exhaust system with respect to TDC is as shown in FIG. 10, the air/fuel ratio recognized by the control unit 36 may yield totally different values as shown in FIG. 11 depending on its sampling timing. Also, this change in air/fuel ratio may vary according to the time required for the exhaust gas to reach the LAF sensor 54 and the response time of the LAF sensor 54. Among them, the time required for the exhaust gas to reach the LAF sensor 54 may vary depending on exhaust gas pressure, exhaust gas volume, and the like. Further, since sampling in synchronization with TDC is sampling in synchronization with crank angle, it is inevitably influenced by the engine speed Ne. Thus, the detected value of air/fuel ratio largely depends on the operational condition of the engine. In order to overcome such a problem, the sampling action block sel-V and observer OBSV are provided.

Figure 12:
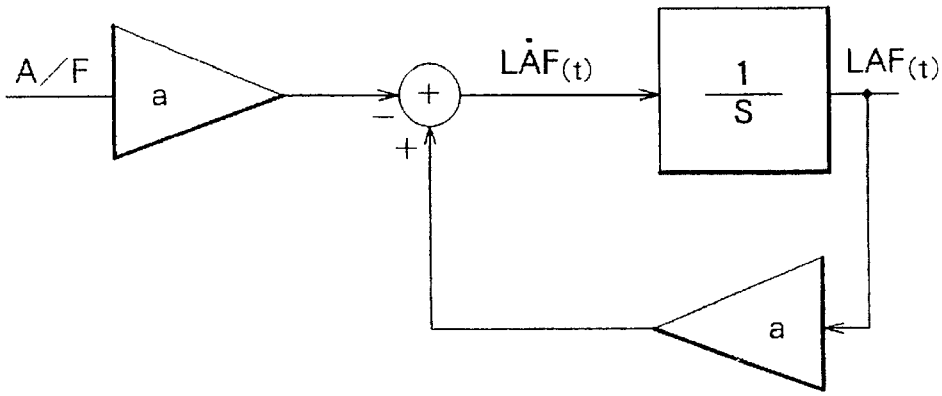
FIG. 12 is a block diagram showing a model of detecting action of an LAF sensor.

In order to separately extract the air/fuel ratio of individual cylinder with a high accuracy from the detection signal of the single LAF sensor 54 disposed at the collective portion of the exhaust system, it is necessary for the delay in detection response of the LAF sensor 54 to be correctly elucidated. Therefore, when this delay is approximately modeled in a first-order delay system as shown in FIG. 12, its equation of state can be indicated by the following equation 13:

<equation 13>

$$LAF(t)=\alpha LAF(t)-\alpha A/F(t)$$

Figure 13:
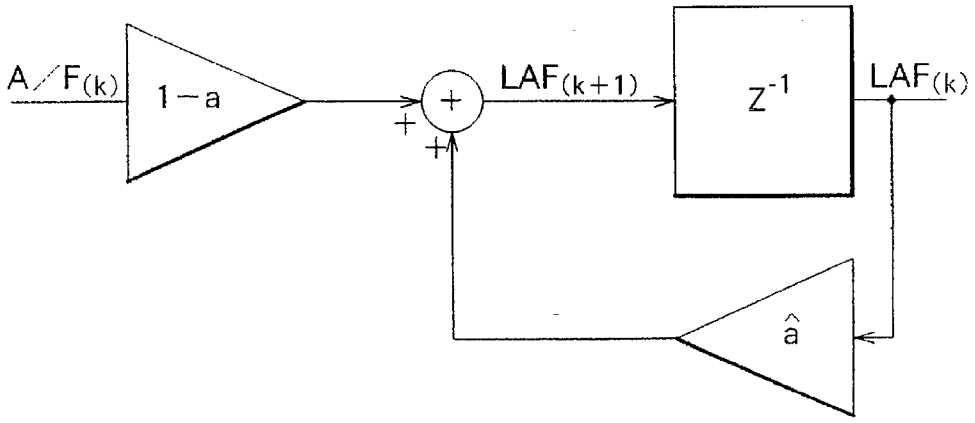
FIG. 13 is a block diagram showing a Z-converted display model of the model depicted in FIG. 12.

When this equation is digitized by a period ΔT, it yields the following equation 14. FIG. 13 represents this equation by a block diagram.

<equation 14>

$$LAF(k+1)=\hat{\alpha}LAF(k)-1(1-\hat{\alpha})A/F(k)$$

wherein, $$\hat{\alpha}=1+\Delta T+(1/2!)\alpha^2\Delta T^2+(1/3!)\alpha^3\Delta T^3+(1/4!)\alpha^4\Delta T^4$$

Accordingly, equation 14 can be used to obtain the true air/fuel ratio from the detection output of the LAF sensor 54. Namely, as equation 14 can be deformed into equation 15, the value at time k−1 can be inversely calculated from the value at time k as expressed by equation 16.

<equation 15>

$$A/F(k)=\{LAF(k+1)-\hat{\alpha}LAF(k)\}/(1-\hat{\alpha})$$

<equation 16>

$$A/F(k-1)=\{LAF(k)-\hat{\alpha}LAF(k-1)\}/(1-\hat{\alpha})$$

Figure 14:
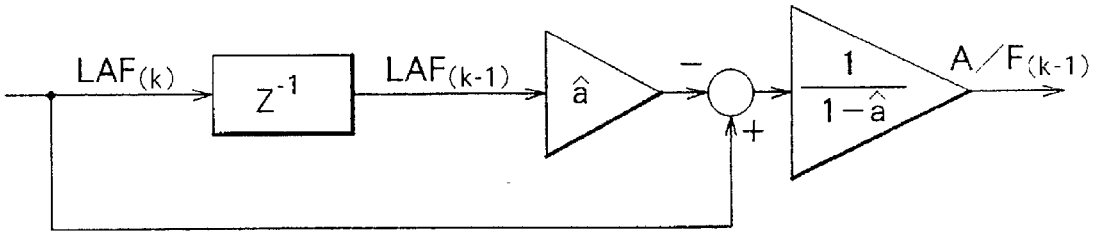
FIG. 14 is a block diagram showing an air/fuel ratio estimator in which the detecting behavior of the air/fuel ratio sensor is modeled.

Specifically, since equation 15 is expressed as equation 17 in a transfer function using Z-conversion, the current detection output LAF(k) of the LAF sensor 54 can be multiplied by its inverse transfer function to estimate the last input air/fuel ratio in real time. FIG. 14 shows the block diagram of this real-time A/F estimator.

<equation 17>

$$t(z)=(1-\hat{\alpha})/(z-\hat{\alpha})$$

Next, the technique for separately extracting the air/fuel ratio of individual cylinder on the basis of thus obtained true air/fuel ratio will be explained. The air/fuel ratio at the collective portion of the exhaust system is considered to be a weighted mean of the air/fuel ratios of the cylinders in which their time-based contributions are taken into account. Then, its value at time k is expressed as equation 18. Since F (fuel amount) is taken as a control amount, "fuel/air ratio F/A" is used herein. However, as long as there are no problems, "air/fuel ratio" will be used in the following explanation in order to facilitate understanding. The air/fuel ratio (or fuel/air ratio) refers to the true value in which the response delay previously obtained by equation 17 has been corrected.

<equation 18>

$$\begin{aligned}[F/A](k) &= C_1[F/A\#_1] + C_2[F/A\#_3] + C_3[F/A\#_4] + C_4[F/A\#_2] \\ [F/A](k+1) &= C_1[F/A\#_3] + C_2[F/A\#_4] + C_3[F/A\#_2] + C_4[F/A\#_1] \\ [F/A](k+2) &= C_1[F/A\#_4] + C_2[F/A\#_2] + C_3[F/A\#_1] + C_4[F/A\#_3]\end{aligned}$$

Figure 15:
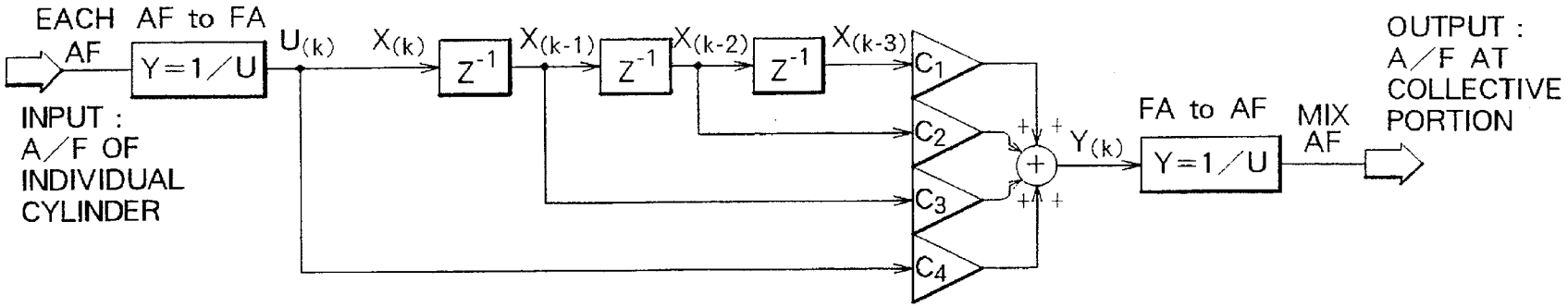
FIG. 15 is a block diagram in which the behavior of an exhaust system of an internal combustion engine is modeled.

Namely, the air/fuel ratio at the collective portion is expressed as the total of the past burning histories of discrete cylinders multiplied by a weight C (e.g., 40% for the cylinder burned just before, 30% for the one burned before that, etc). This model can be represented in a block diagram as shown in FIG. 15

Also, its equation of state becomes as expressed in the following equation 19:

<equation 19>

$$\begin{bmatrix} x(k-2) \\ x(k-1) \\ x(k) \end{bmatrix} = \begin{bmatrix} 0 & 1 & 0 \\ 0 & 0 & 1 \\ 0 & 0 & 0 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k)$$

Further, when the air/fuel ratio at the collective portion is taken as y(k), the output equation can be expressed as indicated by the following equation 20:

<equation 20>

$$y(k) = [C_1\ C_2\ C_3] \begin{bmatrix} x(k-3) \\ x(k-2) \\ x(k-1) \end{bmatrix} + C_4\, u(k)$$

wherein, $C_1$: 0.05, $C_2$: 0.15, $C_3$: 0.30, $C_4$: 0.50

Since u(k) cannot be observed in the above, x(k) cannot be observed even when the observer is designed from this equation of state. Accordingly, when it is assumed that the air/fuel ratio before 4TDCs (i.e., in the same cylinder) is under a steady operational condition where it does not drastically change and then equation of x(k+1)=x(k−3) is provided, the following equation 21 is obtained:

<equation 21>

$$\begin{bmatrix} x(k-2) \\ x(k-1) \\ x(k) \\ x(k+1) \end{bmatrix} = \begin{bmatrix} 0 & 1 & 0 & 0 \\ 0 & 0 & 1 & 0 \\ 0 & 0 & 0 & 1 \\ 1 & 0 & 0 & 0 \end{bmatrix} \begin{bmatrix} x(k-3) \\ x(k-2) \\ x(k-1) \\ x(k) \end{bmatrix}$$

-continued $$y(k) = [C_1\ C_2\ C_3\ C_4] \begin{bmatrix} x(k-3) \\ x(k-2) \\ x(k-1) \\ x(k) \end{bmatrix}$$

When simulation is performed with respect to this model, it has been found that the model output value favorably follows the measured value of output of the LAF sensor 54, thereby proving that the above-mentioned model favorably models the exhaust system of multiple cylinder internal combustion engines.

Accordingly, it results in a question of normal Kalman filter in which x(k) is observed in the equation of state indicated by the following equation 22 and the output equation (equation 20). When its load matrices Q and R are taken as expressed in equation 23 to solve Riccati equation, gain matrix K becomes as expressed by equation 24.

<equation 22>

$$\begin{cases} X(k+1) = AX(k) + Bu(k) \\ y(k) = CX(k) + Du(k) \end{cases}$$

wherein, $$A = \begin{bmatrix} 0 & 1 & 0 & 0 \\ 0 & 0 & 1 & 0 \\ 0 & 0 & 0 & 1 \\ 1 & 0 & 0 & 0 \end{bmatrix} C = [C_1\ C_2\ C_3\ C_4]\ B = D = [0]$$

$$X(k) = \begin{bmatrix} x(k-3) \\ x(k-2) \\ x(k-1) \\ x(k) \end{bmatrix}$$

<equation 23>

$$Q = \begin{bmatrix} 1 & 0 & 0 & 0 \\ 0 & 1 & 0 & 0 \\ 0 & 0 & 1 & 0 \\ 0 & 0 & 0 & 1 \end{bmatrix} R = [1]$$

<equation 24>

$$K = \begin{bmatrix} -0.3093 \\ 1.1918 \\ 0.3093 \\ 0.0803 \end{bmatrix}$$

From these equations, A−KC is obtained as expressed in the following equation 25:

<equation 25>

$$A - KC = \begin{bmatrix} 0.0785 & 1.0313 & 0.1426 & 0.0569 \\ -0.3025 & -0.1206 & 0.4505 & -0.2192 \\ -0.0785 & -0.0313 & -0.1426 & 0.9431 \\ 0.9796 & -0.0081 & -0.0370 & -0.0148 \end{bmatrix}$$

Figure 16:
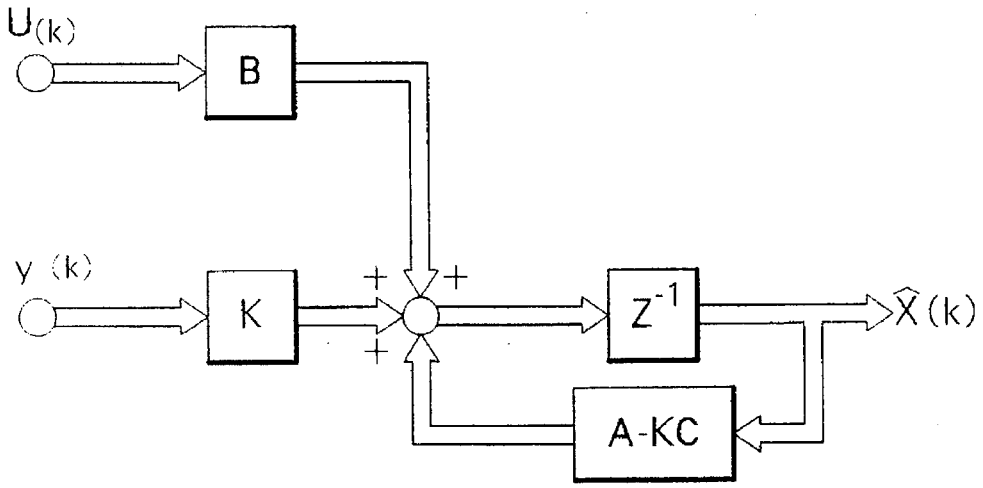
FIG. 16 is a block diagram showing a general observer.
Figure 17:
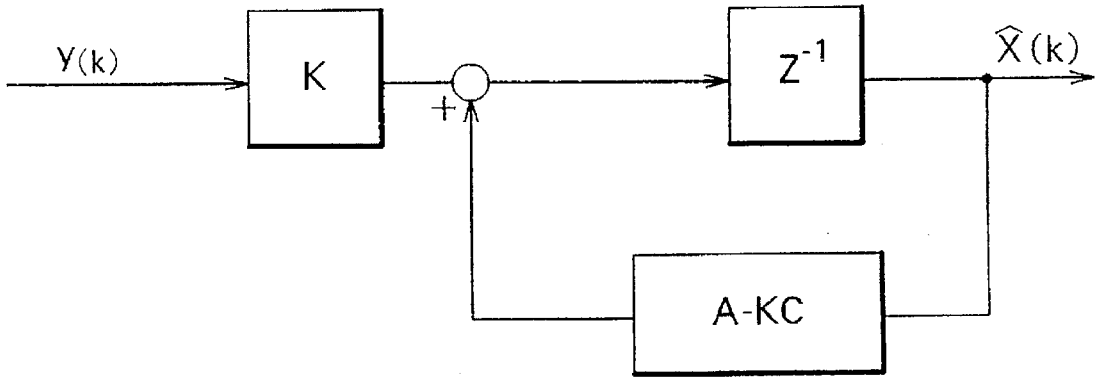
FIG. 17 is a block diagram showing the constitution of an observer in accordance with an embodiment of the present invention.

The constitution of a general observer is as shown in FIG. 16. However, since there is no input u(k) in the present model, it is constructed as shown in FIG. 17, in which only y(k) is input, and expressed in an equation as indicated by the following equation 26:

<equation 26>

$$\begin{cases} \hat{X}(k+1) = [A - KC]\hat{X}(k) + Ky(k) \\ \hat{x}(k) = [0\,0\,0\,1]\begin{bmatrix} \hat{x}(k-3) \\ \hat{x}(k-2) \\ \hat{x}(k-1) \\ \hat{x}(k) \end{bmatrix} \end{cases}$$

When y(k) is input here, the system matrix of the observer, i.e., Kalman filter, is expressed as indicated by the following equation 27:

<equation 27>

$$S = \left[\begin{array}{c|c} A - KC & K \\ \hline 0\,0\,0\,1 & 0 \end{array}\right]$$

In the present model, when the ratio of R element/Q element in load distribution of Riccati equation is 1:1, the system matrix S of Kalman filter is provided by the following equation 28:

<equation 28>

$$S = \begin{bmatrix} 0.0785 & 1.0313 & 0.1426 & 0.0569 & -0.3093 \\ -0.3025 & -0.1206 & 0.4505 & -0.2192 & 1.1918 \\ -0.0785 & -0.0313 & -0.1426 & 0.9431 & 0.3093 \\ 0.9796 & -0.0081 & -0.0370 & -0.0148 & 0.0803 \\ 0.0 & 0.0 & 0.0 & 1.0 & 0.0 \end{bmatrix}$$

Figure 18:
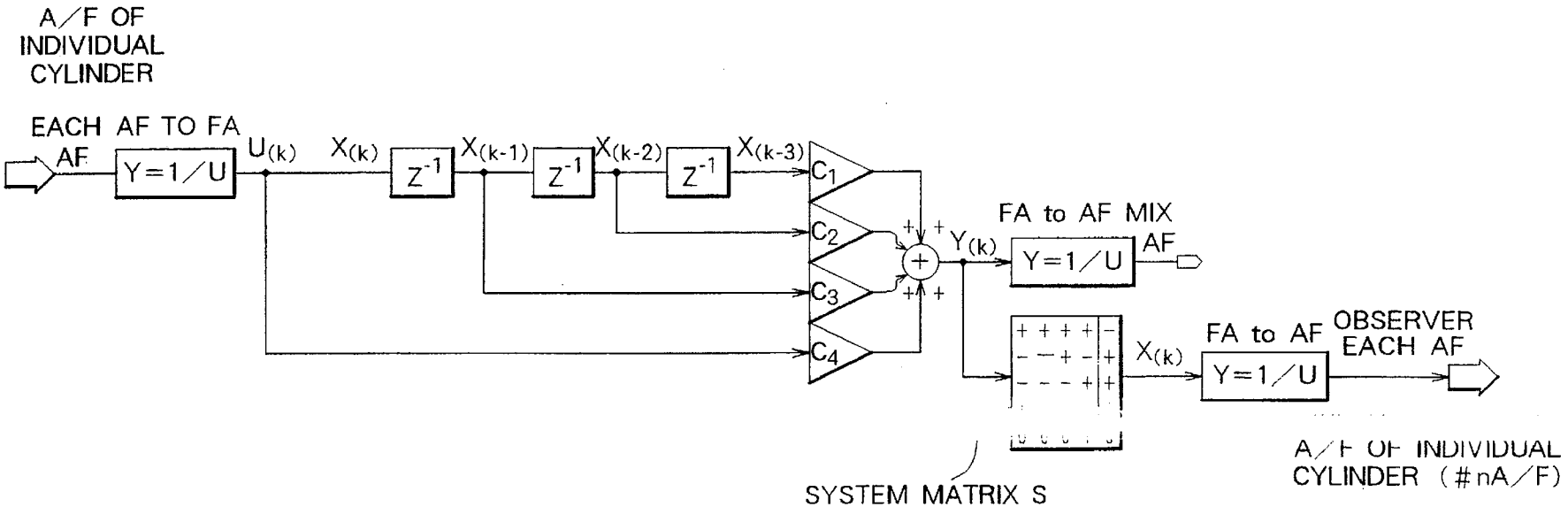
FIG. 18 is a block diagram showing a constitution in which an air/fuel ratio estimating device and an observer are combined together.

FIG. 18 shows a combination of the above-mentioned model and observer. The results of simulation have proved that the air/fuel ratio of individual cylinder can be accurately extracted from the air/fuel ratio at the collective portion.

In this manner, since the observer can estimate the air/fuel ratio of individual cylinder #nA/F from the air/fuel ratio at the collective portion A/F (i.e., A/F being equivalent to KACT), the PID control law can be used to calculate the air/fuel ratio correction coefficient for individual cylinder #nKLAF for controlling the air/fuel ratio in individual cylinder.

Figure 19:
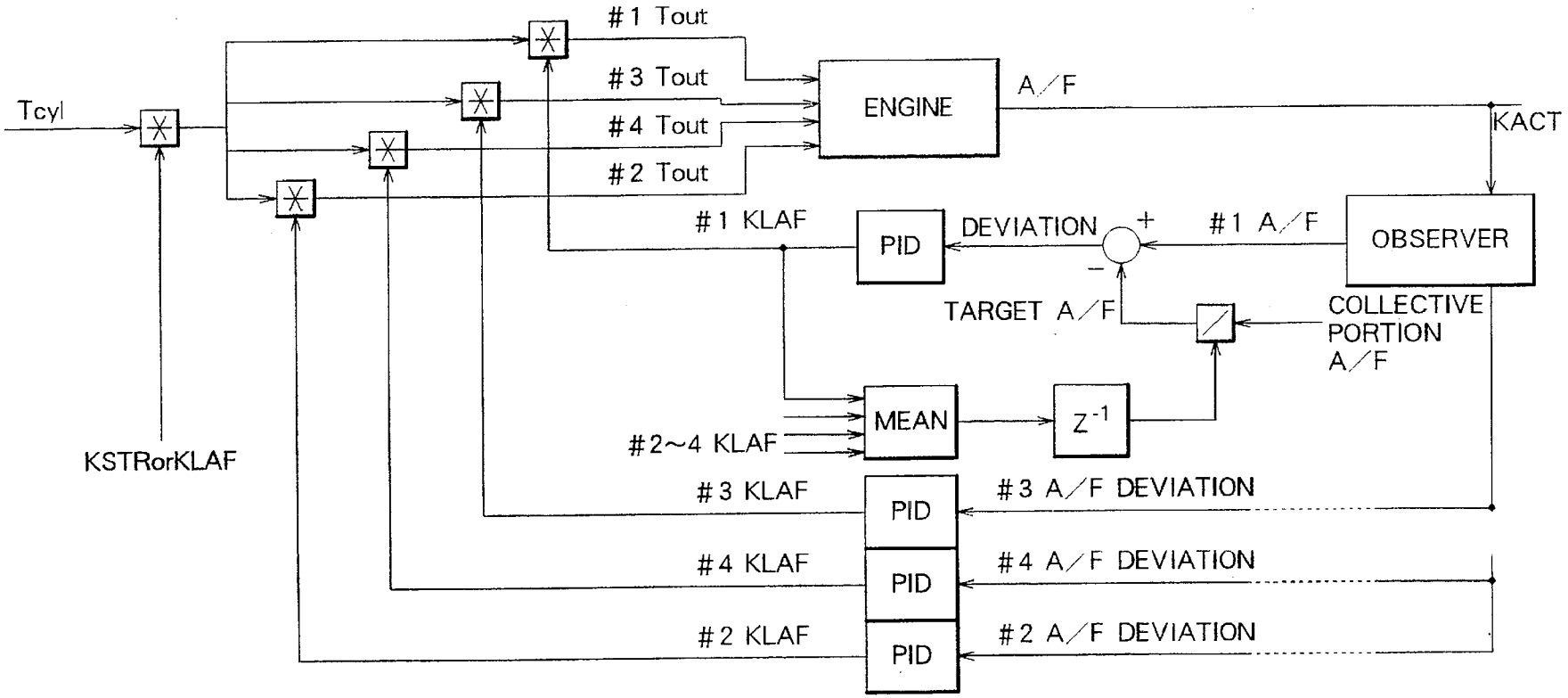
FIG. 19 is a block diagram showing functions of a third feedback system.

Specifically, as shown in FIG. 19, it is obtained by using the PID control law so as to eliminate the deviation between the target value obtained when the air/fuel ratio at the collective portion of the exhaust system (i.e., KACT) is divided by the last calculated value of the mean value with respect to the discrete #n air/fuel ratios of all cylinders having their air/fuel ratio correction coefficients and the value #nA/F for individual cylinder estimated by the above-mentioned observer. Namely, as indicated by the following equation 29, the above-mentioned target value KCMDOBSV to be applied to the PID control law is obtained when the currently obtained detected air/fuel ratio KACT is divided by the mean value of the last estimated air/fuel ratio correction coefficients for discrete cylinders #1KLAF to #4KLAF.

<equation 29>

$$KCMDOBSV(k) = \frac{KACT(k)}{(\#1KLAF + \#2KLAF + \#3KLAF + \#4KLAF)/4}$$

On the other hand, as indicated by the following set of equations 30, the deviation #nDKACT(m) between the detected air/fuel ratio #nKACT(m) and the target value KCMDOBSV is obtained in individual cylinder #n, the deviation #nDDKACT between the currently obtained deviation #DKACT(m) and the last obtained deviation #nDKACT(m−1), the results of these calculations are used to obtain KP, KI, and KD terms of the PID law corresponding to individual cylinder #n, and then these KP, KI, and KD terms are used to obtain the air/fuel ratio correction coefficient for individual cylinder #nKLAF:

<equation 30>

$$\begin{aligned} &\#nDKACT = \#nKACT - KCMDOBSV(m) \\ &\#nDDKACT = \#nDKACT(m) - \#nDKACT(m-1) \\ &\#nKP(m) = KPOBSV - \#nDKACT(m) \\ &\#nKI(m) = KIOBSV - \#nDKACT(m) + KI(m-1) \\ &\#nKD(m) = KDOBSV - \#nDDKACT(m) \\ &\#nKLAF(m) = \#nKP(m) + \#nKI(m) + \#nKD(m) + 1.0 \end{aligned}$$

Here, #n indicates cylinders #1 to #4 and m indicates time for every 4TDCs. Namely, theair/fuel ratio correction coefficient for individual cylinder #nKLAF is calculated once per 4TDCs. Each of KPOBSV, KIOBSV, and KDOBSV terms, which are reference gains, is set to different values according to whether the engine is under an idling action or not. Since these values have been stored in the ROM 76 as a data map beforehand, this map is retrieved during such calculation according to the operational condition.

In this manner, the air/fuel ratio of individual cylinder converges on the air/fuel ratio at the collective portion, whereas the latter converges on the target air/fuel ratio. As a result, the air/fuel ratio of all cylinders converge on the target air/fuel ratio. Here, the output fuel injection amount of individual cylinder #nTout (defined by the valve opening period of injector) is obtained by the following equation 31:

<equation 31>

$$\#nTout = Tcyl' \times \#nKLAF$$

wherein n refers to cylinder.

In the following, with reference to the flow chart of FIG. 20, actions by which the detected output of the LAF sensor 54 is sampled and the estimated air/fuel ratio of individual cylinder #nA/F is obtained will be explained. This processing is actually executed in step S400 in the routine indicated in FIG. 5 beforehand so that the detected air/fuel ratio KACT and estimated value #nA/F can be used in the processing operations at step S700 and step S800.

Figure 20:
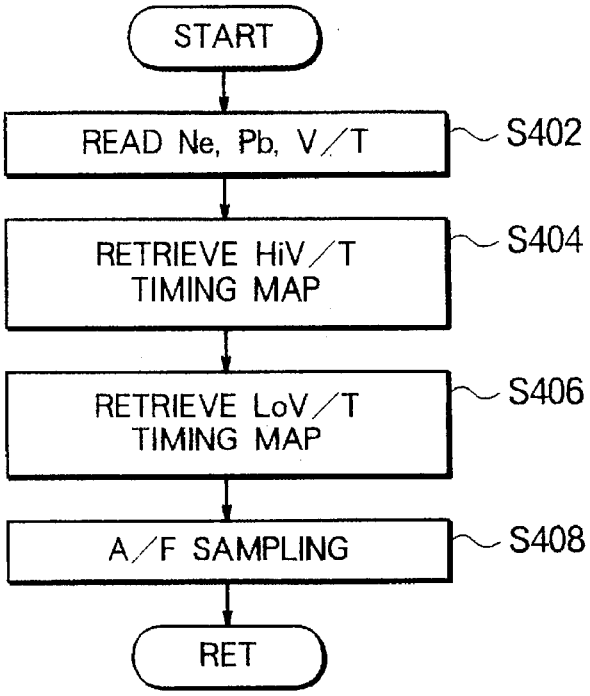
FIG. 20 is a flow chart showing the sampling action of detected air/fuel ratio in a sampling action block (sel-V)

In FIG. 20, the engine speed Ne, intake pressure Pb, and valve timing V/T are read out at step S402, the timing maps for HiV/T and LoV/T are respectively retrieved at step S404 and step S406, and then the output of the LAF sensor 54 is sampled for HiV/T and LoV/T at step S408 to obtain the detected air/fuel ratio KACT for HiV/T and the detected air/fuel ratio KACT for LoV/T.

Figure 21:
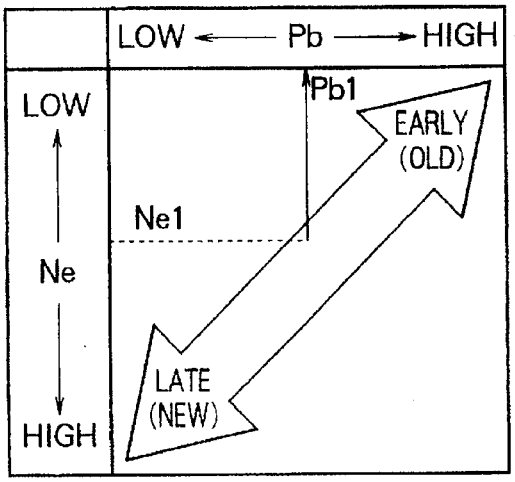
FIG. 21 is an explanatory chart showing a timing map used in the sampling action of the sampling action block (sel-V)
Figure 22:
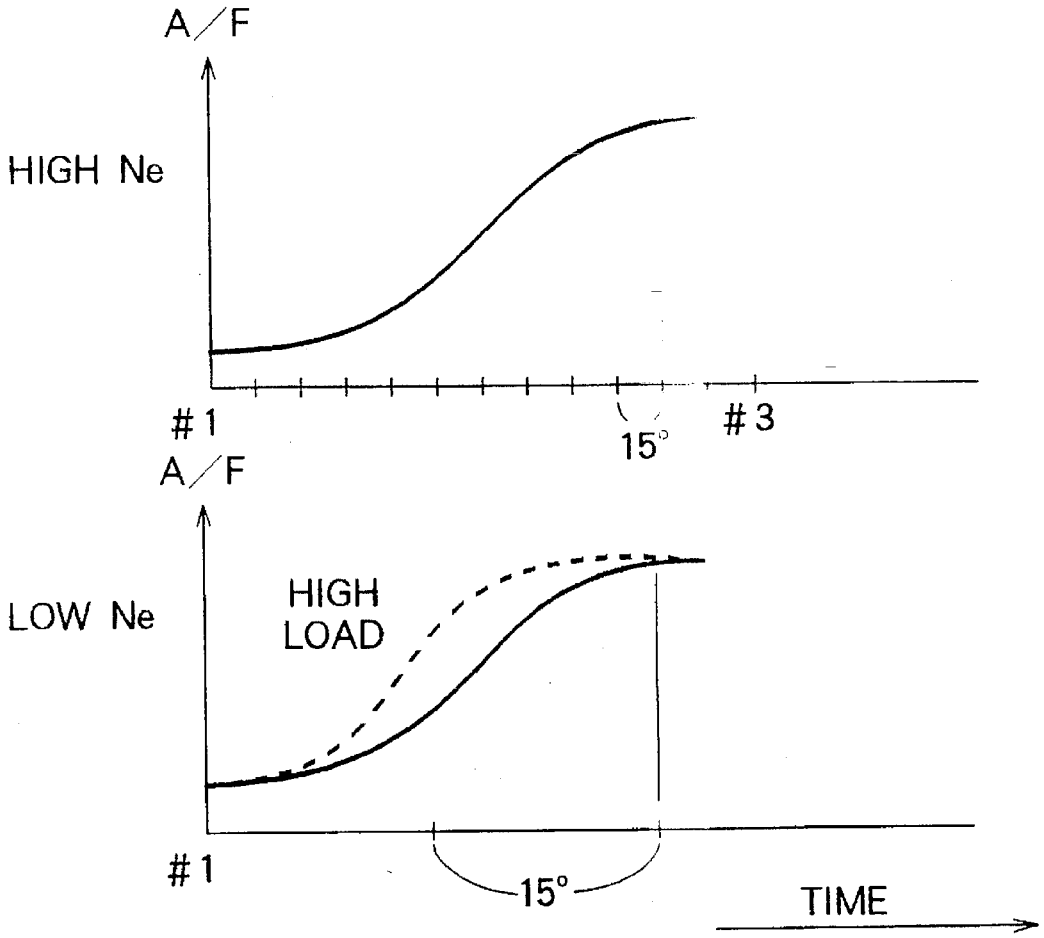
FIG. 22 is an explanatory chart showing output characteristics of an LAF sensor with respect to engine speed and engine load.

FIG. 21 is an explanatory chart showing the characteristics of these timing charts. As indicated by this chart, the characteristics are set such that the value sampled at earlier crank angle is selected as the engine speed Ne becomes lower or the intake pressure (i.e., negative pressure) Pb becomes higher. Here, "earlier" refers to the value sampled at a position nearer to the last TDC position (i.e., older value). On the other hand, they are set such that the value sampled at later crank angle (i.e., newer value) is selected as the engine speed Ne becomes higher or the intake pressure Pb becomes lower. Namely, as shown in FIG. 11, though it is best for the LAF sensor output to be sampled at a position as near as possible to the point of inflection of the actual air/fuel ratio, this point of inflection, e.g., the first peak value, occurs at an earlier crank angle as the engine speed Ne becomes lower as shown in FIG. 22 when the response time of the sensor is assumed to be constant. Also, the exhaust gas pressure and exhaust gas volume increase as the load becomes higher, so that the exhaust gas is expected to flow at a faster rate and reach the LAF sensor in a shorter time. In view of these points, the sampling timing is set as shown in FIG. 22.

Further, with respect to valve timing, certain values of engine speed Ne1 are taken as Ne1–Lo on the Lo side and as Ne1–Hi on the Hi side, while certain values of intake pressure Pb1 are taken as Pb1–Lo on the Lo side and as Pb1–Hi on the Hi side. Then, the map characteristics are:

$$Pb1\text{–}Lo > Pb1\text{–}Hi$$

$$Ne1\text{–}Lo > Ne1\text{–}Hi$$

Namely, in HiV/T, since the opening timing of the exhaust valve is earlier than that in LoV/T, its map characteristic is set such that an earlier sampling value is selected when its engine speed or intake pressure value is the same as that in LoV/T.

Figure 23:
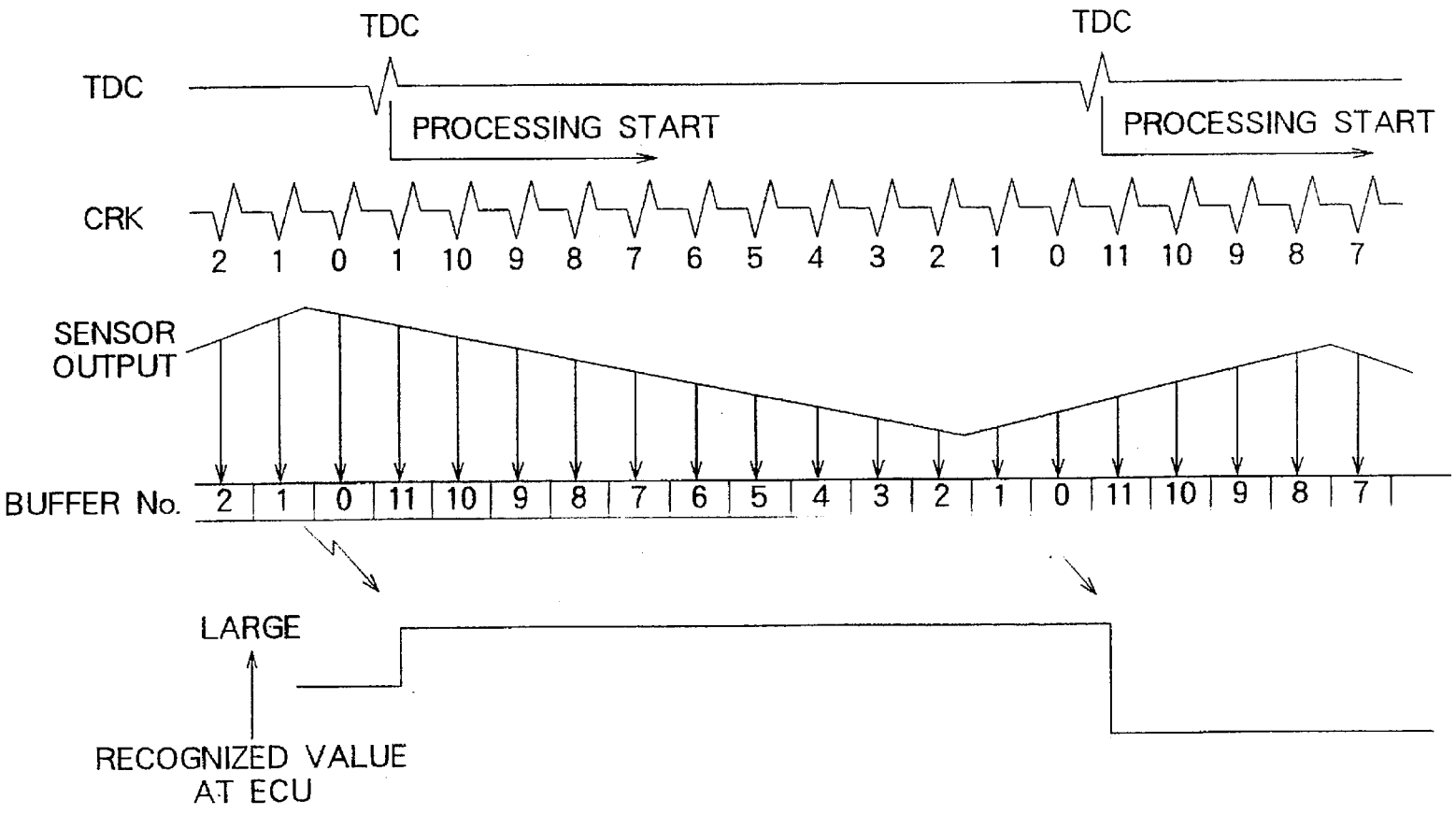
FIG. 23 is a timing chart explaining the sampling action in the sampling action block (sel-V)

The foregoing processing operations in steps S402 to S408 correspond to the sampling action block sel-V. Accordingly, as shown in the lower portion of FIG. 23, the CPU core 64 can correctly recognize the maximum and minimum values of sensor output. Also, according to this constitution, when the observer is used to estimate the air/fuel ratio of individual cylinder, a value approximating the actual behavior of air/fuel ratio can be used to improve accuracy in estimation of the observer. Further, accuracy in performing the air/fuel ratio feedback-control of individual cylinder, which will be explained later with reference to FIGS. 24 to 26, can be improved.

In the following, the feedback control for individual cylinder at step S800 in FIG. 5 will be explained with reference to the flow charts of FIGS. 24 and 25. In this embodiment, since the internal combustion engine has the valve timing mechanism 300, the air/fuel ratio of individual cylinder #nA/F is estimated according to the valve timings HiV/T and LoV/T in the processing of FIG. 24 and then the air/fuel ratio correction coefficient for individual cylinder #nKLAF shown in FIG. 25 is obtained.

Figure 24:
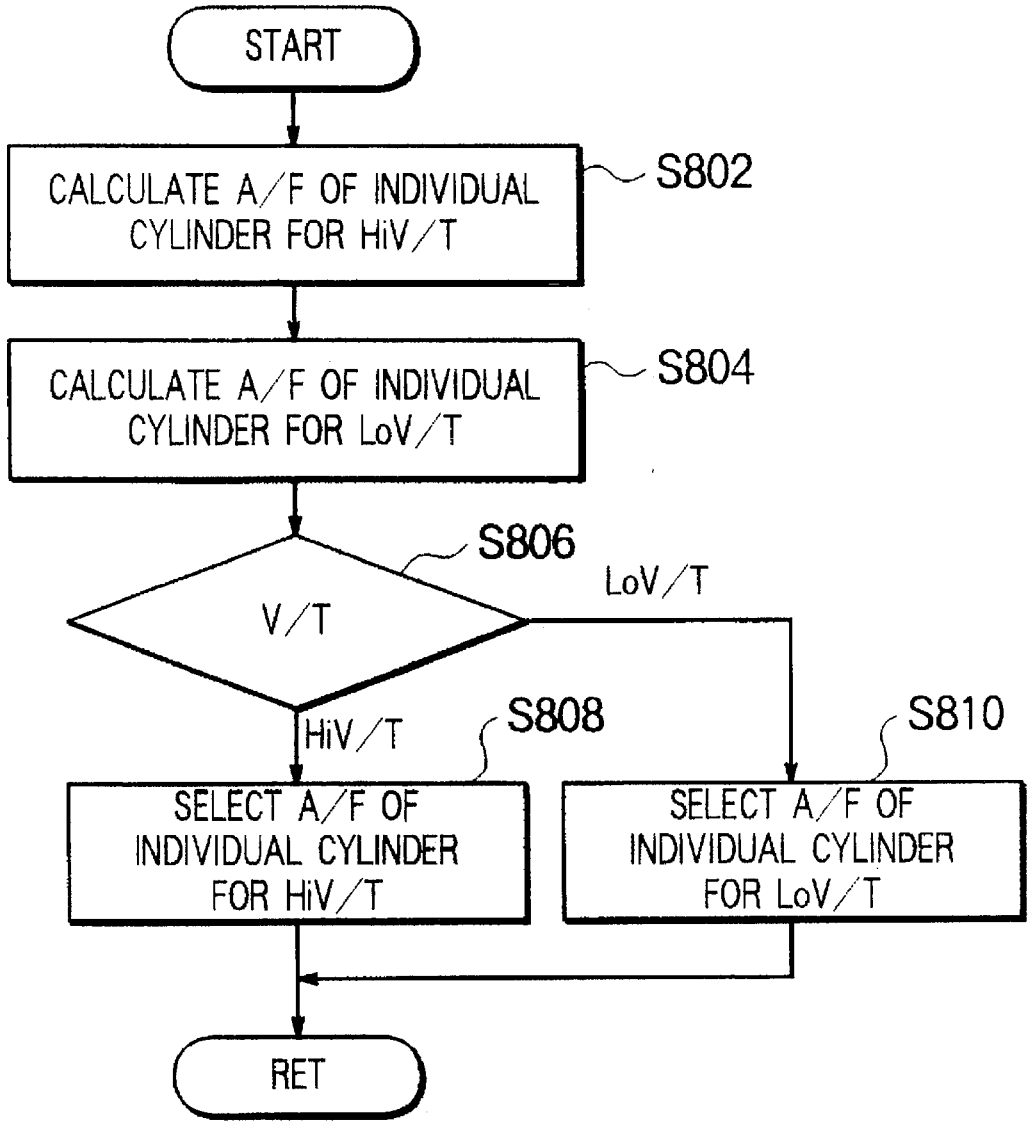
FIG. 24 is a flow chart with respect to the action of the observer showing the air/fuel ratio of individual cylinder generated in response to the engine timing.

In FIG. 24, at step S802, the detected air/fuel ratio (i.e., air/fuel ratio at the collective portion of the exhaust system) KACT for HiV/T obtained at step S408 in FIG. 20 is applied to calculation of the observer matrix so as to obtain the air/fuel ratio of individual cylinder #nA/F for HiV/T and then, at step S804, the detected air/fuel ratio (i.e., air/fuel ratio at the collective portion of the exhaust system) KACT for LoV/T is applied to calculation of the observer matrix so as to obtain the air/fuel ratio of individual cylinder #nA/F (#nKACT) for LoV/T. Thereafter, at step S806, the current valve timing V/T is judged and, on the basis of this judgment, the process proceeds to step S808 or S810 where the air/fuel ratio of individual cylinder #nA/F for either HiV/T or LoV/T is selected. In this manner, at steps S802 to S810, the observer performs the estimation processing of air/fuel ratio of individual cylinder in order to obtain the air/fuel ratio #nA/F corresponding to the valve timing V/T.

Figure 25:
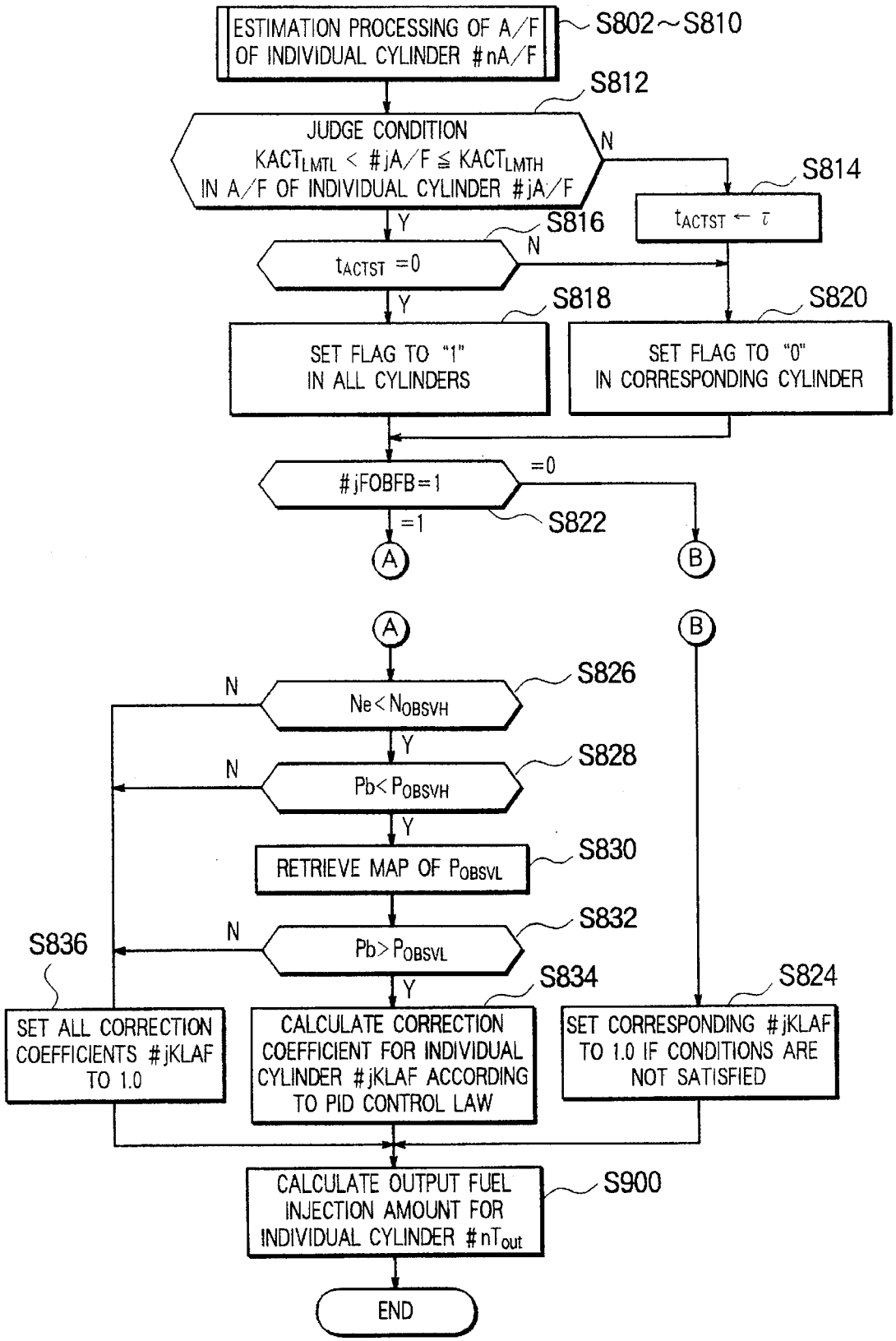
FIG. 25 is a flow chart explaining the judging action for determining the correction coefficient for air/fuel ratio of individual cylinder in the third feedback system (i.e., feedback control system for individual cylinder)

Next, according to the flow chart shown in FIG. 25, a judgment processing for securing the stability in control or the like, which is the problem to be overcome by the present invention, is performed; the air/fuel ratio correction coefficient #nKLAF for individual cylinder according to the PID control law is obtained; and then the fuel injection amount Tcyl' is multiplied by this correction coefficient #nKLAF to determine the output fuel injection amount #nTout for determining the injector valve opening time for individual cylinder.

First, at step S812 in FIG. 25, with respect to the air/fuel ratio of individual cylinder #jA/F (wherein #j indicates individual cylinder, j=1 to n), it is judged whether each value exists within the range between a predetermined lowest reference value $KACT_{LMTL}$ and a predetermined highest reference value $KACT_{LMTH}$. Specifically, in the case of n=4 cylinder internal combustion engine, it is judged whether the following conditions:

for the first cylinder; $KACT_{LMTL} < \#1A/F \leqq KACT_{LMTH}$ for the second cylinder; $KACT_{LMTL} < \#2A/F \leqq KACT_{LMTH}$ for the third cylinder: $KACT_{LMTL} < \#3A/F \leqq KACT_{LMTH}$ for the fourth cylinder; $KACT_{LMTL} < \#4A/F \leqq KACT_{LMTH}$ are satisfied or not. Namely, when the estimated air/fuel ratio drastically changes in response to a change in target air/fuel ratio during a transient operational condition, since the predetermined range changes in response to this change in target air/fuel ratio, the estimated air/fuel ratio deviates out of the predetermined range, thereby elongating the period for stopping the air/fuel ratio control. Therefore, the predetermined range is set based on the target air/fuel ratio in order to judge whether or not the cylinder has an air/fuel ratio which abnormally fluctuates.

When at least one cylinder is detected as having the air/fuel ratio which does not satisfy the above-mentioned conditions at step S812, the processing proceeds to step S814. On the other hand, when the air/fuel ratio of individual cylinder #1A/F to #nA/F in all cylinders satisfy the above-mentioned conditions, the processing proceeds to step S816.

At step S814, a predetermined time $\tau$ is preset (i.e., counter value $t_{ACTST}$ is preset at $\tau$) in a predetermined timer circuit (not shown) to start measuring time. Then, the processing proceeds to step S820. This setting of the timer is performed in order to adjust time in view of the stability at the time when the feedback control is restarted.

At step S816, it is judged whether the above-mentioned timer circuit has completed the measurement of the preset time $\tau$ or not. Namely, it is judged whether the condition of $t_{ACTST}=0$ is satisfied or not.

Then, when it is judged positive, the processing proceeds to step S818, where all judgment flags #1FOBFB to #nFOBFB attributed to the discrete cylinders are set to "1", and then to step S822. On the other hand, when it is judged negative at step S816, the processing proceeds to step S820 where, among the judgment flags #1FOBFB to #nFOBFB, the judgment flag #jFOBFB with respect to the cylinder not satisfying the above-mentioned conditions is set to "0". Namely, the judgment flags #1FOBF to #nFOBFB are used for identifying the cylinders associated with the air/fuel ratio of individual cylinder satisfying the above-mentioned conditions and air/fuel ratio of individual cylinder not satisfying the above-mentioned conditions.

Next, at step S822, a judgment is made in order to discriminate the case where each judgment flag is 37 1" from the case where each judgment flag is "0". Then, the processing of the cylinder with the "1" judgment flag proceeds to (A), whereas the processing of the cylinder with the "0" judgment flag proceeds to (B).

In the processing after (B), the correction coefficient #jKLAF of the cylinder #j with the "0" judgment flag is forcibly set to value 1.0 at step S824. In other words, the correction coefficient for the remaining cylinders with the "1" judgment flag is obtained by a normal PID control law when further conditions, which will be explained later, are satisfied.

In the processing after (A), at steps S826 to S832, it is judged whether the engine speed Ne and intake pressure Pb representing the operational conditions are within predetermined feedback control regions for individual cylinder or not. Here, as shown in the hatched area in the graph of FIG. 26, the feedback region for individual cylinder sets conditions under which the feedback control for individual cylinder can be performed. Outside of this region, the feedback control for individual cylinder is stopped. Namely, the feedback control for individual cylinder can be performed when the engine speed Ne is between its higher limit $N_{OBSVH}$ and lower limit 0 and the intake pressure Pb is between predetermined lower limit $P_{OBSVL}$ and $P_{OBSVH}$ which have been set according to the engine speed. In this drawing regions of $\Delta N_{OBSV}$ and $\Delta P_{OBSV}$ are kinds of hysteresis which are set in order to secure the stability in control when the feedback control for individual cylinder is changed from a stop state to an executing state or from the executing state to the stop state. The data of this feedback region for individual cylinder have been stored in the ROM 76 beforehand so that they can be retrieved as a map.

In order to perform such conditional judgment, it is judged whether the engine speed Ne is lower than its higher limit $N_{OBSVH}$ or not and whether the intake pressure Pb is lower than its upper limit $P_{OBSVH}$ or not. Only when both conditions are satisfied, the processing proceeds to step S830. When at least one of the conditions is not satisfied, the processing proceeds to step S836 where all the values of air/fuel ratio correction coefficients #1KLAF to #nKLAF are set to 1.0.

At step S830, the lower limit $P_{OBSVL}$ for the intake pressure corresponding to the engine speed Ne is retrieved from the map. Then, at step S832, it is judged whether the intake pressure Pb is greater than this lower limit $P_{OBSVL}$ or not. When it is judged negative, the processing proceeds to step S836 where all the values of air/fuel ratio correction coefficients for individual cylinders #1KLAF to #nKLAF are set to 1.0. When it is judged positive at step S832, on the other hand, the processing proceeds to step S834.

At step S834, the air/fuel ratio correction coefficient for individual cylinder with respect to the cylinder having a set value of "1" within the judgment flags #1FOBFB to #nFOBFB is obtained by the PID control law.

Even when the air/fuel ratio correction coefficient for individual cylinder is forcibly set to 1 at the above-mentioned steps S824 and S836, the observer continuously performs an estimation processing of the air/fuel ratio of individual cylinder #nA/F. This is because the past history information is necessary for estimating the air/fuel ratio of individual cylinder #nA/F. Namely, if this estimation processing is stopped when the air/fuel ratio correction coefficient for individual cylinder is forcibly set to 1, there will be a possibility that the next air/fuel ratio #nA/F for individual cylinder may not be estimated rapidly with accuracy when, for example, the air/fuel ratio returns to the normal condition. In other words, in the case where the estimation processing of the air/fuel ratio of individual cylinder #nA/F is continued, the next air/fuel ratio of individual cylinder #nA/F can be estimated rapidly with accuracy, for example, when the air/fuel ratio returns to the normal condition.

When the processing operations at steps S824, S834, and S836 are completed, the processing of step S900 in the main routine shown in FIG. 5 is performed to determine the output fuel injection amount for individual cylinder #nTout.

In this manner, as the third feedback system performs the feedback control for individual cylinder in accordance with this embodiment, the fluctuation in air/fuel ratios among individual cylinders can be corrected, thereby improving the efficiency in purification of exhaust gas in the catalyst apparatus.

Also, the circumstance where the feedback control for individual cylinder should not be performed is judged on the basis of the parameters Ne and Pb which represent the operational conditions. Under this circumstance, all the air/fuel ratios of individual cylinders #nKLAF are forcibly set to 1.0 so as to substantially stop the feedback control for individual cylinder. Accordingly, the overall feedback control is prevented from being unfavorably affected thereby. When the circumstance returns to normal, the feedback control for individual cylinder is restarted to perform the air/fuel ratio control utilizing the observer OBSV.

Further, under the circumstance where the feedback control for individual cylinder can be performed, when one of the air/fuel ratios of individual cylinders #nA/F deviates out of the predetermined range, only the air/fuel ratio correction coefficient for individual cylinder concerning the corresponding cylinder is forcibly set to 1.0, while the remaining air/fuel ratio correction coefficients for individual cylinders are continuously calculated according to the normal PID control law. Accordingly, the overall feedback control is prevented from being unfavorably affected. When the circumstance returns to normal, the whole feedback control for individual cylinder is restarted to perform the air/fuel ratio control utilizing the observer OBSV.

Though the corresponding air/fuel ratio correction coefficient for individual cylinder is forcibly set to 1.0 at steps S824 and S836 in FIG. 25 in the foregoing explanation of this embodiment, so as not to substantially correct the output fuel injection amount Tout to the corresponding cylinder, in order to eliminate unstableness in control or the like, it may not be restricted to the value of 1.0. For example, the last or earlier estimated value of air/fuel ratio of individual cylinder #nA/F during the normal condition can be used as the corresponding air/fuel ratio correction coefficient for individual cylinder. In this manner, fluctuations in the air/fuel ratios are expected to be converged more rapidly.

(Second Embodiment)

Figure 27:
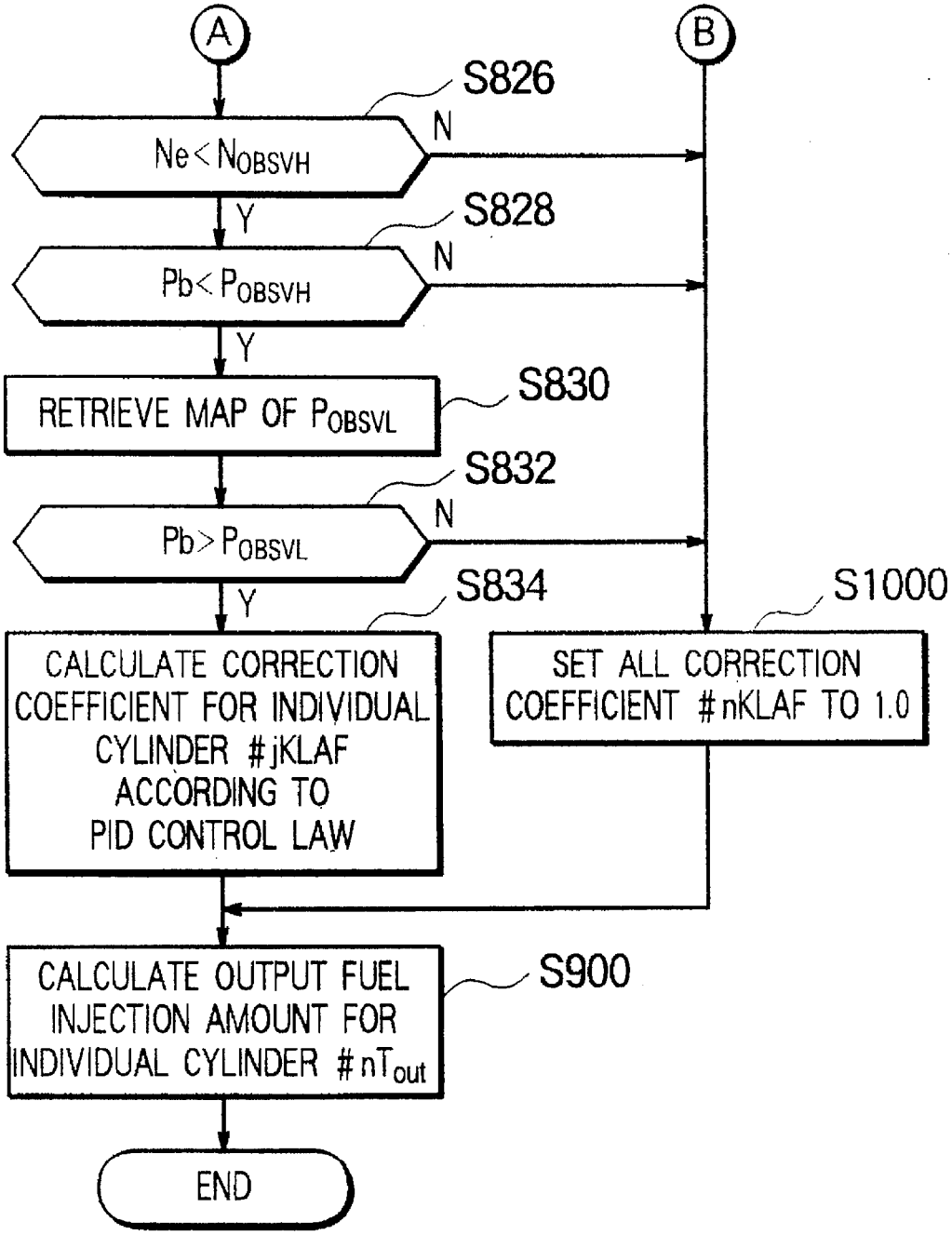
FIG. 27 is a flow chart with respect to the second embodiment of the present invention explaining the judging action for determining the air/fuel ratio correction coefficient for individual cylinder in the third feedback system (i.e., feedback control system for individual cylinder)

In the following, the second embodiment will be explained with reference to the flow chart of FIG. 27. This embodiment relates to the feedback control for individual cylinder performed by the above-mentioned third feedback system. Since the constitutions of the feedforward system and the first and second feedback systems shown in the first embodiment are the same as or similar to those of this embodiment, explanations will be provided while comparing their differences. In FIG. 27 showing the characteristic features of this embodiment, the parts which are the same as or similar to the contents of processing in the first embodiment are referred to with the marks which are identical to those in the first embodiment.

In the processing operations at steps S824 to S836 in FIG. 25 explained in the first embodiment, when there is an obstacle in the feedback control for individual cylinder, the corresponding air/fuel ratio correction coefficient for individual cylinder is selected and forcibly fixed at a constant value such as 1.0. By contrast, in this embodiment, when at least one air/fuel ratio of individual cylinder #nA/F becomes a value which may be an obstacle for the control, all the air/fuel ratio correction coefficients for individual cylinders #nKLAF are forcibly set to 1.0. Accordingly, during the period for the air/fuel ratio to return to normal, the feedback control for individual cylinder is substantially stopped or the air/fuel ratio correction coefficient #nKLAF during the normal condition which has been obtained at the last estimating operation is used to continue the correction processing of the output fuel injection amount #Tout, thereby preventing the overall feedback control from being unfavorably affected. When the condition returns to normal, the whole feedback control for individual cylinder is restarted so that the observer OBSV is utilized to perform the air/fuel ratio control for individual cylinder.

Namely, when the distributing processing at step S822 in FIG. 25 is completed, the procedure continues to processing (A) or processing (B) in FIG. 27. It continues to the processing (B) when at least one air/fuel ratio of individual cylinder (e.g., #1A/F) exceeds a predetermined value. In this case, at step S1000, all the air/fuel ratio correction coefficients for individual cylinders #1KLAF to #nKLAF are set to 1.0. Alternatively, they may be set to the air/fuel ratio correction coefficient #nKLAF during the normal condition which has been obtained at the last estimating operation.

The procedure continues to the processing (A) when the estimated air/fuel ratio of individual cylinder #nA/F is normal. Accordingly, by the processing operations at steps S826 to S832, it is judged whether the operating condition is applicable to the feedback correction region for individual cylinder (cf. FIG. 26) or not. Then the above-mentioned conditions are completely satisfied (positive), the processing proceeds to step S834 where the air/fuel ratio correction coefficient for individual cylinder #nKLAF according to the PID control law is calculated. Then, at step S900, the output fuel injection amount for individual cylinder #nTout is corrected. When the judgment is negative at the processing operations at step S826 to S832, on the other hand, the processing proceeds to step S1000 where all the air/fuel ratio correction coefficients for individual cylinders #1KLAF to #nKLAF are set to 1.0 or the above-mentioned air/fuel ratio correction coefficient #nKLAF during the normal condition.

(Third Embodiment)

Figure 28:
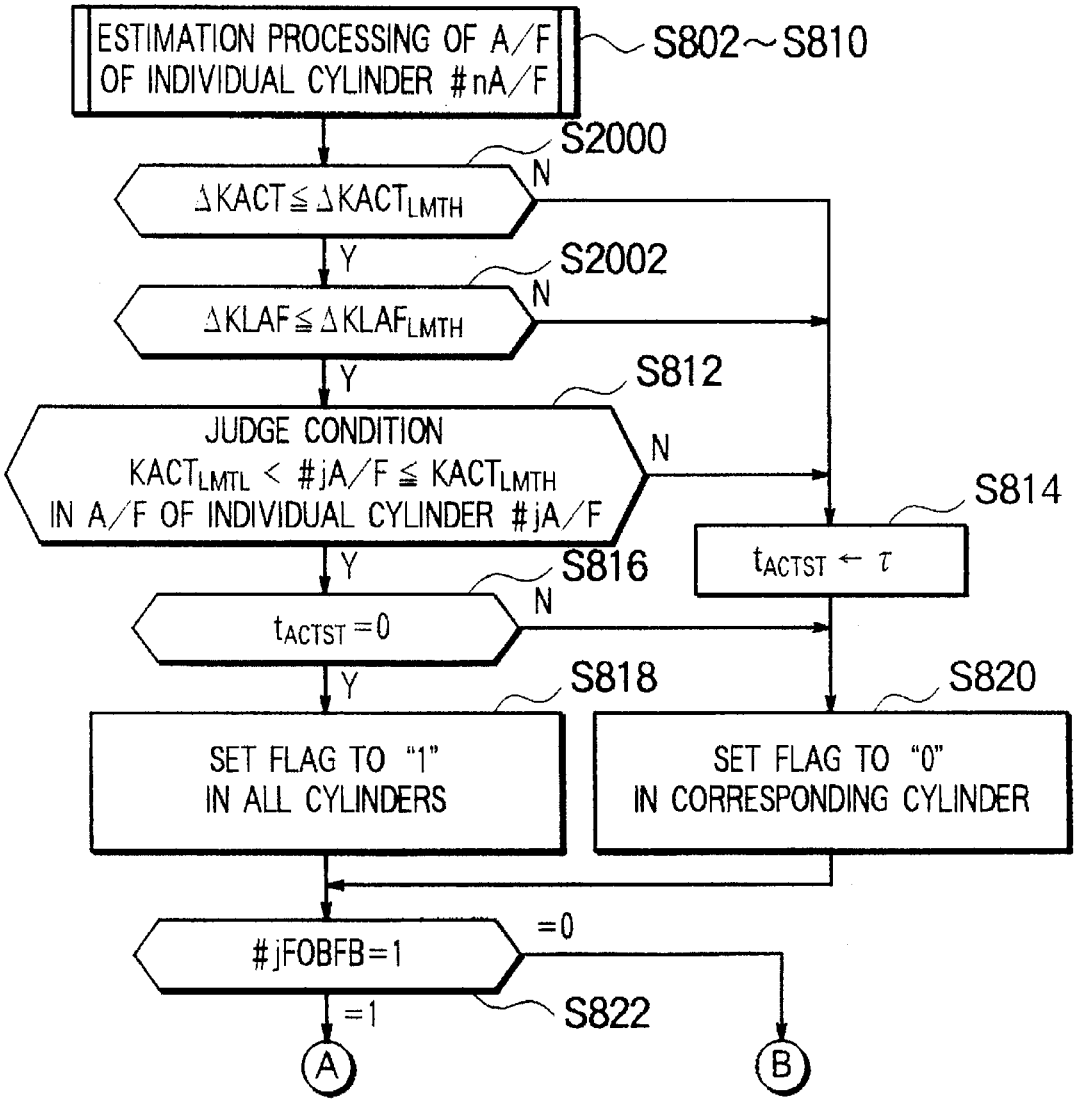
FIG. 28 is a flow chart with respect to the third embodiment of the present invention explaining the judging action for determining the air/fuel ratio correction coefficient for individual cylinder in the third feedback system (i.e., feedback control system for individual cylinder)

In the following, the third embodiment will be explained with reference to the flow chart of FIG. 28. This embodiment relates to the feedback control for individual cylinder performed by the above-mentioned third feedback system. Since the constitutions of the feedforward system and the first and second feedback systems shown in the first embodiment are the same as or similar to those of this embodiment, explanations will be provided while comparing their differences. In FIG. 28 showing the characteristic features of this embodiment, the parts which are the same as or similar to the contents of processing in the first embodiment are referred to with the marks which are identical to those in the first embodiment.

In the processing operations at steps S812 to S822 in FIG. 25 explained in the first embodiment, when there is an obstacle in the feedback control for individual cylinder, the corresponding air/fuel ratio of individual air/fuel ratio #nA/F is judged and, based on the result of this judgment, the corresponding value of air/fuel ratio correction coefficient for individual cylinder is set to a constant value such as 1.0. In addition, in this embodiment, the feedback control for individual cylinder is substantially stopped when both time-based change in detected air/fuel ratio KACT and time-based change in target air/fuel ratio correction coefficient KLAF drastically change.

Namely, in FIG. 28, after the air/fuel ratio of individual cylinder #nA/F is obtained, it is judged at step S2000 whether the absolute value of difference between the newest detected air/fuel ratio KACT(k) and the previously-obtained detected air/fuel ratio KACT(k−1), i.e., $\Delta KACT=|KACT(k)-KACT(k-1)|$, is smaller than a predetermined higher limit $\Delta KACT_{LMTH}$ or not. When it is judged positive, the processing proceeds to step S2002. When it is judged negative, the processing proceeds to step S814.

At step S2002, it is judged whether the absolute value of difference between the newest target air/fuel correction coefficient KLAF(k) and the previously-obtained target air/fuel ratio KLAF(k−1), i.e., $\Delta KLAF=|KLAF(k)-KLAF(k-1)|$, is smaller than a predetermined higher limit $\Delta KLAF_{LMTH}$ or not. When it is judged positive, the processing proceeds to step S812. When it is judged negative, the processing proceeds to step S814.

Accordingly, the processing proceeds to step S812 only when both change in detected air/fuel ratio KACT and change in target air/fuel ratio correction coefficient KLAF are not large. When one of the change in detected air/fuel ratio KACT and the change in target air/fuel ratio correction coefficient KLAF is large, the processing proceeds to step S814.

Next, as explained in the first embodiment, the processing operations of steps S812 to S822 are performed such that, the corresponding operations proceed to the processing (B) when the air/fuel ratio of individual cylinder is outside of predetermined value ranges, whereas the corresponding operations proceed to the processing (A) when the air/fuel ratio of individual cylinder is within the predetermined value ranges. Then, after air/fuel ratio correction coefficients for individual cylinders #1KLAF to #nKLAF are determined at steps S826 to S836 shown in FIG. 25, the output fuel injection amount for individual cylinder #nTout is calculated.

In accordance with this embodiment, since whether the control is stable or not is judged on the basis of each of the amount of change in detected air/fuel ratio KACT and the amount of change in target air/fuel ratio correction coefficient KLAF, the stability in control of air/fuel ratio for individual cylinder is prevented from deteriorating due to abnormality in at least one cylinder.

Though the stability in control or the like is judged on the basis of amounts of change in both detected air/fuel ratio KACT and target air/fuel ratio correction coefficient KLAF in this embodiment, this judgment control may be performed on the basis of amount of change in one of them.

Also, while the processing shown in FIG. 28 continues to the processing operations (A) and (B) of the first embodiment shown in FIG. 25 in the foregoing explanation, it may continue to the processing operations (A) and (B) of the second embodiment shown in FIG. 27.

(Fourth Embodiment)

In the fourth embodiment, even in such a case where the operational condition of the internal combustion engine is not correctly measured due to abnormalities in operational state and environmental state of the internal combustion engine as well as failures of various sensors or the like, the feedback control for individual cylinder is stably performed in response to these abnormal states, thereby preventing the emission from deteriorating beforehand.

Since the basic structure of this fuel injection amount control apparatus for internal combustion engine is similar to that of the first embodiment which has been explained with reference to FIGS. 1–19, 20–23, and 26, the characteristic portions of the present embodiment will be mainly explained in detail.

This embodiment differs from the first embodiment in that, while the feedback control system for individual cylinder in the first embodiment is constructed as shown in FIG.

Figure 29:
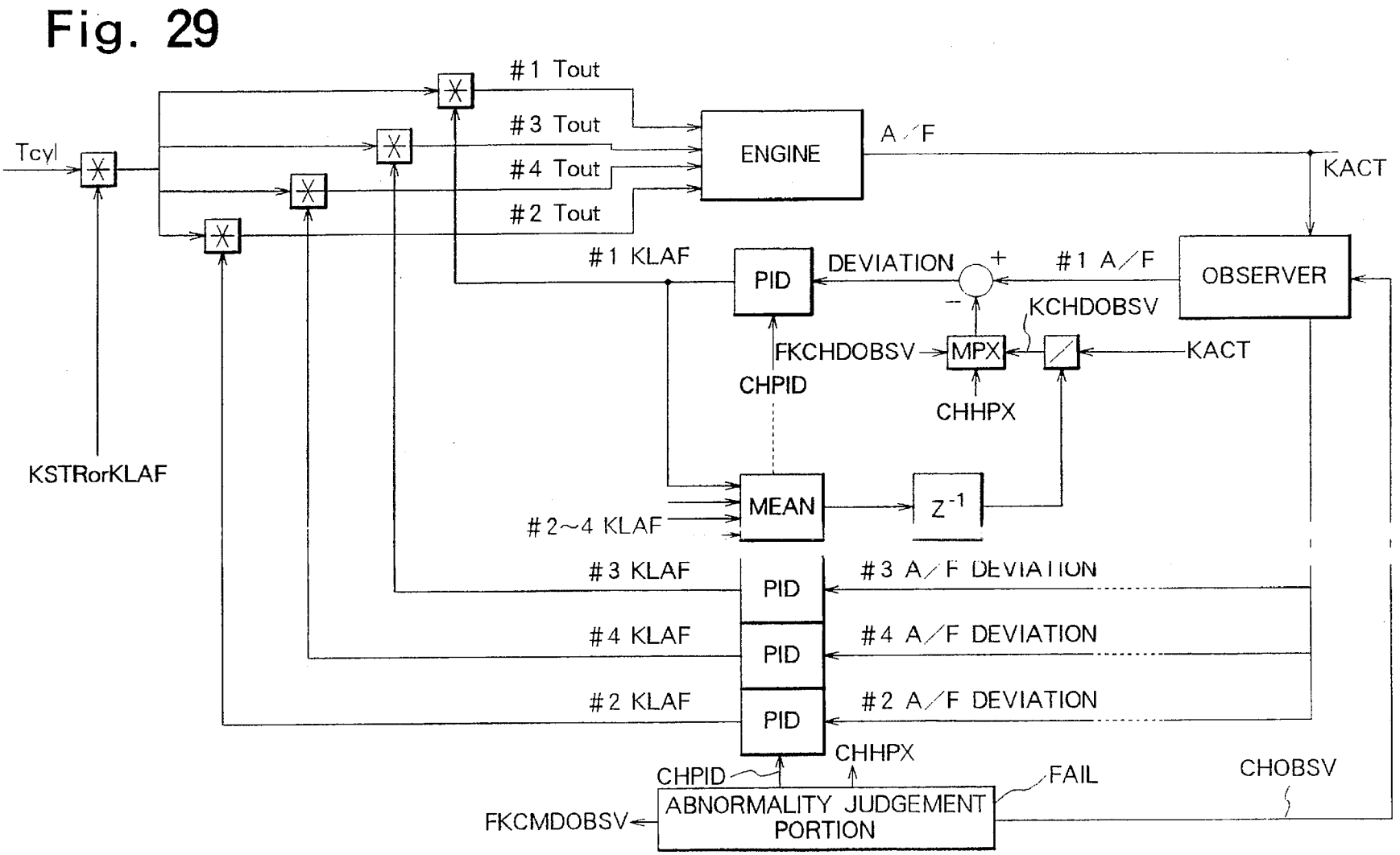
FIG. 29 is a block diagram showing functions of a feedback system in accordance with the fourth embodiment of the present invention.

19, the fist and second feedback control systems of the present embodiment are constructed as shown in the block diagram of FIG. 29. Also, in accordance with the difference in constitution, the sampling action block sel-V has characteristic functions. Like those shown in FIG. 2, the functions of FIG. 29 are realized by an engine control equipped with a microprocessor and the like.

In FIG. 29, the third feedback system has a change-over mechanism MPX on the input side of each PID block, while an abnormality judgment portion FAIL for controlling the actions of the change-over mechanism MPX, PID blocks, and observer OBSV is provided.

The abnormality judgment portion FAIL judges whether or not there are various abnormalities which are explained later. When there are not abnormalities, it sends a command signal CHMPX to the change-over mechanism MPX so as to make it transfer the target value KCMDOBSV to an adder-subtractor, while sending command signals CHPID and CHOBSV to the PID blocks and observer OBSV, respectively, so as to make them perform the normal feedback control for individual cylinder explained in the first embodiment. When there are abnormalities, on the other hand, depending on the kinds of these abnormalities, various control operations are performed. For example, the command signal CHPID may be used to change each of the PI, KI, and KD terms in the PID blocks to a value smaller than that in the normal operational condition before the air/fuel ratio correction coefficient for individual cylinder #nKLAF is calculated; the command signal CHMPX may be used to perform a change-over processing by which a predetermined fixed value FKCMDOBSV is transferred to the adder-subtractor in lieu of the target value KCMDOBSV; or the command signal CHOBSV may be used to stop the estimation processing of air/fuel ratio of individual cylinder #nA/F. These functions of the abnormality judgment portion FAIL and change-over mechanism MPX may be realized by programmed processing of the engine control unit 36 or by hardware.

In the following, specific actions of the sampling action block sel-V and third feedback control will be explained with reference to the flow charts of FIGS. 30 and 31.

First, with reference to the flow chart of FIG. 30, the action of the sampling action block sel-V for obtaining the air/fuel ratio at the collective portion of the exhaust system (i.e., KACT) will be explained. Actually, this processing is performed at step S400 in the routine shown in FIG. 5 beforehand, so that the detected air/fuel ratio KACT and estimated value #nA/F can be used in the processing operations at step S700 and step S800.

Figure 30:
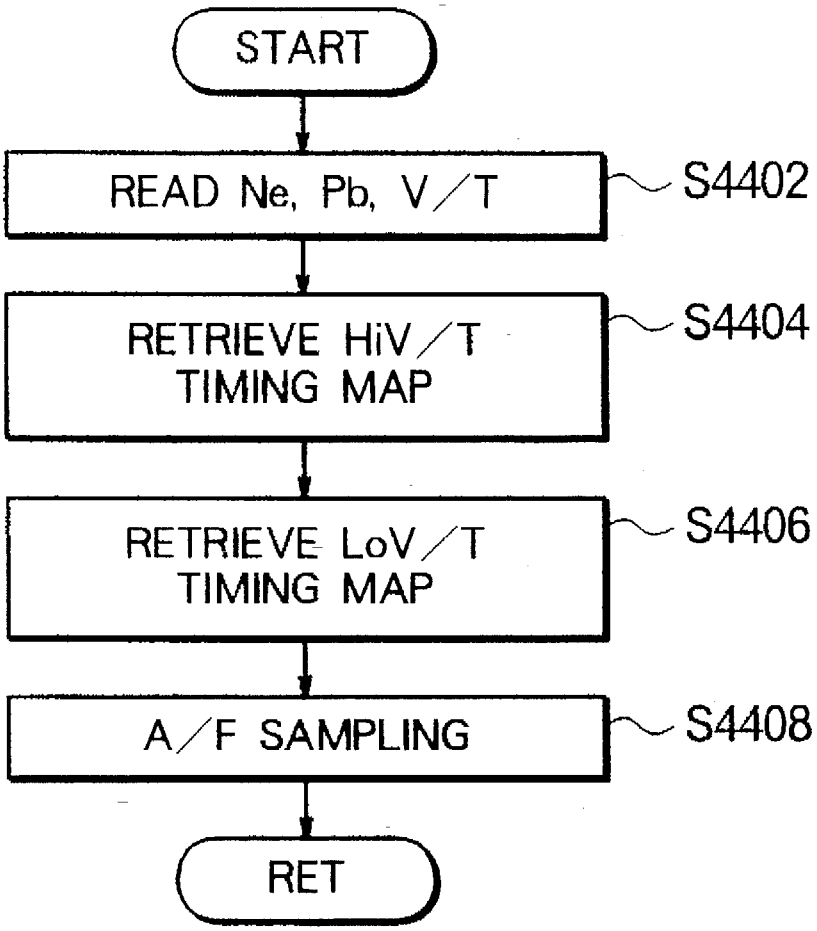
FIG. 30 is a flow chart showing the sampling action of detected air/fuel ratio in the sampling action block (sel-V)

In FIG. 30, engine speed Ne, intake pressure Pb, and valve timing V/T are read out at step S4402, the timing maps for HiV/T and LoV/T are respectively retrieved at step S4404 and step S4406, and then the output of the LAF sensor 54 is sampled for HiV/T and LoV/T at step S4408 to obtain the detected air/fuel ratio KACT for HiV/T and the detected air/fuel ratio KACT for LoV/T.

The above-mentioned timing maps are similar to those of FIG. 21. Namely, the characteristics are set such that the value sampled at earlier crank angle is selected as the engine speed Ne becomes lower or the intake pressure (i.e., negative pressure) Pb becomes higher. Here, "earlier" refers to the value sampled at a position nearer to the last TDC position (i.e., older value). On the other hand, they are set such that the value sampled at later crank angle (i.e., newer value) is selected as the engine speed Ne becomes higher or the intake pressure Pb becomes lower. Namely, as shown in FIG. 11, though it is best for the LAF sensor output to be sampled at a position as near as possible to the point of inflection of the actual air/fuel ratio, this point of inflection, e.g., the first peak value, occurs at an earlier crank angle as the engine speed Ne becomes lower as shown in FIG. 22 when the response time of the LAF sensor 54 is constant. Also, the exhaust gas pressure and exhaust gas volume increase as the load becomes higher, so that the exhaust gas is expected to flow in a faster rate and reach the LAF sensor 54 in a shorter time. In view of these points, the sampling timing is set as shown in FIG. 22.

Further, with respect to valve timing, certain values of engine speed Ne1 are taken as Ne1–Lo on the Lo side and as Ne1–Hi on the Hi side, while certain values of intake pressure Pb1 are taken as Pb1–Lo on the Lo side and as Pb1–Hi on the Hi side. Then, the map characteristics are:

$$Pb1\text{–}Lo > Pb1\text{–}Hi$$

$$Ne1\text{–}Lo > Ne1\text{–}Hi$$

Namely, in HiV/T, since the opening timing of the exhaust valve is earlier than that in LoV/T, its map characteristic is set such that an earlier sampling value is selected when its engine speed or intake pressure value is the same as that in LoV/T.

The foregoing processing operations in steps S4402 to S4408 correspond to the sampling action block sel-V. Accordingly, as shown in the lower portion of FIG. 23, the CPU core 64 can correctly recognize the maximum and minimum values of sensor output. Also, based on thus-obtained correct air/fuel ratio, the control operations shown in steps S700 and S800 in FIG. 5 are performed.

In the following, the feedback control for individual cylinder in step S800 in FIG. 5 will be explained with reference to the flow chart of FIG. 31. In this embodiment, since the internal combustion engine has the valve timing mechanism 300, the air/fuel ratio of individual cylinder #nA/F is estimated according to the valve timings HiV/T and LoV/T and then the air/fuel ratio correction coefficient for individual cylinder #nKLAF is obtained.

Figure 26:
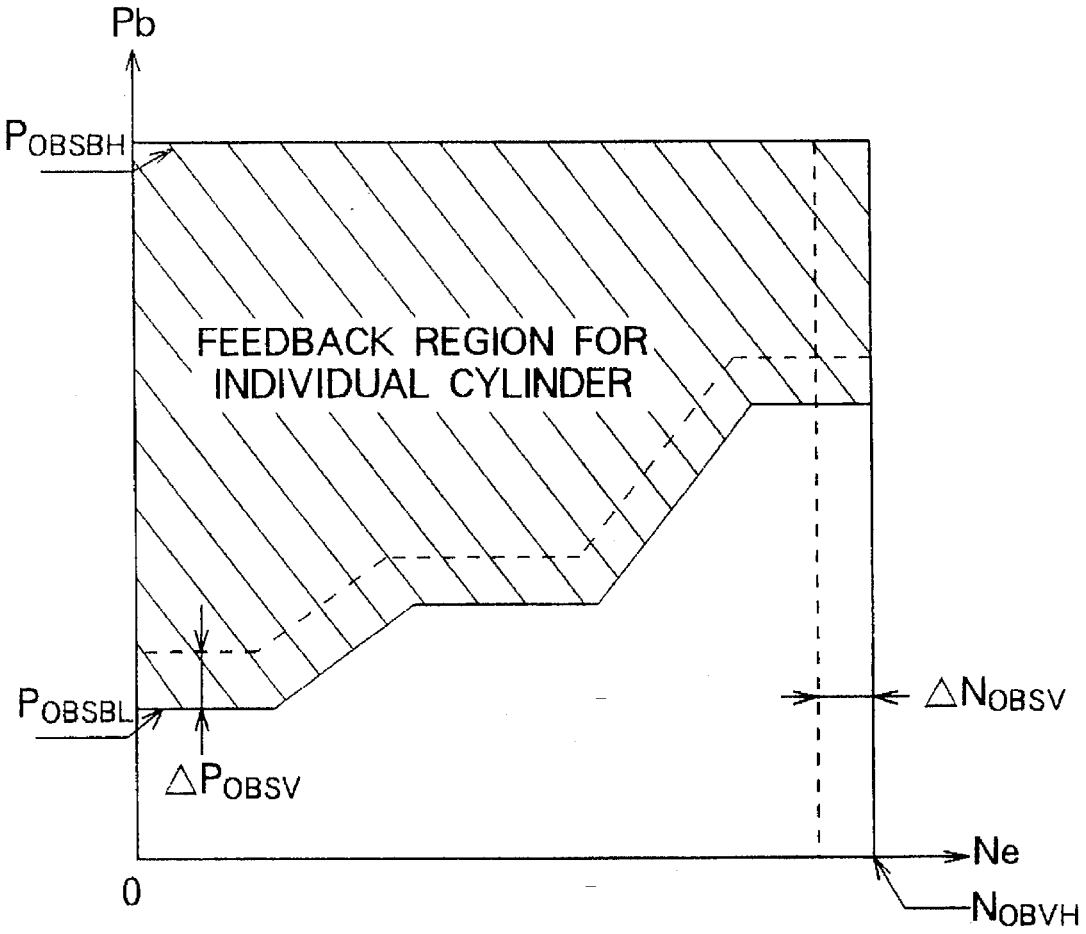
FIG. 26 is an explanatory chart showing a feedback region for individual cylinder used for the judging action depicted in FIG. 25.
Figure 31:
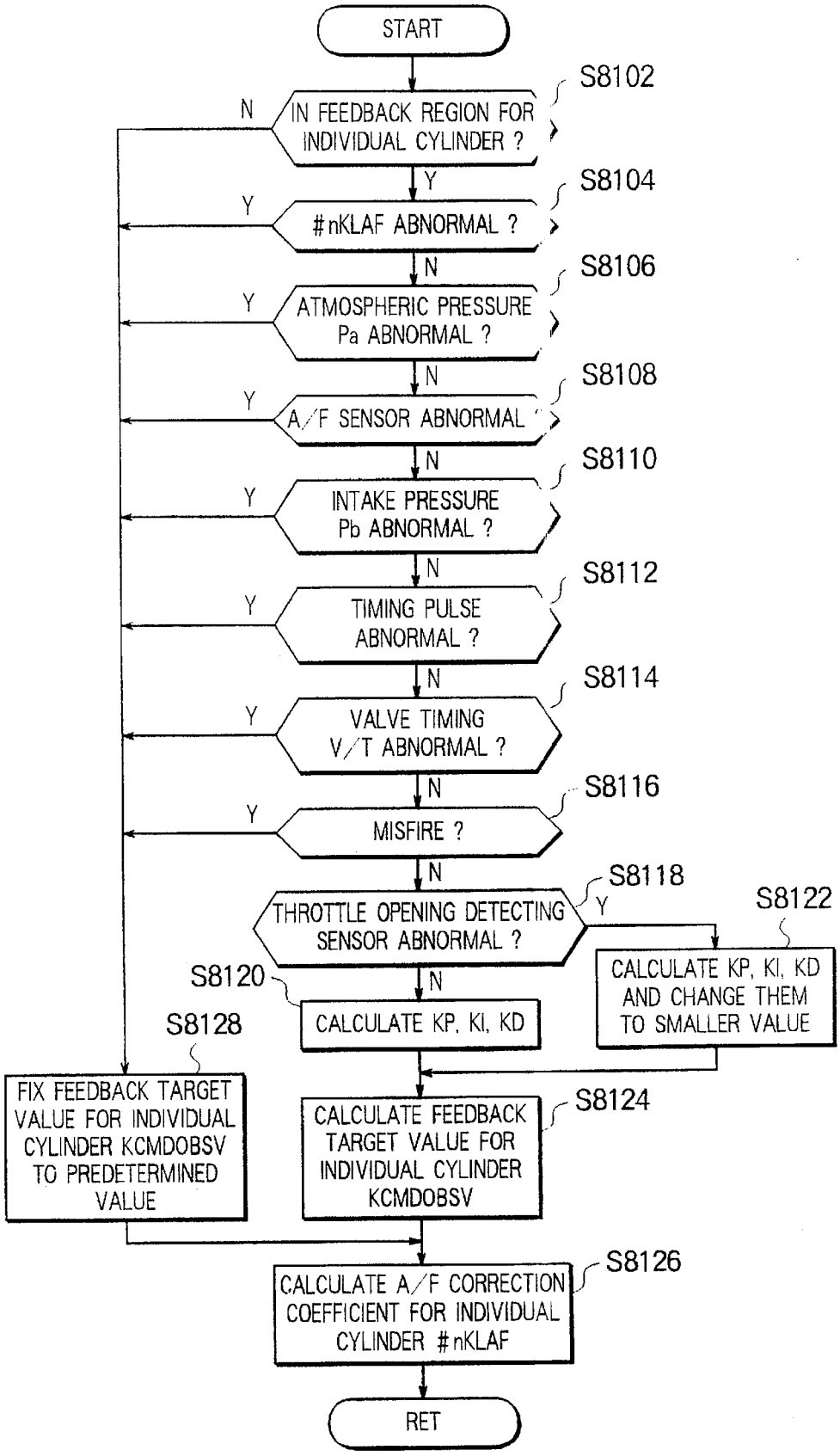
FIG. 31 is a flow chart explaining actions of the third feedback system (i.e., feedback control system for individual cylinder) in the fourth embodiment.

In FIG. 31, the abnormality judgment portion FAIL performs the judgment operations at steps S8102 to S8118. First, at step S8102, it is judged whether the feedback control for individual cylinder by the third feedback system can be performed or not. Namely, when the operational condition is within a predetermined region (called "feedback region for individual cylinder") with parameters of engine speed Ne and intake pressure Pb as shown in FIG. 26, it is judged that the normal feedback control for individual cylinder is possible and the processing proceeds to step S8104; whereas, when the operational condition is outside of the predetermined range, the processing proceeds to step S8128 in view of the stability in control.

At step S8104, when the value of the air/fuel ratio correction coefficient for individual cylinder #nKLAF obtained by the PID control law is within a predetermined region, it is judged that the normal feedback control for individual cylinder is possible and the processing proceeds to step S8106; whereas, when the operational condition is outside of the predetermined range, it is judged that the aimed correction of fluctuations in the air/fuel ratios of individual cylinders is impossible and the processing proceeds to step S8128.

At step S8106, it is judged whether there is abnormality in output Pa of the atmospheric pressure sensor 48 or not. For example, when the value of the output Pa becomes a value which cannot occur inherently, it is judged that the atmospheric pressure sensor 48 has failed and the processing proceeds to step S8128. Also, as in the case of high-ground travel, when the output becomes much lower than that in the normal low-ground travel, the processing proceeds to step S8128 in order to stop the normal feedback control for individual cylinder. When the output is judged as an atmospheric pressure which is applicable to the operational condition of the internal combustion engine 10, the processing proceeds to step S8108.

Figure 32:
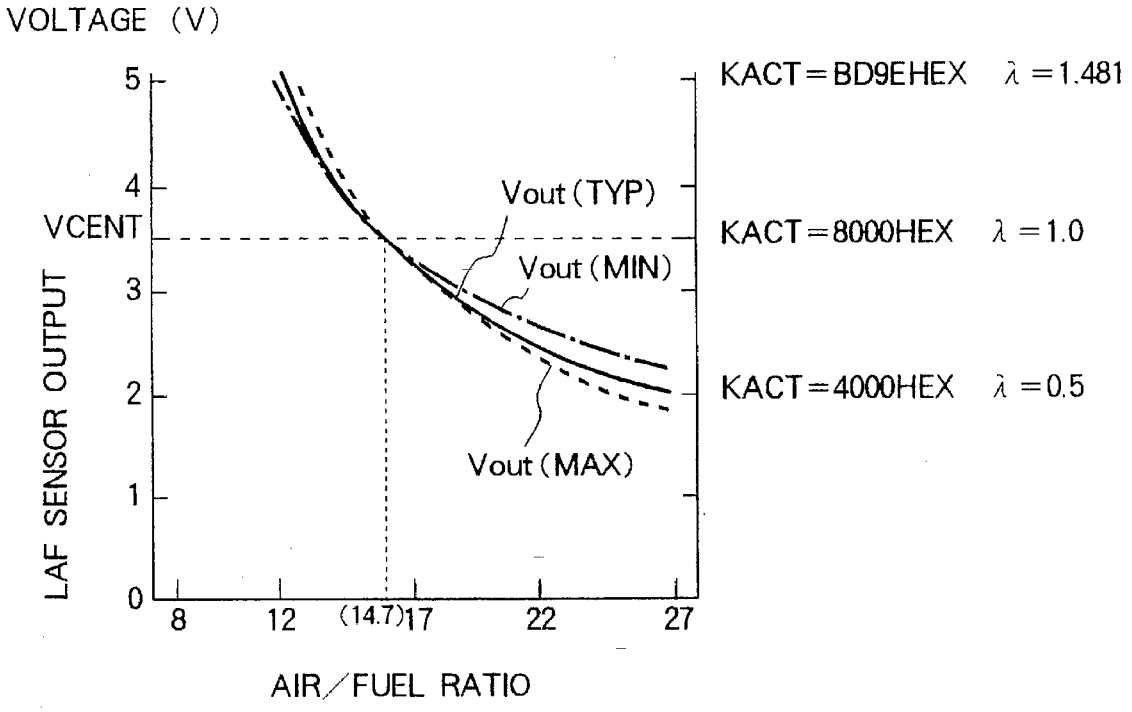
FIG. 32 is an explanatory chart showing characteristics of an LAF sensor in accordance with the fourth embodiment.

At step S8108, it is judged whether there is abnormality in the LAF sensor 54 or not. For example, when the output value LAF of the LAF sensor 54 becomes a value which cannot occur inherently, it is judged that the LAF sensor 54 has failed and the processing proceeds to step S8128; whereas the processing proceeds to step S8110 when such abnormality is not detected. As shown in FIG. 32, the output value LAF of the normal LAF sensor 54 is a value within a range from a minimum value (MIN) to a maximum value (MAX) having its center at a typical value (TYP). Accordingly, it can be judged that the LAF sensor is normal when its output value is within a predetermined region including the range from the minimum value (MIN) to the maximum value (MAX), whereas it is judged that abnormality such as failure has occurred when the output is outside of such a region.

At step S8110, it is judged whether there is abnormality in the output Pb of the intake pressure sensor 44 or not. For example, when the output value Pb becomes a value which cannot occur inherently, it is judged that the intake air pressure sensor 44 has failed and the processing proceeds to step S8128; whereas the processing proceeds to step S8112 when such abnormality is not detected.

At step S8112, it is judged whether abnormality has occurred in the sampling timing of the sampling action block sel-V or not. For example, when the output of the LAF sensor 54 cannot be correctly sampled, as in the case where the sampling timing indicated as "CRK" in FIG. 23 does not change in response to changes in the engine speed, it is judged that abnormality has occurred and the processing proceeds to step S8114. when there is no such abnormality, on the other hand, the processing proceeds to step S8114.

At step S8114, it is judged whether there is abnormality in the output of the timing detection sensor 52 or not. For example, when the output value becomes a value which cannot occur inherently, it is judged that abnormality has occurred in the timing detection sensor 52 or valve timing mechanism 300 and the processing proceeds to step S8128; whereas the processing proceeds to step S8116 when such abnormality is not detected.

At step S8116, on the basis of fluctuations in the engine speed, it is judged whether a misfiring condition has occurred or not. When it is judged that misfire has occurred, the processing proceeds to step S8128; while it proceeds to step S8118 when such abnormality is not detected.

At step S8118, it is judged whether there is abnormality in the output of the throttle opening detection sensor 40 or not. The processing proceeds to step S8120 when there is no abnormality, whereas it proceeds to step S8122 when there is abnormality.

In this manner, according to the processing operations at steps S8102 to S8118, it is judged whether or not there are abnormalities such as failure in various sensors for detecting operational conditions and whether or not there are environmental conditions applicable to the engine. When it is detected that any abnormality has occurred, the processing operation of step S8122 or step S8128 is selectively performed depending on the magnitude of abnormality (according to a predetermined order of preference). Only when there is no abnormality at all, the processing proceeds to step S8120 in order to perform the normal feedback control for individual cylinder. The command signals CHPID, CHMPX, and CHOBSV of the abnormality judgment portion FAIL shown in FIG. 29 are used to perform such selection of the processing.

At step S8120, the calculation indicated in the above-mentioned equation 30 is performed to obtain the KP, KI, and KD terms of the PID control law. At step S8122, on the other hand, each of thus obtained KP, KI, and KD terms is multiplied by a predetermined coefficient $\beta$ ($0 \leqq \beta < 1.0$), for example, to obtain smaller values of the KP, KI, and KD terms. Namely, the KP, KI, and KD terms are changed into smaller values so as to reduce the speed at which the feedback control amount for individual cylinder is calculated with respect to the output fuel injection amount #nTout.

Next, at step S8124, the calculation indicated in the above-mentioned equation 29 is performed to calculate the target value KCMDOBSV. Accordingly, the adder-subtractor disposed at the feedback path for individual cylinder is actuated so as to reduce the deviation between the air/fuel ratio of individual cylinder #nA/F estimated by the observer OBSV and this target value KCMDOBSV and, at step 8126, calculates the air/fuel ratio correction coefficient for individual cylinder #nKLAF according to the PID control law. Then, at step S900 shown in FIG. 5, the output fuel injection amount for individual cylinder #nTout is obtained.

In this manner, in the processing operations at steps S8120, S8122, and S8124, the normal feedback control for individual cylinder or the feedback control for individual cylinder corresponding to the magnitude of abnormality is performed. When this routine is executed, the observer OBSV continues the estimation processing of the air/fuel ratio of individual cylinder #nA/F.

When any abnormality is detected at the above-mentioned steps S8102 to S8116 and then the processing proceeds to step S8128, the abnormality judgment portion FAIL sends the command signal CHMPX to the change-over mechanism MPX so as to make it change over such that the predetermined value FKCMDOBSV is transferred to each adder-subtractor in lieu of the target value KCMDOBSV. As a result, the value of air/fuel ratio correction coefficient for individual cylinder #nKLAF obtained according to the PID control law is also fixed, thereby substantially stopping the feedback control for individual cylinder with respect to the output fuel injection amount for individual cylinder #nTout obtained at step S900. Also, the observer OBSV stops performing the estimation processing of the air/fuel ratio of individual cylinder #nA/F.

As explained in the foregoing, in accordance with this embodiment, the third feedback system has the change-over mechanism MPX on the input side of each PID block, while the abnormality judgment portion FAIL for controlling the actions of the PID blocks and observer OBSV is provided, and control operations are performed such that, according to the failures of various sensors disposed for controlling the internal combustion engine 10 and the magnitude of environmental conditions where the feedback control for individual cylinder cannot be performed appropriately, the feedback control for individual cylinder is stopped or the feedback gain is decreased, for example. Accordingly, upon these abnormal conditions, the air/fuel ratio is prevented from diverging, for example, and thus the stability in control can be secured.

(Fifth Embodiment)

This embodiment relates to a technique which enables the engine control unit (ECU) to perform the feedback control for individual cylinder even when the engine speed Ne of the internal combustion engine increases.

First, in order to facilitate the understanding of this embodiment, the problem to be solved resulting from the increase in the engine speed Ne will be explained with reference to FIG. 33.

Figure 33:
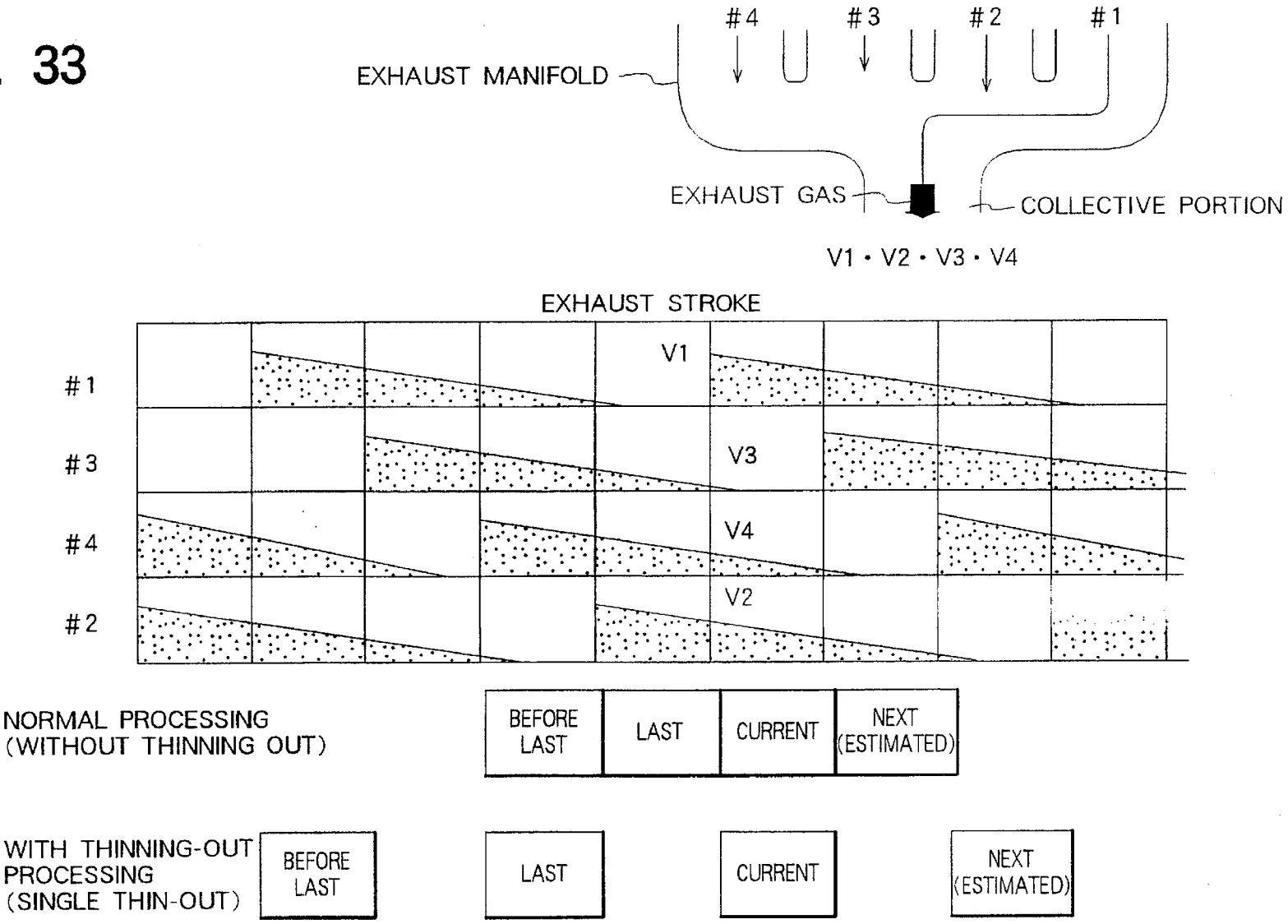
FIG. 33 is an explanatory chart with respect to the fifth embodiment of the present invention explaining technical problems to be overcome.

FIG. 33 shows exhaust strokes of a multiple cylinder internal combustion engine (the drawing showing a four-cylinder engine as a typical example) and a conventional technique for coping with the increase in engine speed Ne. The exhaust gas flowing through the collective portion of the exhaust system in the internal combustion engine is a mixed gas comprising gases V1 to V4 discharged from the cylinders #1 to #4. These gases V1 to V4 cannot be clearly separated and measured on the basis of time.

Therefore, in accordance with the present invention, as mentioned above, the theoretical model for the exhaust system, sampling action block (sel-V), observer, and the like are provided and the detected value of the single air/fuel ratio sensor disposed at the collective portion of the exhaust system is applied thereto so as to accurately estimate the air/fuel ratio of individual cylinder. Also, the feedback control for individual cylinder is performed so as to eliminate fluctuation in the air/fuel ratios of individual cylinders, thereby improving the efficiency in purification of exhaust gas.

Here, the time required for the feedback control for individual cylinder is determined substantially univocally depending on the processing speed of a predetermined application program by the engine control unit. Accordingly, when the engine speed Ne is small (i.e., in the case of low-speed operation), there must be no problem since the normal feedback control for individual cylinder can be performed during each TDC period. When the engine speed Ne increases (i.e., in the case of high-speed operation) and the period of each TDC becomes shorter, there occurs a problem that it becomes difficult for the normal feedback control to be performed during each TDC period.

In order to cope with such a problem, there are cases, for example, where a technique is applied such that feedback control operations for individual cylinder are thinned out so as to relatively shorten the time required for the feedback control for individual cylinder.

However, when the thinning-out processing is simply performed, the true air/fuel ratio of individual cylinder cannot be estimated. Namely, when the thinning-out operation is performed for every other operation as shown in FIG. 33, the air/fuel ratio of the first cylinder #1, air/fuel ratio of the fourth cylinder #4, and air/fuel ratio of the first cylinder #1 are detected at before last, last, and current operations, respectively. Accordingly, the air/fuel ratios of the second cylinder #2 and third cylinder #3 cannot be detected. As a result, there occurs a problem that the air/fuel ratio of individual cylinder cannot be estimated from the air/fuel ratio at the collective portion of the exhaust system.

Also, a technique may be applied such that a simple discontinuing processing by which the estimation processing is stopped and restarted when the engine speed Ne increases and decreases again, respectively, is performed. In this case, since the observer estimates the air/fuel ratio of individual cylinder by using the above-mentioned form of recurrence formula, it does not perform the calculation of estimated values of the air/fuel ratio of individual cylinder when the estimation processing is stopped. Then, the estimated value for individual cylinder at the time when the estimation processing is restarted may differ from the actual value, thereby naturally forming a discontinuity in the estimated values. Therefore, it may result in a problem that true air/fuel ratio of individual cylinder cannot be obtained, thereby deteriorating the stability in control.

The present embodiment provides a technique by which the feedback control for individual cylinder is appropriately performed even when the engine speed increases.

Since the basic structure of this fuel injection amount control apparatus for internal combustion engine is similar to that of the first embodiment which has been explained with reference to FIGS. 1–19, 20–23, and 26, the characteristic portions of the present embodiment will be mainly explained in detail.

Figure 34:
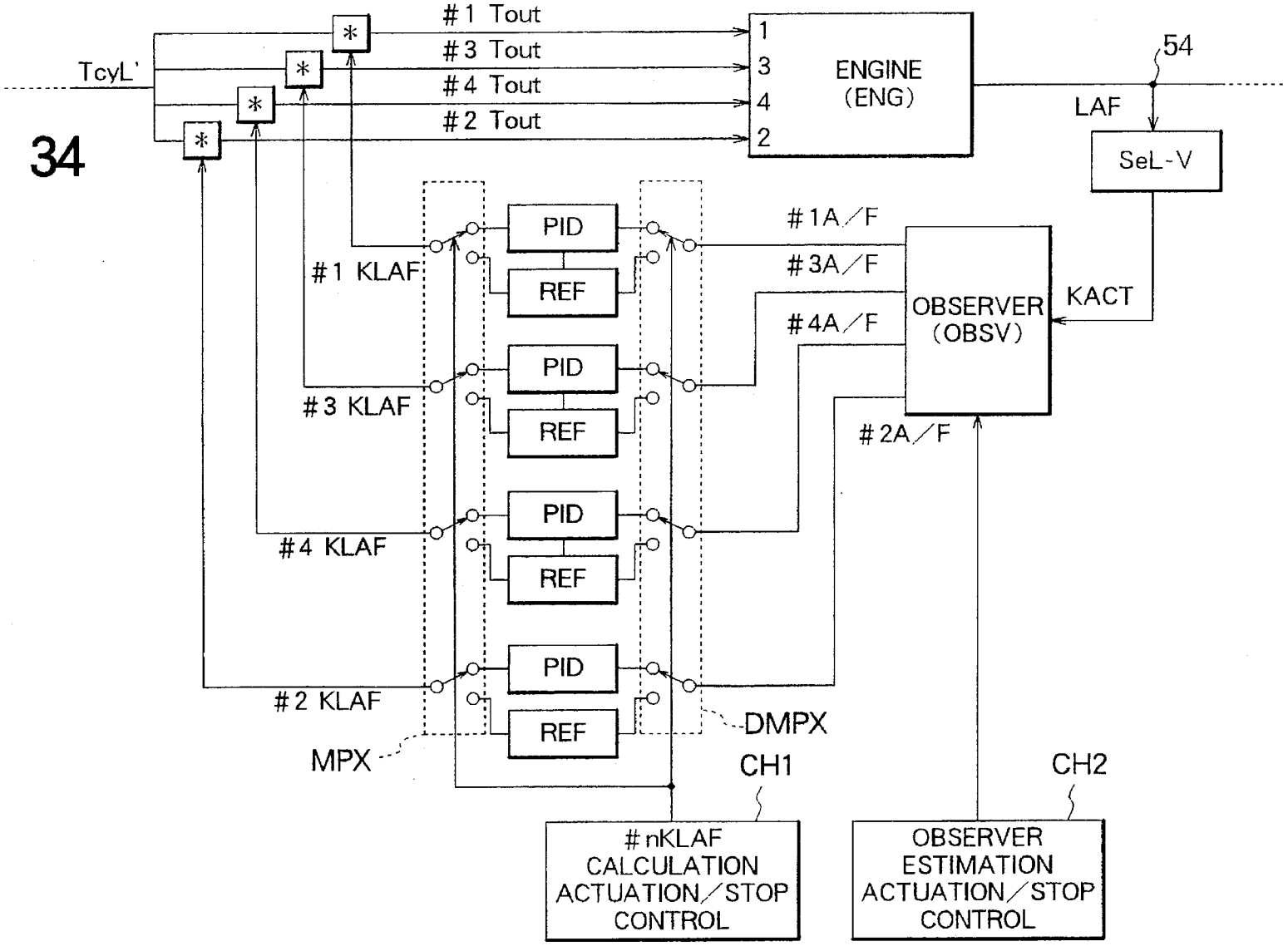
FIG. 34 is a block diagram showing functions of the feedback system in accordance with the fifth embodiment.

This embodiment differs from the first embodiment in that, while the feedback control system for individual cylinder in the first embodiment is constructed as shown in FIG. 19, the feedback control system for individual cylinder in the present embodiment is constructed as shown in the block diagram of FIG. 34. Like those shown in FIG. 2, the functions of FIG. 34 are realized by an engine control unit equipped with a microprocessor and the like.

In FIG. 34, in the middle of the path of the third feedback system, a demultiplexer DMPX and a multiplexer MPX are respectively disposed at input and output terminals of function blocks (i.e., PID in the drawing) for calculating the air/fuel ratio correction coefficient for individual cylinder #nKLAF on the basis of the PID control law. Also, memory blocks REF for storing data of predetermined fixed values or restoring new data are provided. In response to the operational conditions which will be explained later, a first control block CH1 commands the demultiplexer DMPX and multiplexer MPX to change over each channel, whereas a second control block CH2 commands the observer OBSV to actuate or stop the estimation processing. These functions may be realized by programmed processing by the engine control unit 36 or by hardware.

In the following, the specific actions of the sampling action block sel-V and third feedback system will be explained with reference to the flow charts of FIG. 20 and FIG. 35.

First, with reference to the flow chart of FIG. 20, the action of the sampling action block sel-V for obtaining the air/fuel ratio at the collective portion of the exhaust system (i.e., KACT) will be explained. Actually, this processing is performed in step S400 in the routine shown in FIG. 5 beforehand, so that the detected air/fuel ratio KACT and estimated value #nA/F can be used in the processing operations at step S700 and step S800.

In FIG. 20, engine speed Ne, intake pressure Pb, and valve timing V/T are read out at step S402, the timing maps for HiV/T and LoV/T are respectively retrieved at step S404 and step S406, and then the output of the LAF sensor 54 is sampled for HiV/T and LoV/T at step S408 to obtain the detected air/fuel ratio KACT for HiV/T and the detected air/fuel ratio KACT for LoV/T.

FIG. 21 is an explanatory chart showing the characteristics of these timing charts. As indicated by this chart, the characteristics are set such that the value sampled at earlier crank angle is selected as the engine speed Ne becomes lower or the intake pressure (i.e., negative pressure) Pb becomes higher. Here, "earlier" refers to the value sampled at a position nearer to the last TDC position (i.e., older value). By contrast, they are set such that the value sampled at later crank angle (i.e., newer value) is timing maps for HiV/T and LoV/T are respectively retrieved at step S404 and step S406, and then the output of the LAF sensor 54 is sampled for HiV/T and LoV/T at step S408 to obtain the detected air/fuel ratio KACT for HiV/T and the detected air/fuel ratio KACT for LoV/T.

FIG. 21 is an explanatory chart showing the characteristics of these timing charts. As indicated by this chart, the characteristics are set such that the value sampled at earlier crank angle is selected as the engine speed Ne becomes lower or the intake pressure (i.e., negative pressure) Pb becomes higher. Here, "earlier" refers to the value sampled at a position nearer to the last TDC position (i.e., older value). By contrast, they are set such that the value sampled at later crank angle (i.e., newer value) is selected as the engine speed Ne becomes higher or the intake pressure Pb becomes lower. Namely, as shown in FIG. 11, though it is best for the LAF sensor output to be sampled at a position as near as possible to the point of inflection of the actual air/fuel ratio, this point of inflection, e.g., the first peak value, occurs at an earlier crank angle as the engine speed Ne becomes lower as shown in FIG. 22 when the response time of the sensor is assumed to be constant. Also, the exhaust gas pressure and exhaust gas volume increase as the load becomes higher, so that the exhaust gas is expected to flow in a faster rate and reach the LAF sensor 54 in a shorter time. In view of these points, the sampling timing is set as shown in FIG. 22.

Further, with respect to valve timing, certain values of engine speed Ne1 are taken as Ne1–Lo on the Lo side and as Ne1–Hi on the Hi side, while certain values of intake pressure Pb1 are taken as Pb1–Lo on the Lo side and as Pb1–Hi on the Hi side. Then, the map characteristics are:

$$Pb1\text{-}Lo > Pb1\text{-}Hi$$

$$Ne1\text{-}Lo > Ne1\text{-}Hi$$

Namely, in HiV/T, since the opening timing of the exhaust valve is earlier than that in LoV/T, its map characteristic is set such that an earlier sampling value is selected when its engine speed or intake pressure value is the same as that in LoV/T.

The foregoing processing operations in steps S402 to S408 correspond to the sampling action block sel-V. Accordingly, as shown in the lower portion of FIG. 23, the CPU core 64 can correctly recognize the maximum and minimum values of sensor output. Also, based on thus obtained correct air/fuel ratio, the feedback control operations shown in steps S700 and S800 shown in FIG. 5 are performed.

In the following, the feedback control for individual cylinder in step S800 in FIG. 5 will be explained with reference to the flow chart of FIG. 31. In this embodiment, since the internal combustion engine has the valve timing mechanism 300, the air/fuel ratio of individual cylinder #nA/F is estimated according to the valve timings HiV/T and LoV/T and then the air/fuel ratio correction coefficient for individual cylinder #nKLAF is obtained.

Figure 35:
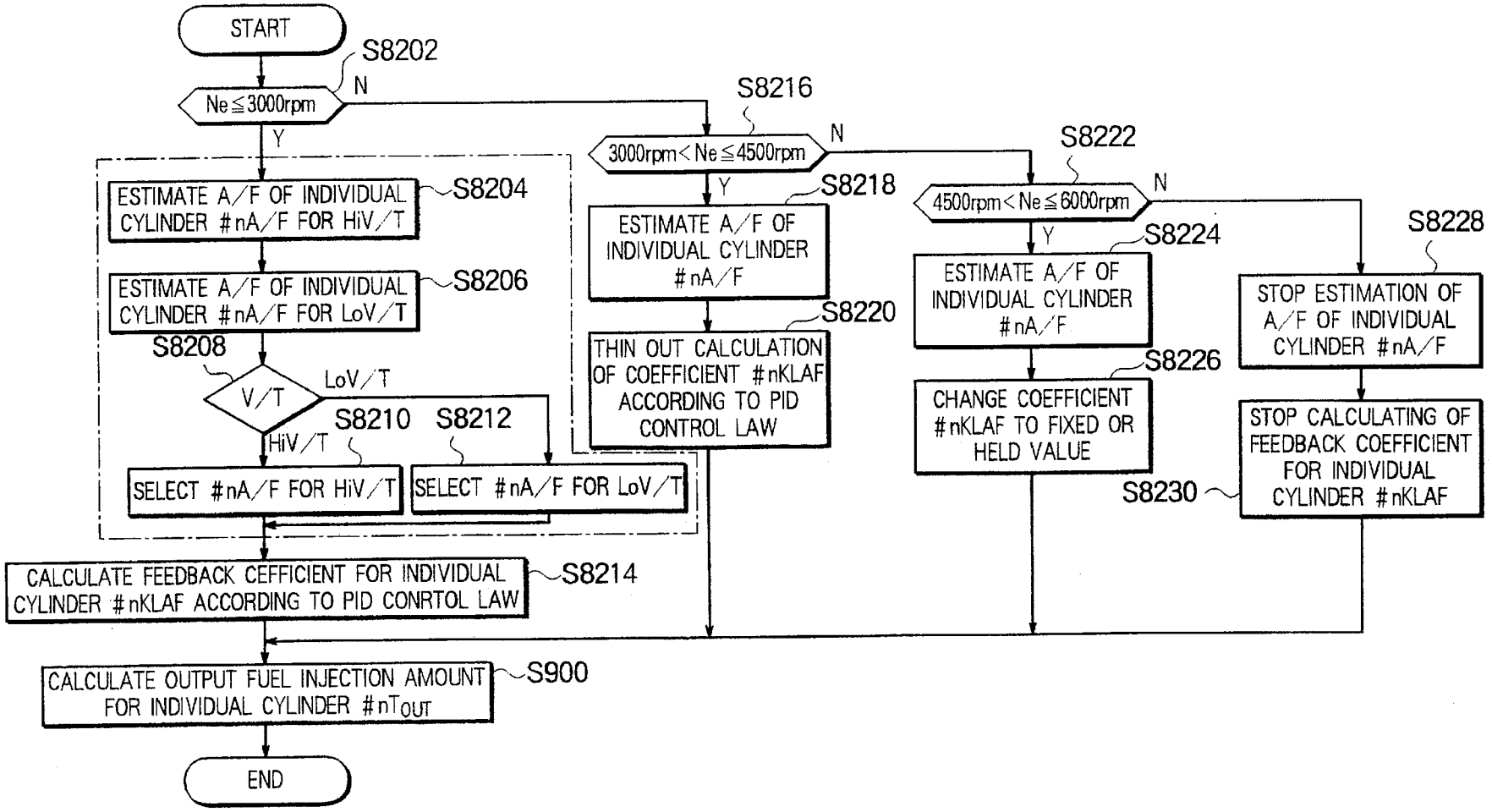
FIG. 35 is a flow chart explaining actions of the third feedback system (i.e., feedback system for individual cylinder) in the fifth embodiment.

In FIG. 35, at step S8202, it is judged whether the engine speed Ne is up to a predetermined value (3,000 rpm in this embodiment) or not. Namely, this judgment processing is performed since a series of processing operations for feedback control cannot be performed at every TDC when the engine speed Ne exceeds the predetermined value so as to shorten the period of every TDC. When the engine speed Ne is at a value where the processing is possible (i.e., the judgment is positive), the processing proceeds to steps S8204 to S8214. As shown in FIG. 34, the first control block CH1 controls the change-over connections of the demultiplexer DMPX and multiplexer MPX such that the output of the observer OBSV is connected to the PID block to perform the normal feedback control for individual cylinder. Also, the second control block CH2 commands the observer OBSV to perform the estimation processing of the air/fuel ratio of individual cylinder #nA/F. When the judgment is negative at step S8202, the processing proceeds to step S8216.

Steps S8204 to S8212 are a routine for the estimation processing of the air/fuel ratio of individual cylinder #nA/F performed by the observer OBSV. First, at steps S8204 and S8206, the air/fuel ratio of individual cylinder #nA/F for HiV/T is estimated from the detected air/fuel ratio KACT for Hi/V obtained at step S408, while the air/fuel ratio of individual cylinder #nA/F for LoV/T is estimated from the detected air/fuel ratio KACT for LoV/V. Then, at step S8208, the current valve timing V/T is judged. Thereafter, based on the result of this judgment, the processing proceeds to step S8210 or S8212 where the air/fuel ratio of individual cylinder #nA/F for HiV/T or LoV/T is selected and then output.

Next, at step S8214, the PID control law is applied to thus selected air/fuel ratio of individual cylinder #nA/F to obtain the air/fuel ratio correction coefficient for individual cylinder #nKLAF and then the output fuel injection amount for individual cylinder #nTout shown in step S900 in FIG. 5 is calculated.

Figure 36:
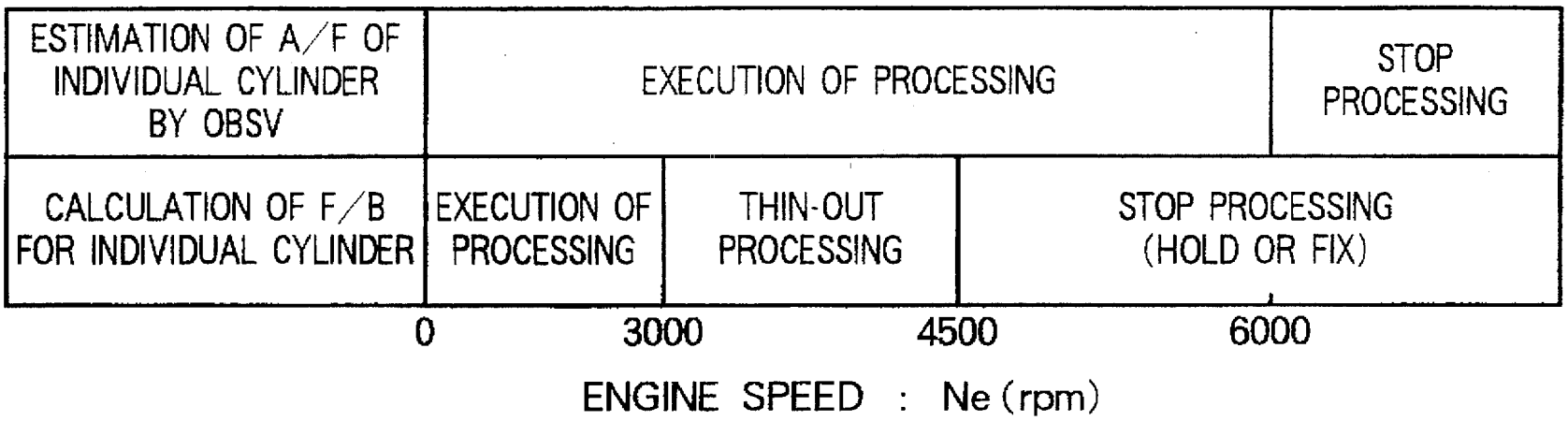
FIG. 36 is an explanatory chart showing conditions under which the actions of the third feedback system in the fifth embodiment are switched according to the engine speed.
Figure 37:
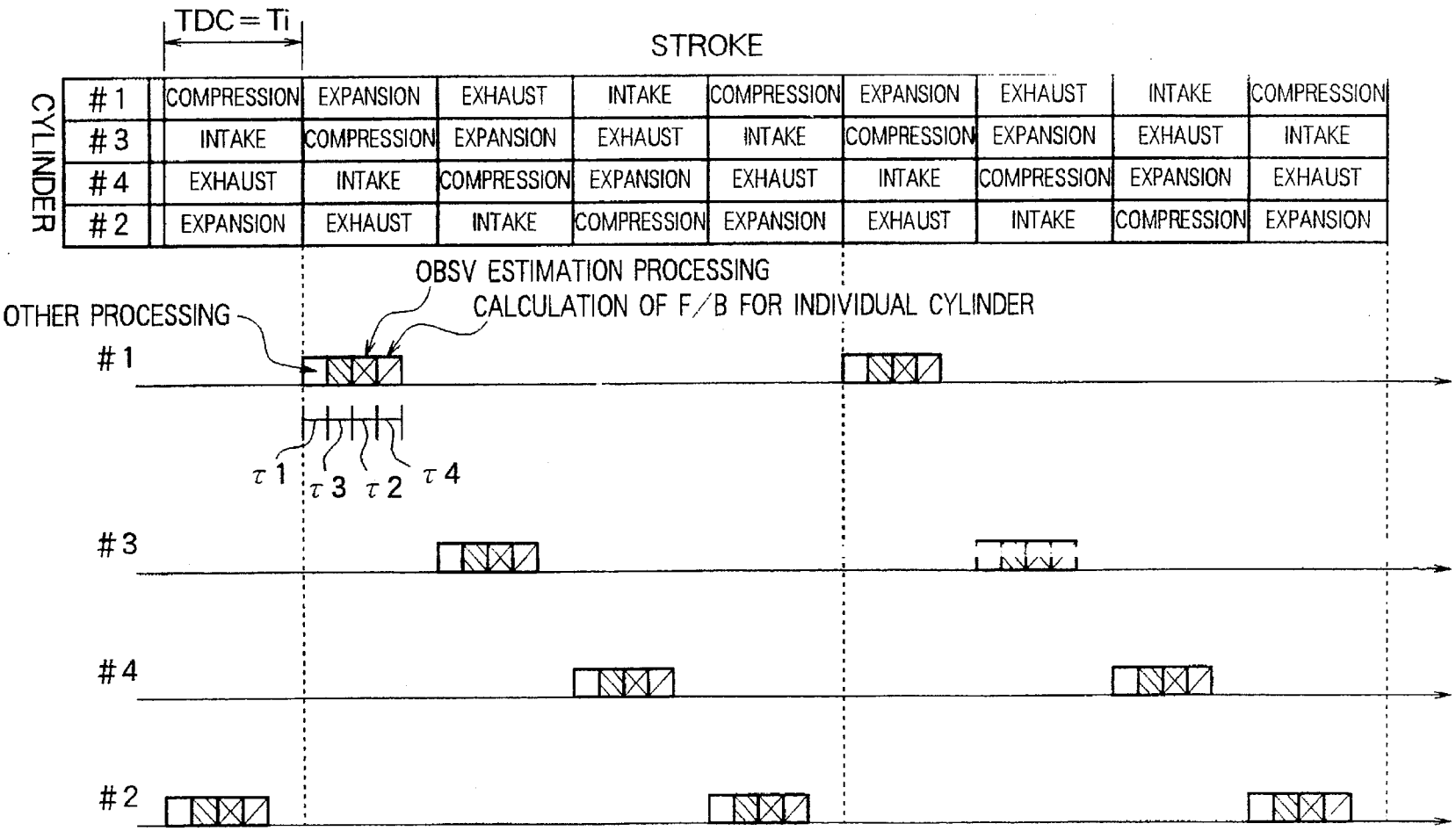
FIG. 37 is a stroke chart explaining the normal actions of the third feedback system in the fifth embodiment.

In this manner, when the engine speed Ne is at the predetermined value (3,000 rpm) or below, as shown in the judgment condition chart of FIG. 36, both the estimation processing operation of air/fuel ratio of individual cylinder #nA/F by the observer OBSV and the feedback calculation processing for individual cylinder are performed in synchronization with every TDC. FIG. 37 shows these functions more specifically. Namely, since TDC is at a sufficient period Ti, both the estimation processing operation of air/fuel ratio of individual cylinder #nA/F by the observer OBSV (processing with a period of $\tau 3$) and the feedback calculation processing for individual cylinder (processing with a period of $\tau 4$) are performed in synchronization with every TDC. Also, other processing operations, i.e., the processing operation of the above-mentioned feedforward system and first and second feedback systems (processing with a period of $\tau 1$), the input operation from various sensors which are basically necessary for performing the engine control (processing with a period of $\tau 2$), and the like are performed. That is, the normal feedback control for individual cylinder is performed.

Now, returning to FIG. 35, explanation will continue. When the judgment is negative at step S8202, it is judged at step S8216 whether the engine speed is within a predetermined range or not. In this embodiment, the processing proceeds to steps S8218 to S8220 in the case of 3,000 rpm$\leqq$Ne<4,500 rpm, whereby, as indicated by the judgment condition chart of FIG. 36, the estimation processing of air/fuel ratio of individual cylinder #nA/F by the observer OBSV is performed in synchronization with every TDC, while the processing of feedback calculation for individual cylinder according to the PID control law is stopped at every predetermined number of operations (i.e., every one or more operations) during a plurality of TDC periods. Namely, a so-called thinning-out processing is performed. This thinning-out processing is realized as the first control block CH1 in FIG. 34 successively on-off controls the change-over connections of the demultiplexer DMPX and multiplexer MPX. For example, when the feedback control with respect to the j-th cylinder #j is to be thinned out, the corresponding change-over contacts of the demultiplexer DMPX and multiplexer MPX are switched off so as to shut off the processing of the PID control law in the path concerning the j-th cylinder #j, while the other change-over contacts of the demultiplexer DMPX and multiplexer MPX are switched on so as to perform the normal processing in the PID in the paths concerning the remaining cylinders. Such a change-over processing is successively performed with respect to the individual cylinders #1 to #n, thereby enabling a uniform feedback control in each path on the basis of time even when the thinning-out processing is performed.

First, at step S8218, as in the case of steps S8204 to S8212, the air/fuel ratio of individual cylinder #nA/F is estimated. Then, at step S8220, the above-mentioned thinning-out processing is performed. Since the processing routine shown in FIG. 35 is in synchronization with TDC, the order by which the thinning-out processing is performed is altered every time this processing routine is performed (i.e., at every TDC).

Then, at step S900, since the feedback correction coefficient #jKLAF with respect to the path #j corresponding to the thinning-out processing is not obtained, only the output fuel injection amount #jTout concerning the corresponding cylinder is not subjected to feedback correction. The output fuel injection amount #nTout (except for #jTout) concerning the remaining cylinders is subjected to the feedback control for individual cylinder by the air/fuel ratio correction coefficient #nKLAF (except for #jKLAF) as usual.

Figure 38:
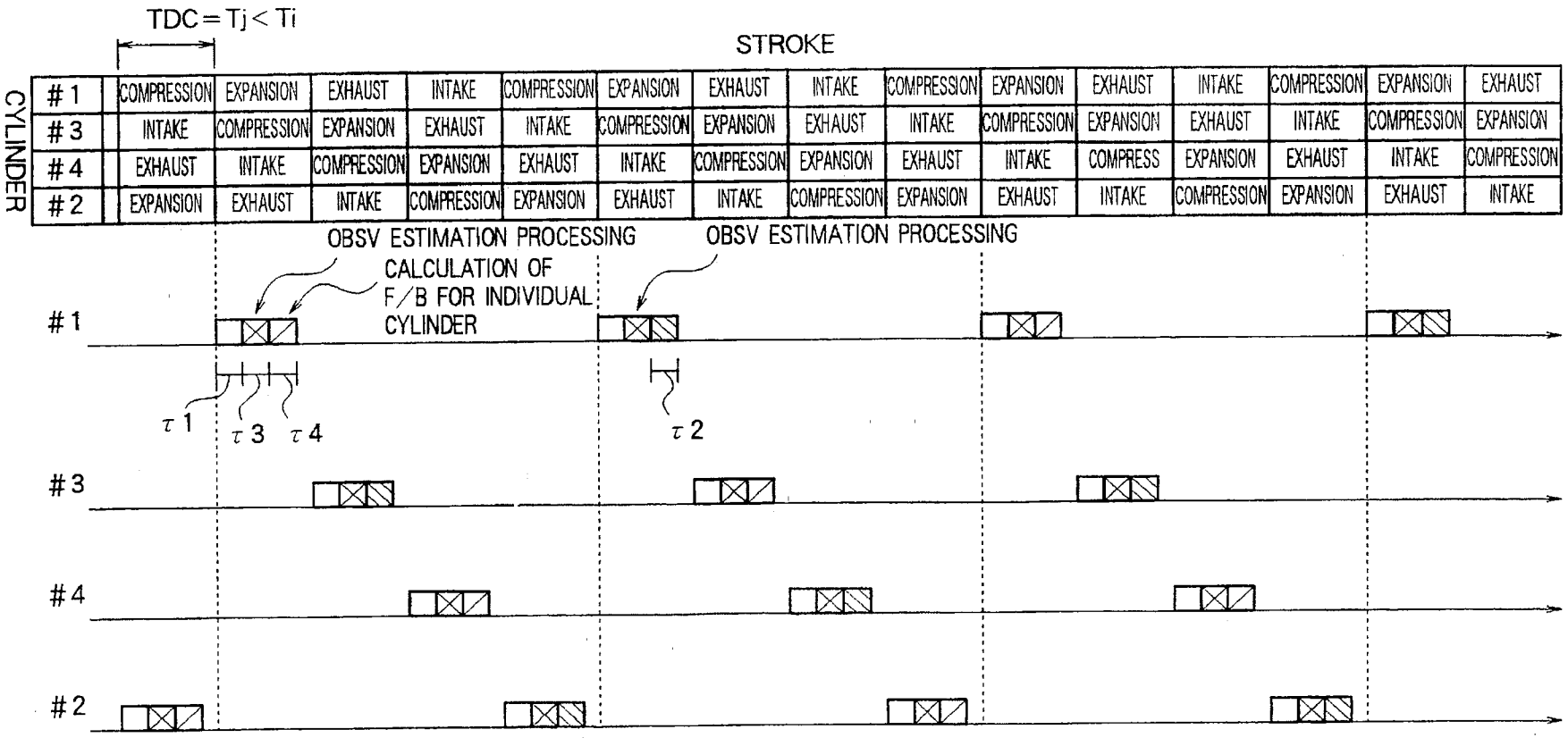
FIG. 38 is a stroke chart explaining an action of thinning-out processing of the third feedback system in the fifth embodiment.

FIG. 38 is a stroke chart showing a first example of thinning-out processing, whereas FIG. 38 is a stroke chart showing a second example of thinning-out processing.

First, the thinning-out processing of FIG. 38 repeats a process in which the feedback calculation for individual cylinder concerning one cylinder is stopped per 4 TDCs and then the order of the cylinder corresponding to this stopped calculation is shifted. In other words, while the feedback calculation for individual cylinder is repeated every 4 TDCs in the normal stroke shown in FIG. 37, the feedback calculation for individual cylinder is repeated every 8 TDCs and the phase of the thinning-out processing is shifted by 1TDC between the cylinders in accordance with the thinning-out processing of FIG. 38. In the case where the thinning-out processing is performed in this manner, the processing by the engine control unit 36 can be performed in synchronization with TDC even when the period of TDC is shortened to Tj (<Ti) as the engine speed increases. For example, as shown in FIG. 38, when the feedback control for individual cylinder according to the PID control law (indicated by period $\tau$4) is performed, the processing for inputting the detection signal of each sensor (indicated by period $\tau$2) or the like is not performed. When the feedback control for individual cylinder according to the PID control law is not performed, on the other hand, the processing can be decentralized such that the processing for inputting the detection signal of each sensor or the like is performed during thus vacated period, thereby substantially shortening the processing time. Therefore, the feedback control for individual cylinder coping with the increase in the engine speed Ne can be performed.

Figure 39:
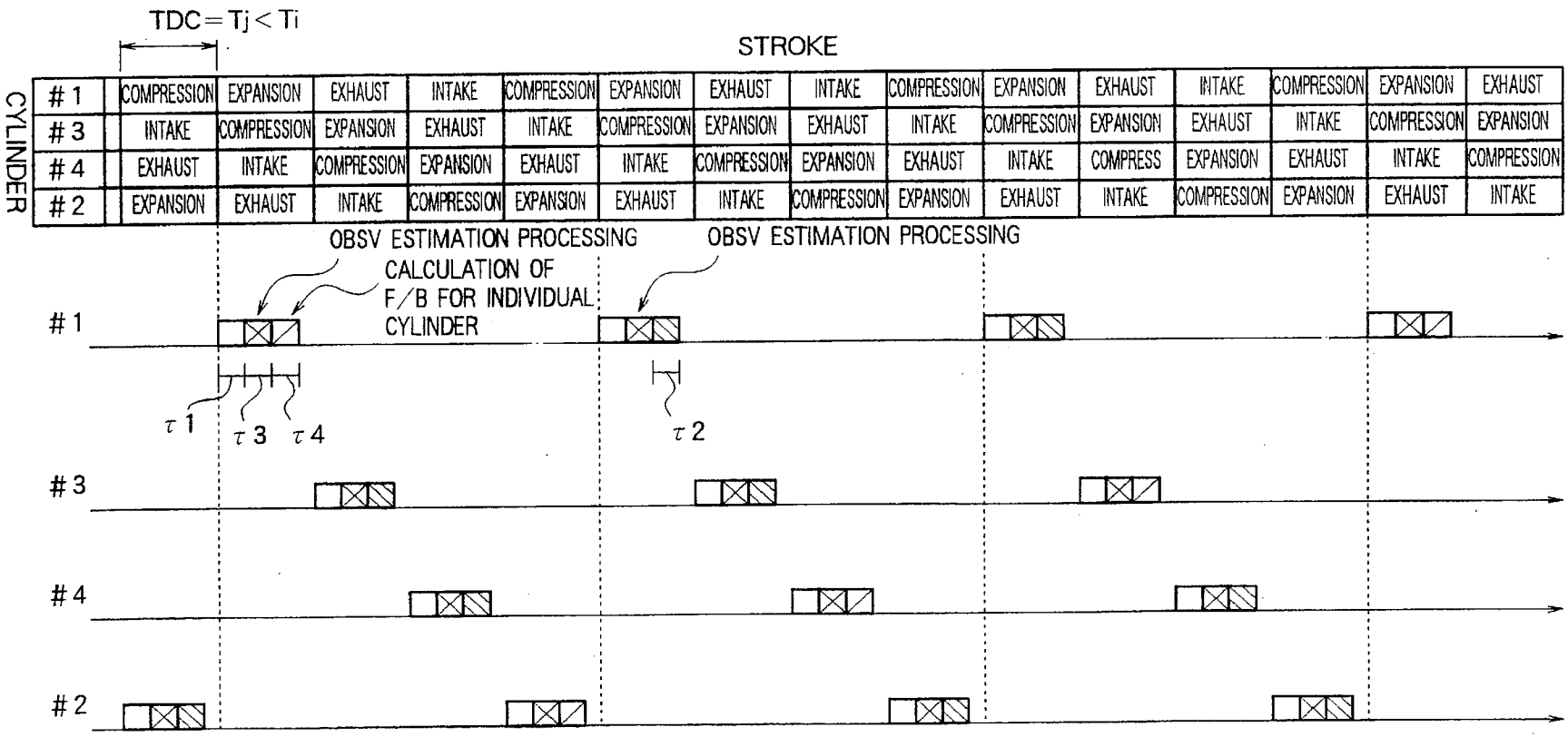
FIG. 39 is a stroke chart explaining another action of thinning-out processing of the third feedback system in the fifth embodiment.

In the thinning-out processing in FIG. 39 where the exhaust stroke is assumed to be repeated in the order of cylinder #1→#3→#4→#2, 3 TDCs are taken as one set in which the estimation processing of air/fuel ratio of individual cylinder #nA/F by the observer OBSV and the feedback calculation according to the PID control law are performed only in the first TDC, while the remaining 2 TDCs are subjected to the estimation processing of air/fuel ratio of individual cylinder #nA/F by the observer OBSV alone and their feedback calculation according to the PID control law is stopped. This thinning-out processing is repeatedly performed. In accordance with this thinning-out processing, the feedback calculation for individual cylinder is repeated every 12 TDCs, while the phase of the thinning-out processing is shifted by 2 TDCs between the cylinders. Then, as in the case of the example shown in FIG. 38, when the feedback control for individual cylinder according to the PID control law (indicated by period $\tau$4) is performed, the processing for inputting the detection signal of each sensor (indicated by period $\tau$2) or the like is not performed. When the feedback control for individual cylinder according to the PID control law is not performed, on the other hand, the processing can be decentralized such that the processing for inputting the detection signal of each sensor or the like is performed during thus vacated period, thereby substantially shortening the processing time. Therefore, the feedback control for individual cylinder coping with the increase in the engine speed Ne can be performed.

FIGS. 38 and 39 merely show examples of thinning-out processing. Other techniques may be adopted as long as the thinning-out processing is performed such that the feedback control according to the PID control law in each PID path becomes uniform on the basis of time.

Now, returning to FIG. 35, explanation will continue. When the judgment is negative at step S8216, the processing proceeds to step S8222 where it is judged whether the engine speed is within another predetermined range or not. In this embodiment, the processing proceeds to steps S8224 to S8228 in the case of 4,500 rpm<Ne≦6,000 rpm, whereby, as indicated in the judgment condition chart of FIG. 36, the estimation processing of air/fuel ratio of individual cylinder #nA/F by the observer OBSV is performed in synchronization with every TDC, while the processing of feedback calculation for individual cylinder according to the PID control law is stopped.

Namely, the first control block CH1 shown in FIG. 34 switches off the demultiplexer DMPX and multiplexer MPX from all the PID blocks so as to make them change over to the memory block REF side. Here, a predetermined value (e.g., 1.0) has been stored in all the memory blocks REF beforehand. When the above-mentioned change-over of connection is made, all the air/fuel ratio correction coefficients for individual cylinders #nKLAF are fixed at this predetermined value. Then, even when the calculation processing at step S900 is performed, the feedback control for individual cylinder is substantially stopped. Alternatively, in lieu of such a predetermined value, the air/fuel ratio correction coefficient for individual cylinder #nKLAF obtained just before may be held in the memory blocks REF so that the feedback control is performed according to thus held air/fuel ratio correction coefficient for individual cylinder #nKLAF. In any case, since the calculation processing according to the PID control law can be eliminated, the process can respond to the shortening of TDC period caused by the increase in engine speed Ne. On the other hand, the second control block CH2 commands the observer OBSV to continue the estimation processing.

First, at step S8224, as in the case of steps S8204 to S8212, the air/fuel ratio of individual cylinder #nA/F is estimated. Then, at step S8226, all the air/fuel ratio correction coefficients for individual cylinders #nKLAF are fixed to the above-mentioned predetermined value or the air/fuel ratio correction coefficient for individual cylinder #nKLAF obtained just before (i.e., before this processing is started) is held.

Thereafter, at step S900, the feedback control with respect to the output fuel injection amount #jTout is substantially stopped.

When the judgment is negative at step S8222, the internal combustion engine 10 is rotating very fast. In this case, the processing proceeds to steps S8228 to S8230 where both the estimation processing of the air/fuel ratio of individual cylinder #nA/F by the observer OBSV and the calculation processing of the air/fuel ratio correction coefficient for individual cylinder #nKLAF according to the PID control law are stopped. Namely, the first control block CH1 in FIG. 34 cuts off all the feedback paths with respect to the demultiplexer DMPX and multiplexer MPX, while the second control block CH2 commands the observer OBSV to stop the estimation processing. Accordingly, when the engine speed Ne decreases again, the recurrence formula type observer OBSV restarts the estimation processing from the initial state.

As explained in the foregoing, in accordance with this embodiment, when the TDC period becomes shorter as the engine speed Ne increases, the feedback control for individual cylinder is thinned out or stopped according to the engine speed Ne, thereby securing vacant times. Accordingly, the processing of the engine control unit 36 can be distributed to thus vacated times. As a result, the processing of the engine control unit 36 is substantially shortened so as to perform the feedback control for individual cylinder coping with the increase in engine speed Ne. Further, in the above-mentioned thinning-out processing, while the calculation of the air/fuel ratio correction coefficient for individual cylinder #nKLAF according to the PID control law is thinned out, the estimation processing by the observer OBSV is continued. Accordingly, without discontinuing the estimation processing by the observer OBSV in a recurrence formula type, the accuracy in the air/fuel ratio of individual cylinder #nA/F can be maintained, whereby the stability in control can be secured.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application Nos. 38856/1995 (7-38856) filed on Feb. 27, 1995, 38867/1995 (7-38867) filed on Feb. 27, 1995, and 38868/1995 (7-38868) filed on Feb. 27, 1995, are hereby incorporated by reference.

What is claimed is:

1. A fuel injection amount control apparatus for internal combustion engine comprising:

an air/fuel ratio detecting means disposed at a collective portion of an exhaust system of a muliple cylinder internal combustion engine, said air/fuel ratio detecting means detecting an air/fuel ratio of an air-fuel mixture discharged from each cylinder of said muliple cylinder internal combustion engine;

an air/fuel ratio estimating means for estimating an air/fuel ratio of individual cylinder, said air/fuel ratio estimating means setting an observer in which, based on a model defining a behavior of the air/fuel ratio in the exhaust system of said muliple cylinder internal combustion engine, said air/fuel ratio is input and a condition within said exhaust system is observed; and an air/fuel ratio correction coefficient calculating means for calculating, based on said estimated air/fuel ratio of individual cylinder, an air/fuel ratio correction coefficient for individual cylinder which corrects a fuel injection amount for individual cylinder supplied to each cylinder of said multiple cylinder internal combustion engine so as to reduce fluctuation in air/fuel ratios among the cylinders;

said apparatus further comprising:

an air/fuel ratio control stopping means which, when said estimated air/fuel ratio is at a value outside of a predetermined range, stops the calculation of said air/fuel ratio correction coefficient for individual cylinder concerning the corresponding cylinder and an air/fuel ratio estimation processing continuing means which continues the estimation processing of said air/fuel ratio when the calculation of said air/fuel ratio correction coefficient is stopped.

2. A fuel injection amount control apparatus for internal combustion engine according to claim 1, further comprising a predetermined range setting means which sets said predetermined range based on a target air/fuel ratio supplied to said multiple cylinder internal combustion engine.

3. A fuel injection amount control apparatus for internal combustion engine comprising:

an air/fuel ratio detecting means disposed at a collective portion of an exhaust system of a muliple cylinder internal combustion engine, said air/fuel ratio detecting means detecting an air/fuel ratio of an air-fuel mixture discharged from each cylinder of said muliple cylinder internal combustion engine;

an air/fuel ratio estimating means for estimating an air/fuel ratio of individual cylinder, said air/fuel ratio estimating means setting an observer in which, based on a model defining a behavior of the air/fuel ratio in the exhaust system of said muliple cylinder internal combustion engine, said air/fuel ratio is input and a condition within said exhaust system is observed; and an air/fuel ratio correction coefficient calculating means for calculating, based on said estimated air/fuel ratio of individual cylinder, an air/fuel ratio correction coefficient for individual cylinder which corrects a fuel injection amount for individual cylinder supplied to each cylinder of said multiple cylinder internal combustion engine so as to reduce fluctuation in air/fuel ratios among the cylinders;

said apparatus further comprising:

an air/fuel ratio control stopping means which, when said estimated air/fuel ratio is at a value outside of a predetermined range, stops the calculation of said air/fuel ratio correction coefficient for individual cylinder concerning all the cylinders and an air/fuel ratio estimation processing continuing means which continues the estimation processing of said air/fuel ratio when the calculation of said air/fuel ratio correction coefficient is stopped.

4. A fuel injection amount control apparatus for internal combustion engine according to claim 3, further comprising a predetermined range setting means which sets said predetermined range based on a target air/fuel ratio supplied to said multiple cylinder internal combustion engine.

5. A fuel injection amount control apparatus for internal combustion engine comprising:

an air/fuel ratio detecting means disposed at a collective portion of an exhaust system of a muliple cylinder internal combustion engine, said air/fuel ratio detecting means detecting an air/fuel ratio of an air-fuel mixture discharged from each cylinder of said muliple cylinder internal combustion engine;

an air/fuel ratio estimating means for estimating an air/fuel ratio of individual cylinder, said air/fuel ratio estimating means setting an observer in which, based on a model defining a behavior of the air/fuel ratio in the exhaust system of said muliple cylinder internal combustion engine, said air/fuel ratio is input and a condition within said exhaust system is observed; and an air/fuel ratio correction coefficient calculating means for calculating, based on said estimated air/fuel ratio of individual cylinder, an air/fuel ratio correction coefficient for individual cylinder which corrects a fuel injection amount for individual cylinder supplied to each cylinder of said multiple cylinder internal combustion engine so as to reduce fluctuation in air/fuel ratios among the cylinders;

said apparatus further comprising:

an air/fuel ratio control stopping means which, when amount of change in said detected air/fuel ratio at the collective portion is large, stops the calculation of said air/fuel ratio correction coefficient and an air/fuel ratio estimation processing continuing means which continues the estimation processing of said air/fuel ratio when the calculation of said air/fuel ratio correction coefficient is stopped.

6. A fuel injection amount control apparatus for internal combustion engine comprising:

an air/fuel ratio detecting means disposed at a collective portion of an exhaust system of a muliple cylinder internal combustion engine, said air/fuel ratio detecting means detecting an air/fuel ratio of an air-fuel mixture discharged from each cylinder of said muliple cylinder internal combustion engine;

an air/fuel ratio estimating means for estimating an air/fuel ratio of individual cylinder, said air/fuel ratio estimating means setting an observer in which, based on a model defining a behavior of the air/fuel ratio in the exhaust system of said muliple cylinder internal combustion engine, said air/fuel ratio is input and a condition within said exhaust system is observed;

a first air/fuel ratio correction coefficient calculating means for calculating a first air/fuel ratio correction coefficient which corrects a fuel injection amount such that said air/fuel ratio coincides with a target air/fuel ratio; and a second air/fuel ratio correction coefficient calculating means for calculating, based on said estimated air/fuel ratio of individual cylinder, a second air/fuel ratio correction coefficient for individual cylinder which corrects a fuel injection amount for individual cylinder supplied to each cylinder of said multiple cylinder internal combustion engine so as to reduce fluctuation in air/fuel ratios among the cylinders;

said apparatus further comprising:

an air/fuel ratio control stopping means which, when amount of change in said first air/fuel ratio correction coefficient is large, stops the calculation of said second air/fuel ratio correction coefficient and an air/fuel ratio estimation processing continuing means which continues the estimation processing of said air/fuel ratio when the calculation of said second air/fuel ratio correction coefficient is stopped.

7. A fuel injection amount control apparatus for internal combustion engine comprising:

an air/fuel ratio detecting means disposed at a collective portion of an exhaust system of a muliple cylinder internal combustion engine, said air/fuel ratio detecting means detecting an air/fuel ratio of an air-fuel mixture discharged from each cylinder of said muliple cylinder internal combustion engine;

an air/fuel ratio estimating means for estimating an air/fuel ratio of individual cylinder, said air/fuel ratio estimating means setting an observer in which, based on a model defining a behavior of the air/fuel ratio in the exhaust system of said muliple cylinder internal combustion engine, said air/fuel ratio is input and a condition within said exhaust system is observed; and an air/fuel ratio correction coefficient calculating means for calculating, based on said estimated air/fuel ratio of individual cylinder, an air/fuel ratio correction coefficient for individual cylinder which corrects a fuel injection amount supplied to each cylinder of said multiple cylinder internal combustion engine so as to reduce fluctuation in air/fuel ratios among the cylinders;

said apparatus further comprising an abnormality judging means which judges whether or not there is abnormality in a sensor for measuring operational and environmental conditions of said multiple cylinder internal combustion engine and, when it is judged that there is abnormality, stops the calculation processing of said air/fuel ratio correction coefficient calculating means or changes the calculating speed of said air/fuel ratio correction coefficient for individual cylinder to a value smaller than that in a normal state.

8. A fuel injection amount control apparatus for internal combustion engine comprising:

an air/fuel ratio detecting means disposed at a collective portion of an exhaust system of a muliple cylinder internal combustion engine, said air/fuel ratio detecting means detecting an air/fuel ratio of an air-fuel mixture discharged from each cylinder of said muliple cylinder internal combustion engine;

an air/fuel ratio estimating means for estimating an air/fuel ratio of individual cylinder, said air/fuel ratio estimating means setting an observer in which, based on a model defining a behavior of the air/fuel ratio in the exhaust system of said muliple cylinder internal combustion engine, said air/fuel ratio is input and a condition within said exhaust system is observed; and an air/fuel ratio correction coefficient calculating means for calculating, based on said estimated air/fuel ratio of individual cylinder, an air/fuel ratio correction coefficient for individual cylinder which corrects a fuel injection amount supplied to each cylinder of said multiple cylinder internal combustion engine so as to reduce fluctuation in air/fuel ratios among the cylinders;

said apparatus further comprising a control means which, when engine speed exceeds a predetermined value, while continuing the estimation processing of the air/fuel ratio of individual cylinder by said air/fuel ratio estimating means, successively shifts and stops the calculation processing of the air/fuel ratio correction coefficient for individual cylinder by said air/fuel ratio correction coefficient calculating means in the order of stroke of the cylinders.

9. A fuel injection amount control apparatus for internal combustion engine comprising:

an air/fuel ratio detecting means disposed at a collective portion of an exhaust system of a multiple cylinder internal combustion engine, said air/fuel ratio detecting means detecting an air/fuel ratio of an air-fuel mixture discharged from each cylinder of said multiple cylinder internal combustion engine;

an air/fuel ratio estimating means for estimating an air/fuel ratio of individual cylinder, said air/fuel ratio estimating means setting an observer in which, based on a model defining a behavior of the air/fuel ratio in the exhaust system of said multiple cylinder internal combustion engine, said air/fuel ratio is input and a condition within said exhaust system is observed; and an air/fuel ratio correction coefficient calculating means for calculating, based on said estimated air/fuel ratio of individual cylinder, an air/fuel ratio correction coefficient for individual cylinder which corrects a fuel injection amount supplied to each cylinder of said multiple cylinder internal combustion engine so as to reduce fluctuation in air/fuel ratios among the cylinders;

said apparatus further comprising a control means which, when engine speed exceeds a predetermined value, while continuing the estimation processing of the air/fuel ratio of individual cylinder by said air/fuel ratio estimating means, fixes the air/fuel ratio correction coefficient for individual cylinder calculated by said air/fuel ratio correction coefficient calculating means to a predetermined value or holds said air/fuel ratio correction coefficient for individual cylinder at an air/fuel ratio correction coefficient obtained just before so as to correct the fuel injection amount for individual cylinder supplied to each of said cylinders.

10. A fuel injection amount control apparatus for internal combustion engine comprising:

an air/fuel ratio detecting means disposed at a collective portion of an exhaust system of a multiple cylinder internal combustion engine, said air/fuel ratio detecting means detecting an air/fuel ratio of an air-fuel mixture discharged from each cylinder of said multiple cylinder internal combustion engine;

an air/fuel ratio estimating means for estimating an air/fuel ratio of individual cylinder, said air/fuel ratio estimating means setting an observer in which, based on a model defining a behavior of the air/fuel ratio in the exhaust system of said multiple cylinder internal combustion engine, said air/fuel ratio is input and a condition within said exhaust system is observed; and an air/fuel ratio correction coefficient calculating means for calculating, based on said estimated air/fuel ratio of individual cylinder, an air/fuel ratio correction coefficient for individual cylinder which corrects a fuel injection amount supplied to each cylinder of said multiple cylinder internal combustion engine so as to reduce fluctuation in air/fuel ratios among the cylinders;

said apparatus further comprising a control means which, when engine speed exceeds a predetermined value, while continuing the estimation processing of the air/fuel ratio of individual cylinder by said air/fuel ratio estimating means, stops the calculation processing of the air/fuel ratio correction coefficient for individual cylinder by said air/fuel ratio correction coefficient calculating means.

* * * * *